US005799562A

United States Patent [19]

Weinberg

[11] Patent Number: 5,799,562

[45] Date of Patent: Sep. 1, 1998

[54] REGENERATIVE BRAKING METHOD AND APPARATUS THEREFOR

[76] Inventor: Morgan W. Weinberg, 602 N. Jordan St. #104, Alexandria, Va. 22304

[21] Appl. No.: 614,544

[22] Filed: Mar. 13, 1996

[51] Int. Cl.[6] ..... F01B 3/02

[52] U.S. Cl. ..... 92/12.2; 91/505; 91/506; 60/414

[58] Field of Search ..... 60/408, 414; 91/505, 91/506; 92/12.2

[56] References Cited

U.S. PATENT DOCUMENTS

| | | | |
|---|---|---|---|
| 1,970,133 | 8/1934 | Ferris et al. | 91/505 |
| 4,132,283 | 1/1979 | McCurry . | |
| 4,163,367 | 8/1979 | Yeh . | |
| 4,188,859 | 2/1980 | VanWagenen et al. | 91/506 |
| 4,196,587 | 4/1980 | Shiber . | |
| 4,246,978 | 1/1981 | Schulz et al. | 60/414 |
| 4,290,268 | 9/1981 | Lowther . | |
| 4,351,409 | 9/1982 | Malik . | |
| 4,644,850 | 2/1987 | Sasaya et al. . | |
| 4,653,269 | 3/1987 | Johnson . | |
| 4,741,251 | 5/1988 | Hayashi et al. . | |
| 4,774,811 | 10/1988 | Kawamura . | |
| 4,800,801 | 1/1989 | van Zweeden . | |
| 4,852,418 | 8/1989 | Armstrong . | |
| 4,875,834 | 10/1989 | Higuchi et al. . | |
| 4,880,361 | 11/1989 | Ikeda et al. . | |
| 4,986,383 | 1/1991 | Evans | 60/414 |
| 5,086,689 | 2/1992 | Masuda . | |

*Primary Examiner*—F. Daniel Lopez
*Attorney, Agent, or Firm*—Richard C. Litman

[57] ABSTRACT

A method and apparatus for braking a rotating element including a reversible eccentric ring or axial piston pump which may be selectably operatively connected to a rotating element. When either pump is configured to compress ambient fluid into a reservoir, the compressive resistance is transmitted to the rotating element, braking it. When either pump is configured to expand fluid from the reservoir, the resultant torque generated is transmitted to the rotating element, driving it. The invention provides mechanisms for rapidly configuring either pump to compress or expand fluid, and for adjusting pump displacement, respecting a user's demand.

37 Claims, 55 Drawing Sheets

VARIABLE DISPLACEMENT ECCENTRIC RING PUMP
0" ECCENTRIC RING OFFSET – MODE: NEUTRAL UNDAMPED

VARIABLE DISPLACEMENT ECCENTRIC RING PUMP
0.50" ECCENTRIC RING OFFSET – MODE: COMPRESSION UNDAMPED

VARIABLE DISPLACEMENT ECCENTRIC RING PUMP
(6-PISTONS); PRESSURE DIFFERENCE = 100 PSI
.5" ECCENTRIC RING OFFSET, 7.30 $in^3$ /revolution
UNDAMPED VARIABLE DISPLACEMENT ECCENTRIC RING PUMP
0" ECCENTRIC RING OFFSET – MODE: NEUTRAL
30° INLET AND 30° OUTLET DAMPING PRESSURE VS. ANGLE OF ROTATION FOR A CYLINDER TAKING IN AND RELEASING AIR FOR A TRANSITION ANGLE OF 30°

VARIABLE DISPLACEMENT ECCENTRIC RING PUMP
0.50" ECCENTRIC RING OFFSET – MODE: COMPRESSION
30° INLET and 30° OUTLET DAMPING VARIABLE DISPLACEMENT ECCENTRIC RING PUMP
(6-PISTONS); PRESSURE DIFFERENCE = 100 PSI
.5" ECCENTRIC RING OFFSET, 7.30 $in^3$/revolution
30° INLET AND 30° OUTLET DAMPING VARIABLE DISPLACEMENT ECCENTRIC RING PUMP
−0.50" ECCENTRIC RING OFFSET − MODE: EXPANSION
30° INLET AND 30° OUTLET DAMPING VARIABLE DISPLACEMENT ECCENTRIC RING PUMP
(6-PISTONS); PRESSURE DIFFERENCE = 100 PSI
-.5" ECCENTRIC RING OFFSET, 7.30 $in^3$/revolution
30° INLET AND 30° OUTLET DAMPING

VARIABLE DISPLACEMENT AXIAL PISTON PUMP
(6 – PISTONS, 3 ROWS) MODE: EXPANSION

VARIABLE DISPLACEMENT AXIAL PISTON PUMP
(150 – PISTONS, 3 ROWS) MODE: EXPANSION

VARIABLE DISPLACEMENT AXIAL PISTON PUMP
(150-PISTONS, 3 ROWS)
AVERAGE TORQUE VS. SWASH PLATE DEFLECTION

VARIABLE DISPLACEMENT AXIAL PISTON PUMP
(150 PISTONS, 3 ROWS)
SWASH PLATE MOMENT ABOUT PIN
AXIS VS. INLET/OUTLET PRESS. DIFF.

REGENERATIVE BRAKING METHOD AND APPARATUS THEREFOR

BACKGROUND OF THE INVENTION

1. Field of the Invention

This invention relates to braking methods and apparatuses. Specifically, this invention relates to regenerative braking methods and apparatuses which promote recovery of kinetic energy from braking, and employment of the recovered energy to impart drive.

2. Description of the Prior Art

Braking a rotating element, such as the wheel of a bicycle or automobile, by operably connecting it to a compressor is not new. The compressor transmits to the rotating element the resistance the compressor experiences while compressing fluid into a reservoir. Employing this compressed fluid to drive the rotating element also is well known. Compressed fluid from the reservoir is expanded in an expander, generating a drive torque which is transmitted to the rotating element. Prior inventions, however, have failed to fully realize the potential energy recoverable from braking. Prior inventions also have failed to provide users efficient means to control the amount of braking or drive imposed on a rotating element.

For example, U.S. Pat. No. 4,132,283, issued Jan. 2, 1979, to Jere L. McCurry, describes a braking apparatus including a compressor operatively connected to a transmission shaft and reservoir which receives fluid from the compressor. McCurry's invention also describes driving the rotating element by feeding compressed fluid from the reservoir to a separate expander operatively connected to the transmission shaft. McCurry's invention seems to be limited to operation with an accumulator from which the compressor draws noncompressible fluid for compression and to which the expander expels fluid after expansion.

U.S. Pat. No. 4,163,367, issued Aug. 7, 1979, to George C. Yeh, describes a braking apparatus similar to McCurry's. Yeh's invention, however, depicts employing a compressible fluid. Yeh's invention describes a reversible compressor-expander operatively connected to the transmission shaft. The invention also discusses electrically heating fluid within a reservoir to increase fluid pressure.

U.S. Pat. No. 4,196,587, issued Apr. 8, 1980, to Samuel Shiber, describes a braking apparatus somewhat similar to the above references including a reversible compressor-expander operatively connected to a transmission shaft. However, Shiber's invention describes pistons and cylinders to carry out compression and expansion. Shiber's invention seems to be limited to operation with a non-compressible fluid accumulator connected to the compressor-expander as described in McCurry's invention.

U.S. Pat. No. 4,290,268, issued Sep. 22, 1981, to Frank E. Lowther, describes an improvement to a braking apparatus including feeding compressed gas from a reservoir to a combustion chamber. The improvement is not directly pertinent to the instant invention. However, the invention improved seems to be similar to the above references, but includes a rotary vane type compressor. The compressor appears to be reversible and employable as an expander. In the invention Lowther claims to improve, regulation of braking torque applied to a rotating element seems to be regulated by varying the pressure ratio across the compressor. The pressure ratio is adjusted by varying the aperture at the outlet of the compressor. Eccentricity of the compressor remains constant.

U.S. Pat. No. 4,351,409, issued Sep. 28, 1982, to Marvin J. Malik, describes a braking apparatus similar to the above references including a compressor of unspecified type operably connected to the vehicle transmission. Malik's invention emphasizes employing a sun gear and pinions to adapt a regenerative braking means to an infinitely variable transmission. Malik's novelty seems to concentrate on means for engaging a compressor-expander, rather than means of storing energy associated with braking. Malik's invention, like others aforementioned, also is burdened with an accumulator feed system.

U.S. Pat. No. 4,653,269, issued Mar. 31, 1987, to David E. Johnson, describes a braking apparatus similar to the above references including a piston and cylinder-type compressor. The invention purports to provide compressed air to a combustion chamber to assist in cold-engine ignition or to boost acceleration when the vehicle is accelerating from rest.

U.S. Pat. No. 4,774,881, issued Oct. 4, 1988, to Hideo Kawamura, describes a thermal recovery system including a turbine mounted across an exhaust manifold of a vehicle. The turbine may be employed to store electrical power or as a means to deliver compressed air to a combustion chamber. Kawamura's invention seems to focus on harnessing heat energy associated with engine exhaust, not compressing fluid in a cylinder.

U.S. Pat. No. 4,644,850, issued Feb. 24, 1987, to Hisanobu K. Sasaya et al., describes a fluid machine. The device includes a plurality of axial pistons radially diverged about a cylinder barrel. The piston cylinders cycle through fluid communication with high and low pressure ports. Each piston is mounted on a wobble plate with a connecting rod terminating in a ball joint. The invention does not provide for varying pump displacement.

U.S. Pat. No. 4,741,251, issued May 3, 1988, to Tsutomu Hayashi et al., describes a swash plate assembly for a swash plate type hydraulic pressure device. The device includes a plurality of axial pistons radially diverged about a cylinder barrel. The piston cylinders cycle through fluid communication with high and low pressure ports. Each piston has a rounded end that slidingly contacts a wobble plate. The invention does not provide for varying pump displacement.

U.S. Pat. No. 4,800,801, issued Jan. 31, 1989, to Adriaan van Zweeden, describes a pump. The device includes a plurality of axial pistons radially diverged about a cylinder barrel. The piston cylinders cycle through fluid communication with high and low pressure ports. Each piston has a socket that slidingly receives a ball mounted on a wobble plate. The invention does not provide for varying pump displacement.

U.S. Pat. No. 4,852,418, issued Aug. 1, 1989, to Richard J. Armstrong, describes a nutating drive. The device includes a plurality of axial pistons radially diverged about a cylinder barrel. The piston cylinders cycle through fluid communication with high and low pressure ports. Each piston has a socket that slidingly receives a first ball at the end of a connecting rod. A wobble plate has sockets for receiving the second ball at the other end of the connecting rod. The invention also includes a rod extending from the wobble plate that terminates in a ball. The ball is received in the socket of a lever. The lever is articulated to adjust the angle of the wobble plate, thus affecting pump displacement.

U.S. Pat. No. 4,875,834, issued Oct. 24, 1989, to Teruo Higuchi et al., describes a wobble plate compressor with variable displacement mechanism. The device is similar to the Armstrong device except the displacement adjustment mechanism. In the Higuchi patent, displacement mechanism includes a flange extending from the wobble plate with a transverse pin at its distal end. The pin is received in a groove disposed in a cam rotor.

U.S. Pat. No. 4,880,361, issued Nov. 14, 1989, to Hayato Ikeda et al., describes a multi-piston swash plate type compressor with arrangement for internal sealing and for uniform distribution of refrigerant to cylinder bores. The invention includes a plurality of axial pistons radially diverged in concentric rings in a cylinder barrel. The piston cylinders cycle through fluid communication with high and low pressure ports. The pistons in the inner ring urges fluid into the cylinders of the outer ring.

U.S. Pat. No. 5,086,689, issued Feb. 11, 1992, to Kenji Masuda, describes an axial piston machine. The apparatus includes a plurality of axial pistons radially diverged about a cylinder barrel. The piston cylinders cycle through fluid communication with damped high and low pressure ports. Each piston a rounded end that slidingly contacts a wobble plate. The invention provides for varying pump displacement with two pistons having rounded ends that slidingly contact the outer edges of the wobble plate and maintain the wobble plate at a predetermined angle.

None of the above references, taken alone or in combination, are seen as teaching or suggesting the presently claimed regenerative braking method and apparatus therefor.

SUMMARY OF THE INVENTION

The present invention is a selectively employable braking method and apparatus. The novel method includes operably connecting a pump to a rotating element. When the pump is configured to compress fluid, it compresses fluid into a reservoir. The pump transmits to the rotating element the compressive resistance the pump experiences. The method also includes storing the heat generated during fluid compression, as taught by the ideal gas law. The method further includes reclaiming the energy and driving the rotating element by configuring the pump to expand fluid and transmitting to the rotating element the resultant drive torque generated.

The novel apparatus includes a-mechanical or electromechanical enabling lever which permits the user to engage and disengage the apparatus with the rotating element. Once the invention is enabled, the user may displace a demand lever in one direction to brake the rotating element, such as a bicycle wheel or an automotive transmission shaft, and store the associated kinetic energy. The user may displace the demand lever in the other direction to employ the stored energy to drive the rotating element.

The invention includes a pump and a reservoir. The pump has an input shaft operably connected to a rotating element. When braking is desired, the user actuates a demand lever toward a second direction, configuring the pump to compress fluid into the reservoir. The pump brakes the rotating element by transmitting to it the resistance the pump experiences while compressing fluid into the reservoir.

When drive is desired, the user articulates the demand lever toward a first direction, configuring the pump to expand fluid from the reservoir. The compressed fluid is expanded, generating a drive torque. The pump transmits the torque to the rotating element and drives it.

The pump, preferably, is of the eccentric ring or axial piston type. The eccentric ring pump includes a housing and a centrally, sealingly and rotatably mounted piston housing. A plurality of pistons are sealingly and rotatably mounted about the piston housing. Each piston has a foot pivotally mounted on an inner ring. The inner ring is slidingly maintained by an eccentric ring. The eccentric ring is slidingly received by the pump housing and may be offset relative to the piston housing, creating a narrow and a wide passage between the eccentric ring and the central axis of the piston housing. When configured to compress fluid, the pistons rotating through the wide passage receive fluid and the pistons rotating through the narrow passage compress and expel the fluid. When configured to expand fluid, the pistons rotating through the narrow passage receive fluid and the pistons rotating through the wide passage expand and expel fluid.

The user may increase the eccentricity of the eccentric ring pump, compelling it to compress a greater volume of fluid. Compressing a greater volume is attended by greater compressive resistance that may be transmitted to the rotating element for braking. While expanding, the user may increase eccentricity of the pump, compelling it to expand a greater volume of fluid. Expanding a greater volume generates greater drive that may be transmitted to the rotating element.

Although eccentric ring pumps work well for low compression applications, high pressure applications for the invention rely on an axial piston-type pump. High-pressure eccentric ring pump applications are often attended by high pressure spikes and degrading vibration which may hasten the life of an eccentric ring pump. Axial piston-type pumps, on the other hand, are better suited for smooth, high pressure power transmission.

The axial piston pump contemplated for this invention includes a housing. A chamber barrel, having a plurality of radially diverged chambers in concentric groupings therethrough, each with a piston disposed therein, is rotatably mounted on the housing. Each piston is fixed to a connecting rod that terminates in a ball. Each ball is slidingly received in a socket in a swash plate. The swash plate is rotatably mounted on the housing and pivots relative to the chamber barrel. The swash plate and chamber barrel are rotationally synchronized. As a piston farthest from the pivot is rotated toward the pivot, it is urged into its respective chamber, compressing the ambient fluid.

The present invention includes control mechanisms with which the user can rapidly configure the pump to compress or expand fluid. The invention also includes mechanisms for adjusting the displacement of the selected pump. The mechanisms are not limited to adjusting the displacement of a selected pump, but may be suited to applications requiring precise transitions under load, such as cylinders and valves, among others.

The preferred embodiment of the eccentric ring control is composed of entirely mechanical elements that simultaneously establish pump configuration and its displacement. The mechanism has three basic components: signal bar, centering member and pump housing. Each component moves independently with respect to the other components, however, the signal bar is biased relative to the centering member and relative to the pump housing. Signal bar-centering member offset linearly corresponds to demand lever displacement. As the user increases demand lever displacement in either the first or second direction, the user experiences increased resistance from the demand lever due to the bias between the signal bar and centering member. The user will experience the same resistance to displacement by the lever regardless of the centering member's location relative to the eccentric ring pump housing or pump eccentricity.

To brake the rotating element, the user displaces the demand lever toward a second direction and imparts offset between the signal bar and the centering member. The signal bar drives spools within cylinders disposed in the pump housing, initiating fluid communication in two, bifurcated fluid circuits. In the first fluid circuit, high pressure fluid from the reservoir flows through the spools and drives the centering member toward a first direction. The second fluid circuit is disposed between the centering member and the eccentric ring. As the pump compresses fluid into the reservoir, it generates a brake torque, which is transmitted to the rotating element, and a brake side force, which opposes translation of the centering member via the second fluid circuit. Whether configured to either brake or drive the rotating element, the eccentric ring tends toward zero offset due to side forces generated therein. The centering member overcomes these side forces in order to offset the eccentric ring in either direction. As the centering member is driven toward the first direction, it drives the signal bar and urges the spools to translate within their respective cylinders. The spools translate a distance equal to the original offset between the signal bar and centering member until they interrupt the fluid circuits. Once the fluid circuits are interrupted, pump eccentricity is fixed and the pump compresses fluid at a fixed displacement. Pump eccentricity linearly corresponds to demand lever displacement, however, after experiencing a brief hysteresis.

To drive the rotating element, the user displaces the demand lever toward the first direction and imparts offset between the signal bar and the centering member in the opposite direction from above. The signal bar drives spools within cylinders disposed in the pump housing, initiating fluid communication in the fluid circuits. In the first fluid circuit, high pressure fluid from the reservoir flows through the spools and drives the centering member toward the second direction. As the pump expands fluid, it generates a drive torque, which is transmitted to the rotating element, and a drive side force, which opposes translation of the centering member, via the second fluid circuit. Again, the centering member drives the signal bar and spools toward the second direction until the spools interrupt fluid communication. Once the fluid circuits are interrupted, pump eccentricity is fixed and the pump expands fluid at a fixed displacement. Pump eccentricity linearly corresponds to demand lever displacement, however, after a brief hysteresis.

The electromechanical embodiment of the eccentric ring pump control mechanisms include switches, microprocessors and solenoids. The user enables the device or registers a demand via the switches. The microprocessor, responsive to the switches, directs energy to the solenoids in an appropriate amount to connect or adjust the eccentricity of the pump.

The preferred embodiment of the axial piston pump control mechanism also is electromechanical. The mechanism includes switches, microprocessors and solenoids to convert the user's demand into an angular adjustment between the chamber barrel and the swash plate.

The invention also provides for auxiliary braking means to supplement the braking capability of the pump. The auxiliary braking means, preferably, includes a conventional caliper brake. Where the invention is implemented on a velocipede, the user simultaneously employs the auxiliary braking means sufficient to satisfy the difference between the braking need and the readily-discernible pump braking potential. Where the invention is implemented on a vehicle having locomotive means, a microprocessor monitors the brake demand the braking capability of the pump. The microprocessor employs the auxiliary braking means sufficient to satisfy the difference between the braking demand and the pump braking potential.

The invention further provides for regulating the amount of drive imparted by the pump on the rotating element. The user displaces the demand lever and sends a drive demand to a microprocessor. The microprocessor registers the drive demand and monitors the drive capability of the pump. The microprocessor directs the power plant of the vehicle to supplement the drive of the pump in an amount sufficient to satisfy the difference between the drive demand and the pump drive potential.

The invention provides for taking advantage of the thermal energy associated with fluid compression and expansion. The ideal gas law teaches that temperature increases as pressure increases the gas is compressed adiabatically. Dissipation of the heat energy during compression represents a loss of energy. The ability to store heat generated during compression has at least two advantages: First, removing thermal energy from a reservoir reduces the pressure therein. Reduced reservoir pressures permits implementation of lighter weight and less costly materials. Second, the stored heat may be reclaimed to re-pressurize a reservoir in which fluid pressure is reduced.

To take advantage of the thermal energy generated by the invention, the invention provides a reservoir surrounded by a chamber filled with a heat-absorbent material. As temperature increases within the reservoir, the material endothermically stores the heat energy. As pressure is relieved from the reservoir, the material releases heat back into the reservoir, increasing the pressure in the reservoir. The present invention harnesses energy previously dissipated. As a result, the invention employs more kinetic energy associated with braking and increases the amount of torque available to drive a rotating element than prior inventions.

The present invention employs ambient air as the compressible fluid, preferably, rather than a unique fluid within a closed circuit and accumulators. First, an apparatus unencumbered by extra equipment is desirable from a manufacturing, cost and weight standpoint. Second, elimination of the extra equipment reduces the number of failure modes which may plague an apparatus. Third, the energy storage medium is readily available, therefore employment of the invention is not provincially limited.

In consideration of the above, an object of the invention is to provide a method and an apparatus including selectable, variable and efficient means to store kinetic energy associated with braking in the form of compressed fluid and heat energy.

Another object of the invention is to provide a method and an apparatus including selectable, variable and efficient means to employ energy, stored in the form or compressed fluid and heat, to drive a body.

An additional object of the invention is to provide a method and an apparatus capable of sustaining operation, reliant solely on power derived from kinetic energy of the host vehicle.

A further object of the invention is to provide an effective mechanism for rapidly controlling displacement of a pump under high loading conditions.

Yet another object of the invention is to provide a damped, reversible pump which operates against high pressure heads at varying speeds for storing and reclaiming the kinetic energy associated with braking or driving a rotating element.

Yet an additional object of the invention is to provide a pump with minimal leakage from the high pressure port to the low pressure port.

Yet a further object of the invention is to provide a valve for converting a pump for compressing to expanding fluid while maintaining a constant rotational direction.

Still another object of the invention is to provide for radial passages in a pump which encourage a pump to breath well.

Still an additional object of the invention is to provide improved elements and arrangements thereof in an apparatus for the purposes described which is inexpensive, dependable and effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

I. REGENERATIVE BRAKING METHOD

Figure 1:
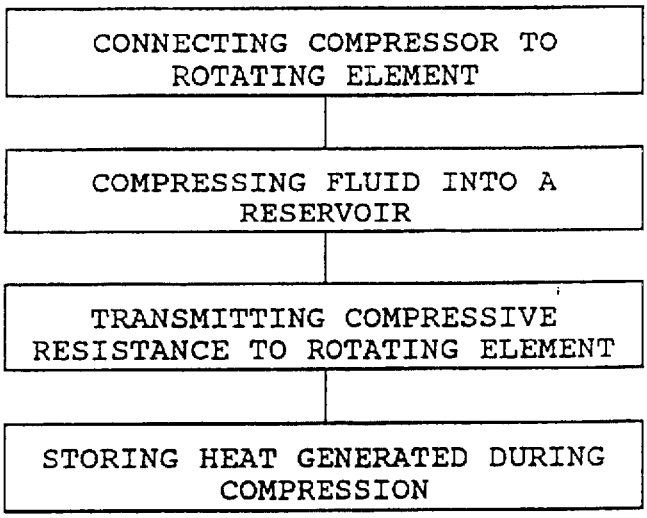
FIG. 1 is a flow diagram of a method claimed herein.

Referring to FIG. 1, the present method for braking a rotating element and storing the kinetic energy associated therewith includes rotationally fixing the output shaft of a pump relative to a target rotating element. The pump is configured to compress fluid. The rotating element urges rotation of the pump which compresses fluid into a reservoir. The fluid resists being compressed and exerts a pneumatic force against the pump. Braking is achieved by transmitting this compressive resistance to the rotating element.

As pressure increases within the fixed volume, temperature increases. The method includes storing this heat in a heat-absorbent medium. An aqueous salt solution is placed in association with the reservoir. As heat is generated in the reservoir, the solution endothermally absorbs and stores the heat. The solution may change phases during heat absorption.

Figure 2:
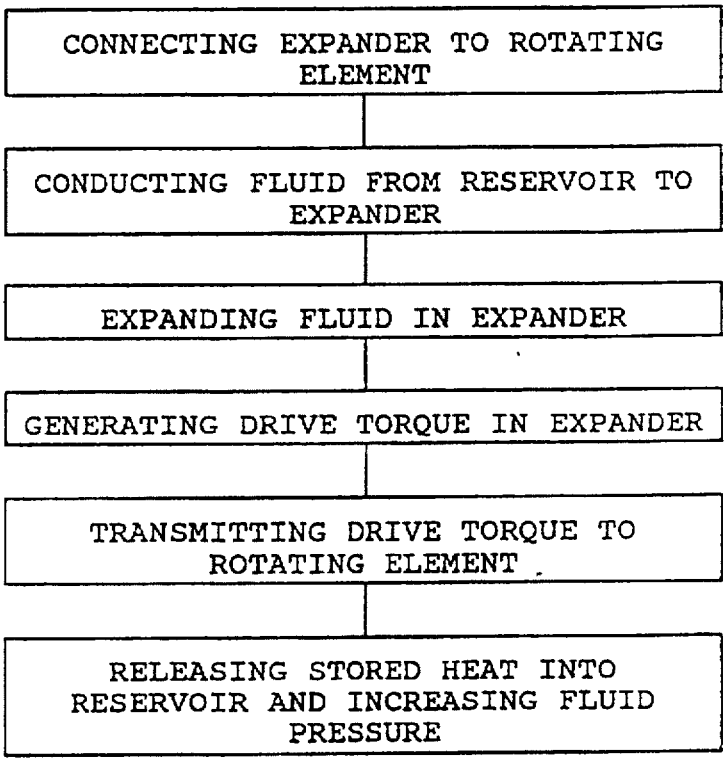
FIG. 2 is a flow diagram of a method claimed herein.

Referring to FIG. 2, the method also includes reclaiming the stored kinetic and thermal energy for driving the rotating element. Driving the element includes configuring the pump to expand fluid from the reservoir. Expanding the fluid within the pump generates a drive torque that is transmitted to the rotating element.

As fluid is expanded from the reservoir, pressure and temperature decrease adiabatically. The method includes releasing the stored heat energy back into the reservoir and increasing the fluid pressure therein. As the temperature decreases, the aqueous salt solution in association with the reservoir reacts exothermally and introduces the stored neat into the reservoir.

II. REGENERATIVE BRAKING APPARATUS

A. Operative Engagement Mechanisms.

Figure 3:
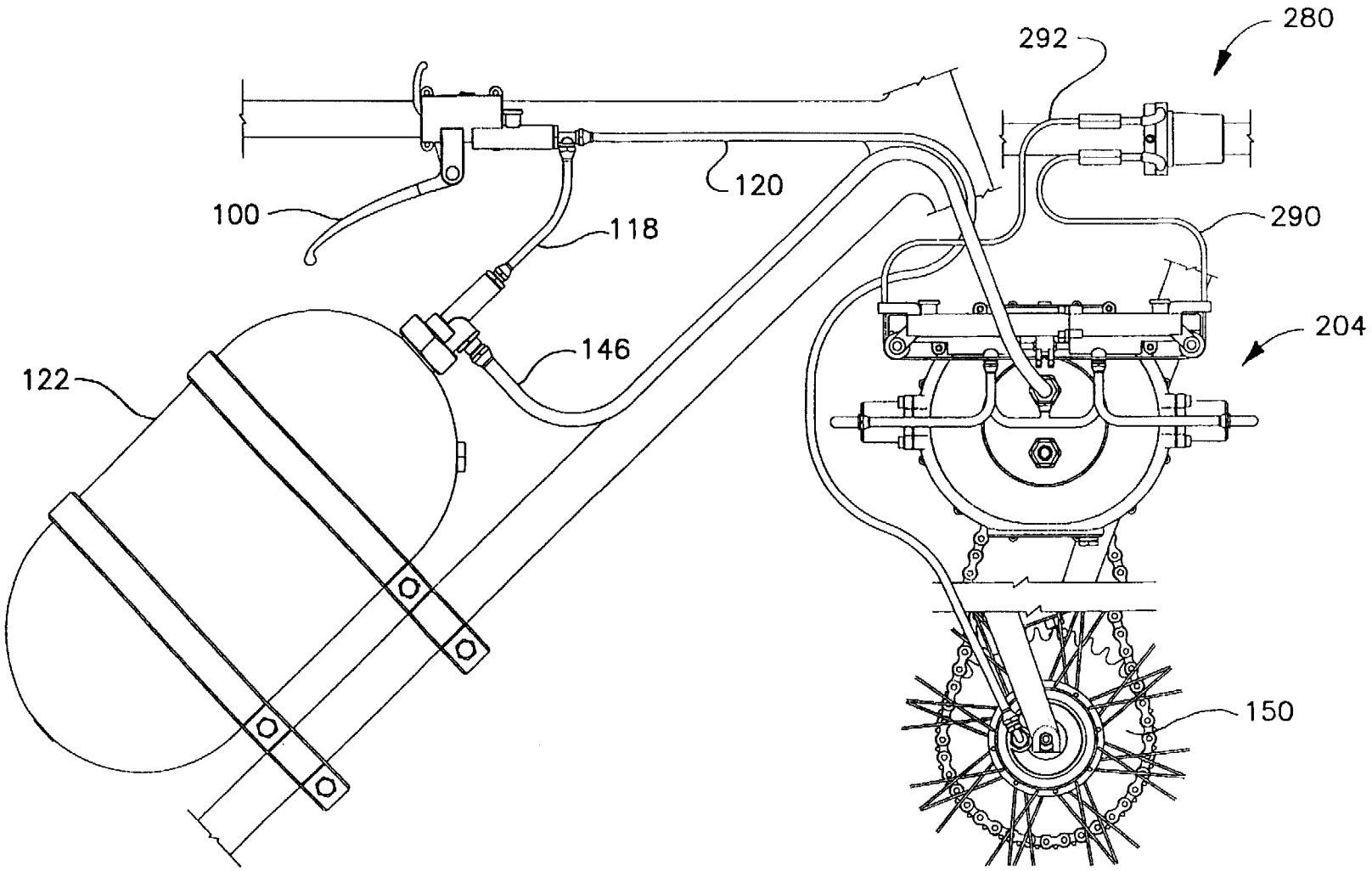
FIG. 3 is a partial environmental perspective view of the invention as implemented on a bicycle.

Referring to FIG. 3, a mechanical embodiment of the enabling means is shown. The enabling means includes an enabling lever 100 for selective employment of the instant apparatus. The user displaces the enabling sever 100 to engage and disengage the apparatus.

Figure 4:
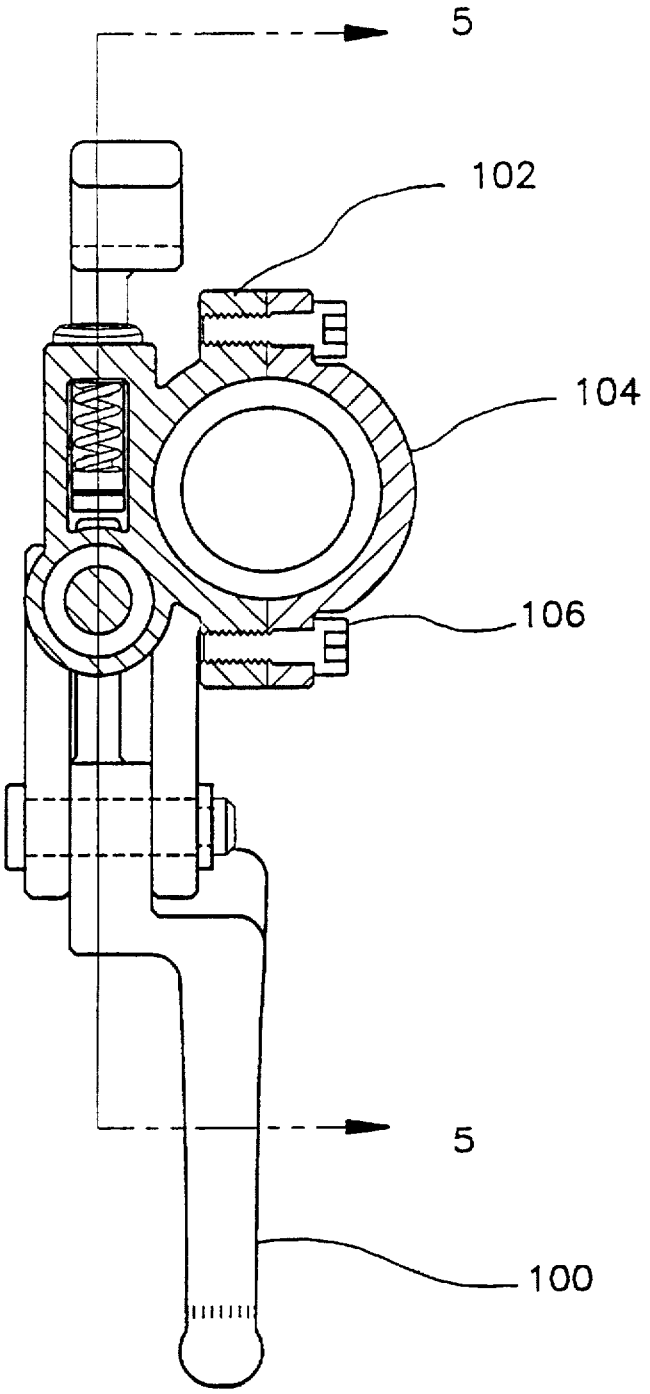
FIG. 4 is a cross-sectional detail view of a handle drawn proximate line 4—4 of FIG. 5 is employed to carry out engagement of the invention.

Referring to FIG. 4, the enabling lever 100 is pivotally mounted on a housing 102. The housing 102 is contoured to receive half of a cylindrical structural member, a bicycle tube in this embodiment. A cover 104 receives the other half of the structural member. The housing 102 and cover 104 are held together and for cooperatively clamping the structural member with threaded fasteners 106. The invention is not limited to a particular mounting method.

Figure 5:
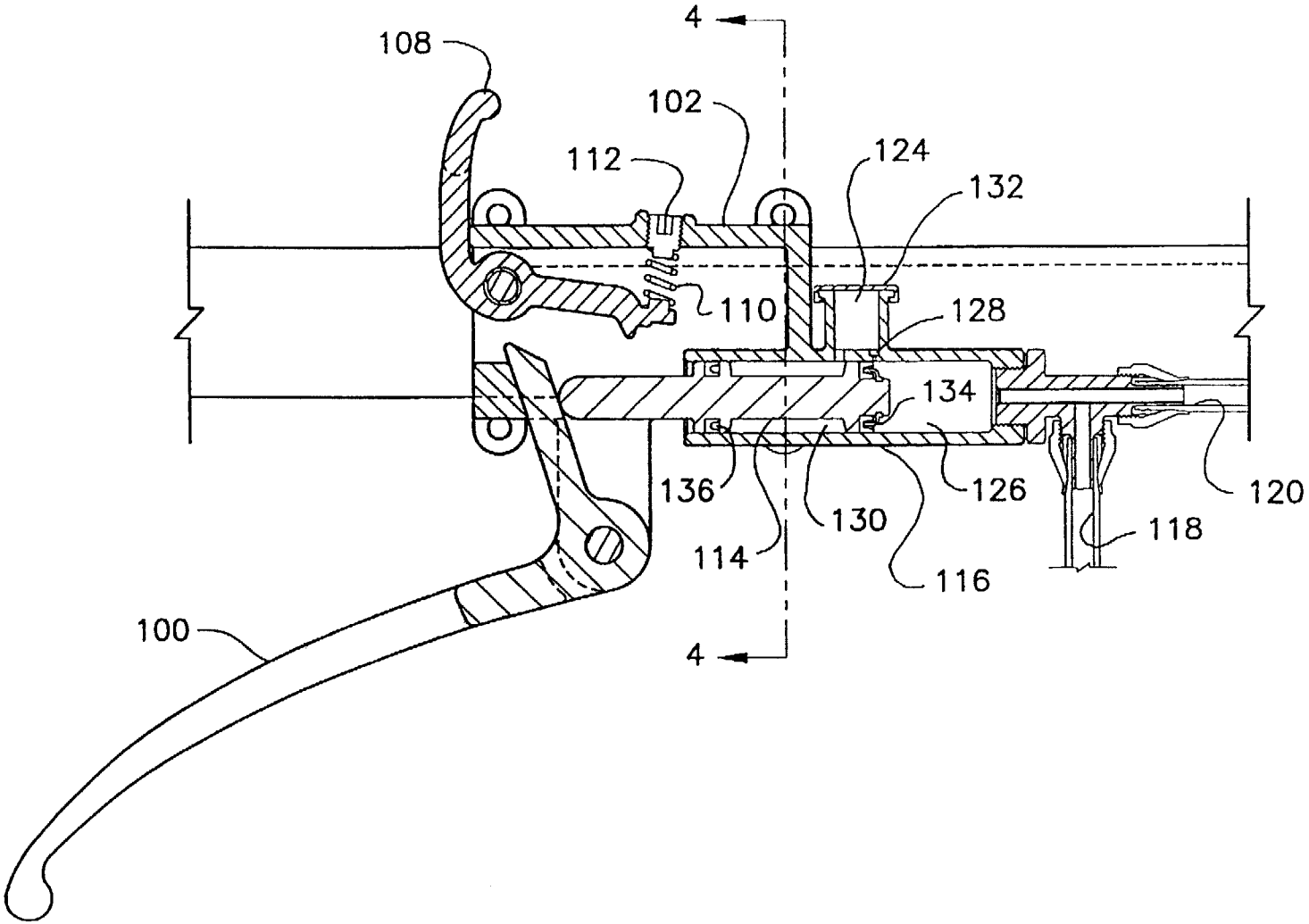
FIG. 5 is a side cross-sectional detail view of the handle drawn proximate line 5—5 of FIG. 4.

Referring to FIG. 5, the enabling lever 100 may be locked into the engaged position with a toothed lever 108 which is pivotally mounted on the housing 102. A spring 110 is installed between the lever 108 and an adjustment screw 112. The screw 112 is threadingly engaged with the housing 102 and permits adjustment of the bias of the spring 110 against the lever 108.

Articulating the enabling lever 100 impels a signal plunger 114 to drive fluid from a signal cylinder 116 into a reservoir closure hose 118 and a clutch hose 120. The clutch engages the rotating element prior to opening a reservoir 122. This convention discourages rapid rotation of the pump prior to clutch engagement. Premature pump rotation may cause the clutch to suffer excessive wear, and the various geared components which interengage within the clutch assembly to suffer impact failure.

A fluid accumulator 124 is shown in communication with, when plunger 114 is fully withdrawn as shown, a working chamber 126 via an aperture 128, and a secondary chamber 130 via an aperture 132. This construction is purposed at, similar to a conventional master braking cylinder, encouraging removal of air incidentally introduced into the working chamber 126. When the plunger 114 is fully withdrawn, fluid from the accumulator 124 is free to flow into the working chamber 126 and secondary chamber 130. When the plunger 114 is urged into the working chamber 126, a seal 134 crosses over aperture 128 and obstructs communication between the accumulator 124 and working chamber 126. Further translation of plunger 114 drives fluid from the working chamber 126 into the reservoir closure hose 118 and clutch hose 120, rather than out through the accumulator 124. As the plunger 114 recedes, fluid may leak past seal 134 into the working chamber 126. To prevent air from being introduced into the hydraulic circuit, the secondary chamber 130 remains filled with hydraulic fluid. Leakage from the secondary chamber 130 is deterred by the seal 136. When the plunger 114 recedes toward the accumulator 124, leakage past the seal 134, if any, comes from the secondary chamber 130 and the accumulator 124. Once the plunger 114 is fully recessed and fluid communication between the accumulator 124 and the chamber 126 is reestablished, the excess fluid in the chamber 126 is directed back into the accumulator 124 by spring pressure exerted at the other end of the circuit.

Figure 6:
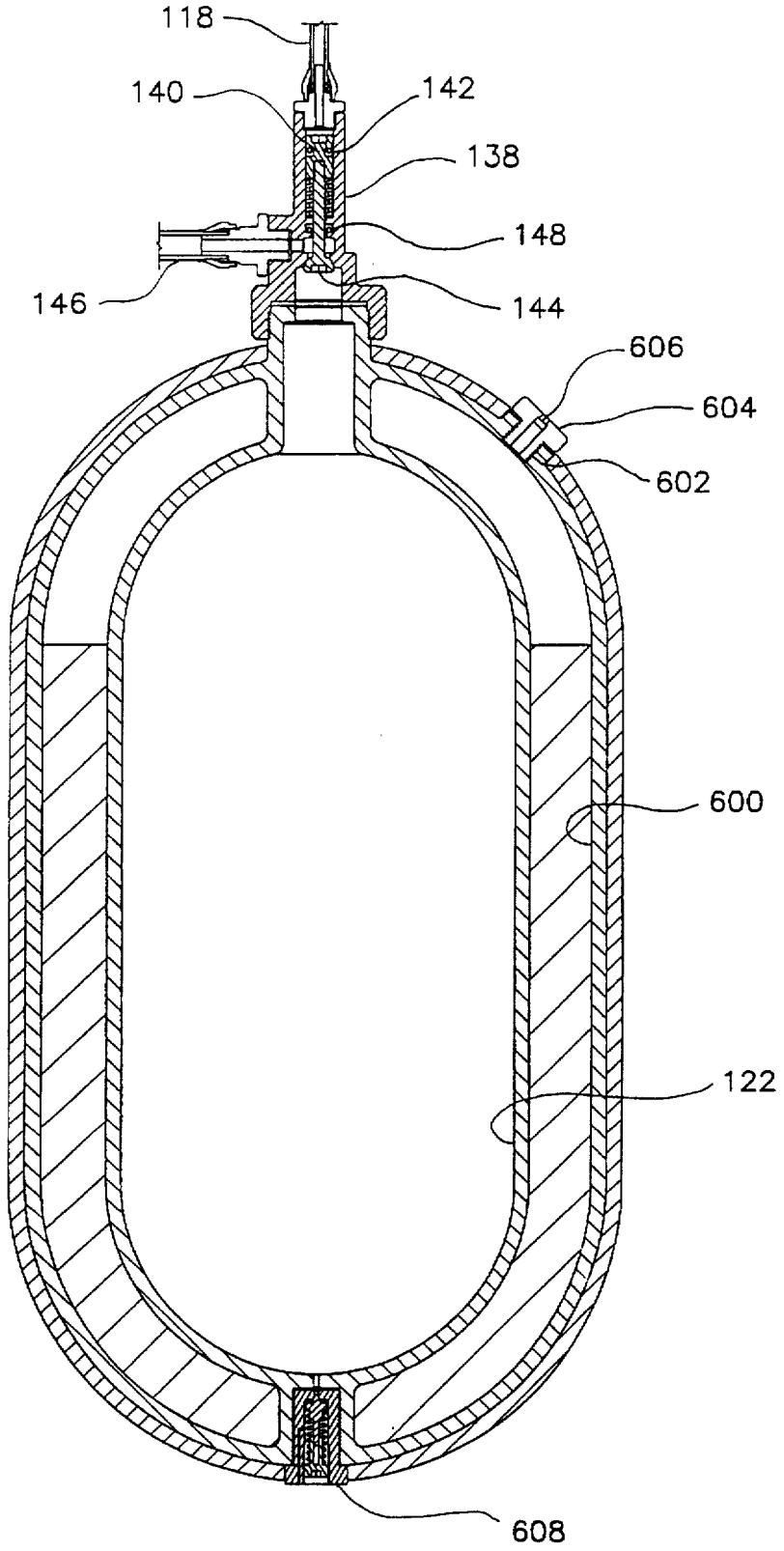
FIG. 6 is a cross-sectional detail view of the reservoir shown at the left of FIG. 3.

Referring to FIG. 6, fluid received in the reservoir closure hose 118 is conveyed to a reservoir closure cylinder 138 and acts over the face of a reservoir closure piston 140. The piston 140 has a seal 142 to deter fluid leaks. The piston 140 drives open a valve 144 and permits fluid communication between a hose 146 and a reservoir 122. A seal 148 deters air leaks into the reservoir closure cylinder 138.

Figure 7:
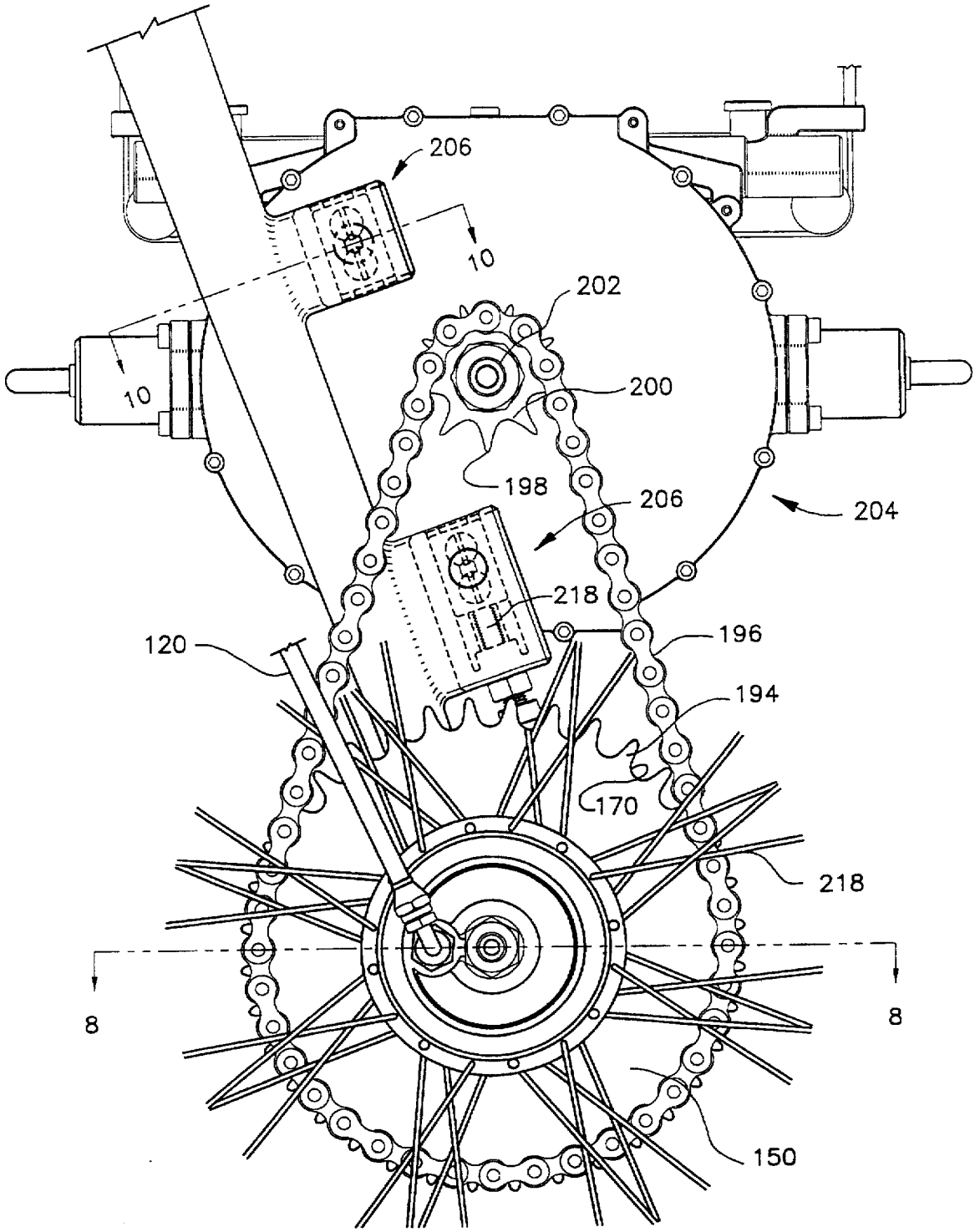
FIG. 7 is a partial environmental perspective view of the invention drawn to an enlarged scale with structural members of the vehicle to which it is connected removed for demonstrative purposes.
Figure 8:
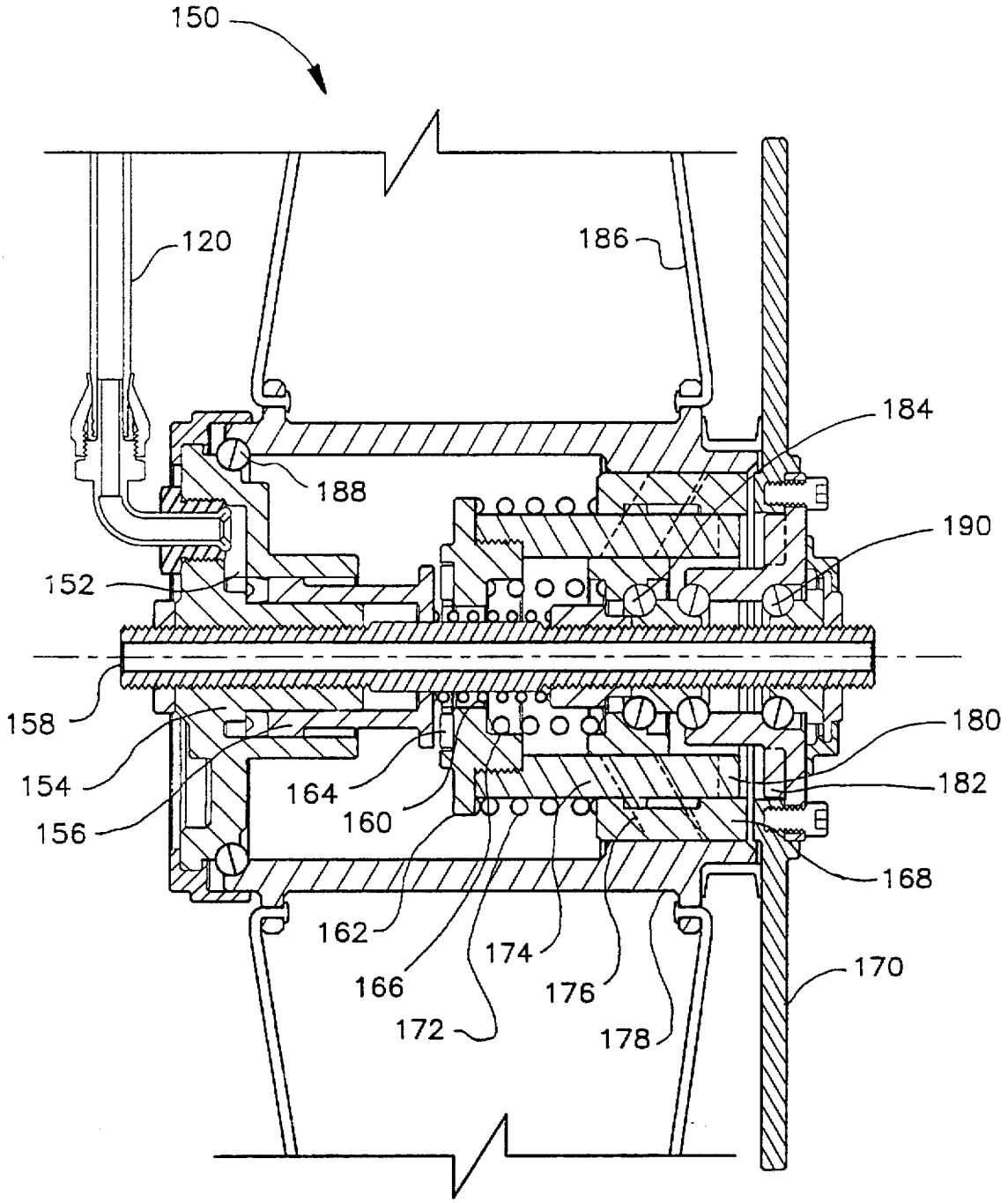
FIG. 8 is a cross-sectional detail view of a clutch mechanism shown at the lower center and drawn proximate line 8—8 of FIG. 7.

Referring to FIGS. 7 and 8, the clutch hose 120 leads to a wheel hub assembly 150. A chamber 152, defined by a hub cylinder 154 and a hub piston 156, receives fluid from the clutch hose 120. The hub cylinder 154 is fixed relative to an axle 158, which is rotationally fixed to a vehicle (not shown). The hub piston 156 is sealingly and slidingly contained within the hub cylinder 154. The hub piston 156 is biased toward hub the cylinder 154 by a spring 160. The spring 160 urges the hub piston 156 to disengage, driving fluid from the chamber 152 when the user releases lever 100.

When the hub piston 156 is advanced against a clutch ring 162, thrust bearings 164 mounted on the clutch ring 162 permit the clutch ring 162 to translate and rotate with respect to the hub piston 156, while maintaining relatively frictionless contact therewith. The clutch ring 162 is biased toward the hub piston 156 by a spring 166. As the clutch ring 162 advances against the spring 166, a hub dog housing 168 is urged against a sprocket 170 by a spring 172. The friction between the hub dog housing 168 and the sprocket 170 decreases relative rotation therebetween, thus facilitating interengagement of toothed members, described infra.

The clutch ring 162 is threadingly engaged with and rotationally fixed relative to a hub dog 174. The hub dog 174 is slidably received within slots 176 of a spoke ring 178, fixing relative rotation therebetween. The hub dog housing 168 also is rotationally fixed relative to the spoke ring 178 via slots 176. As the clutch ring 162 and hub dog 174 advance toward the sprocket 170, the teeth 180 of the hub dog 174 engage with the teeth 182 of the sprocket 170, fixing relative rotation therebetween. Bearings 184 permit relatively frictionless relative rotation between the entire hub assembly (spoke ring 178, hub dog housing 168, clutch ring 162 and hub dog 174) and the axle 158. The spoke ring 178 is rotationally fixed relative to the spokes 186 which are rotationally fixed relative to a ground-engaging member, such as a tire (not shown). Bearings 188 permit relatively frictionless relative rotation between the spoke ring 178 and hub cylinder 154. Bearings 190 permit relatively frictionless relative rotation between the sprocket 170 and the axle 158.

Figure 9:
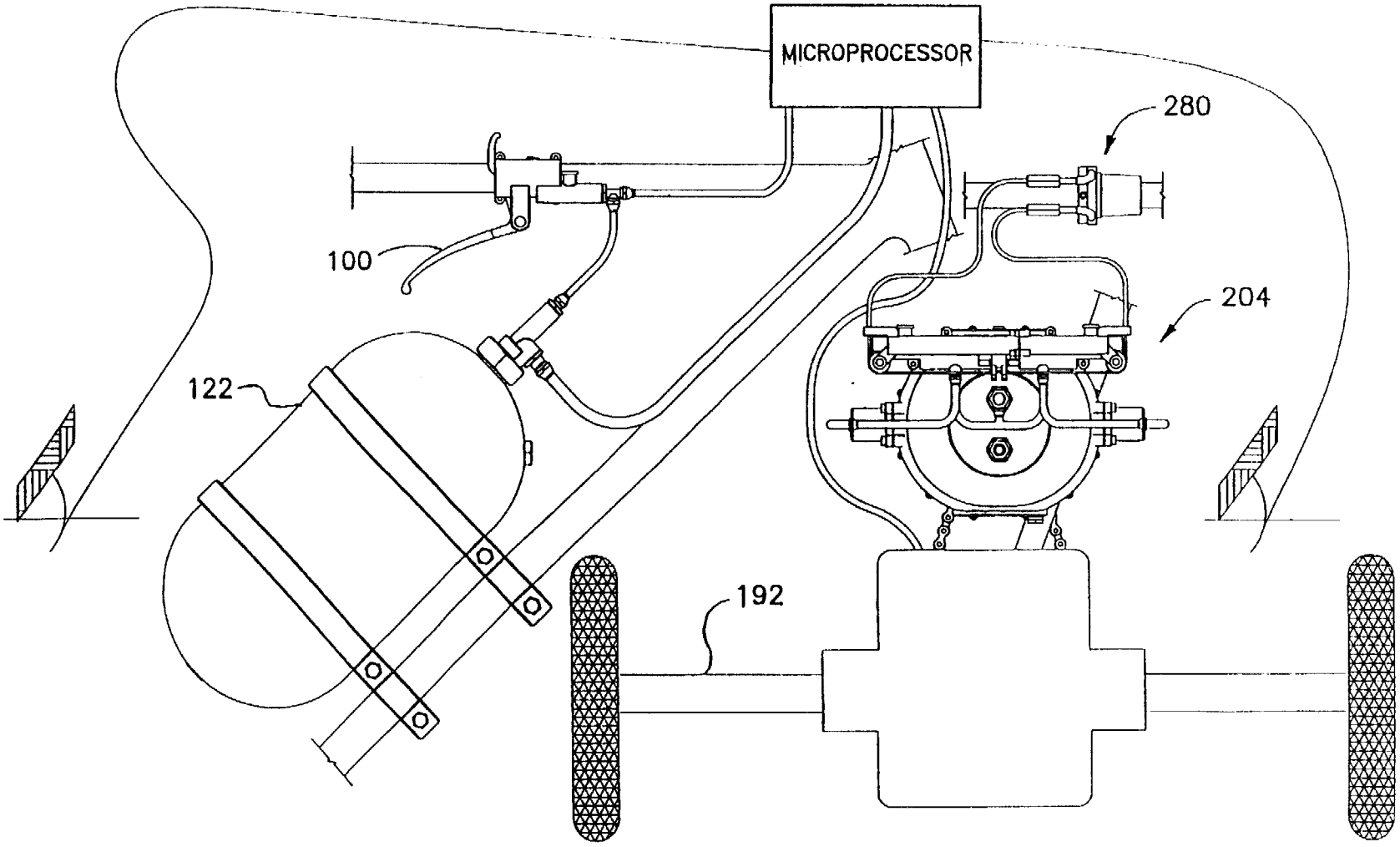
FIG. 9 is a diagrammatic view of the invention implemented on a motor vehicle.

Also referring to FIG. 9, the invention is shown adapted for use in a vehicle having locomotive means. The hub assembly 150, or equivalently engaging apparatus, is mounted on a transmission shaft 192.

Referring again to FIG. 7, sprocket 170 includes teeth 194 which engage with a conventional drive chain 196. The drive chain 196 also engages with the teeth 198 of a sprocket 200. The sprocket 200 is fixed relative to an input shaft 202 shown entering the back of an eccentric ring pump 204.

Figure 10:
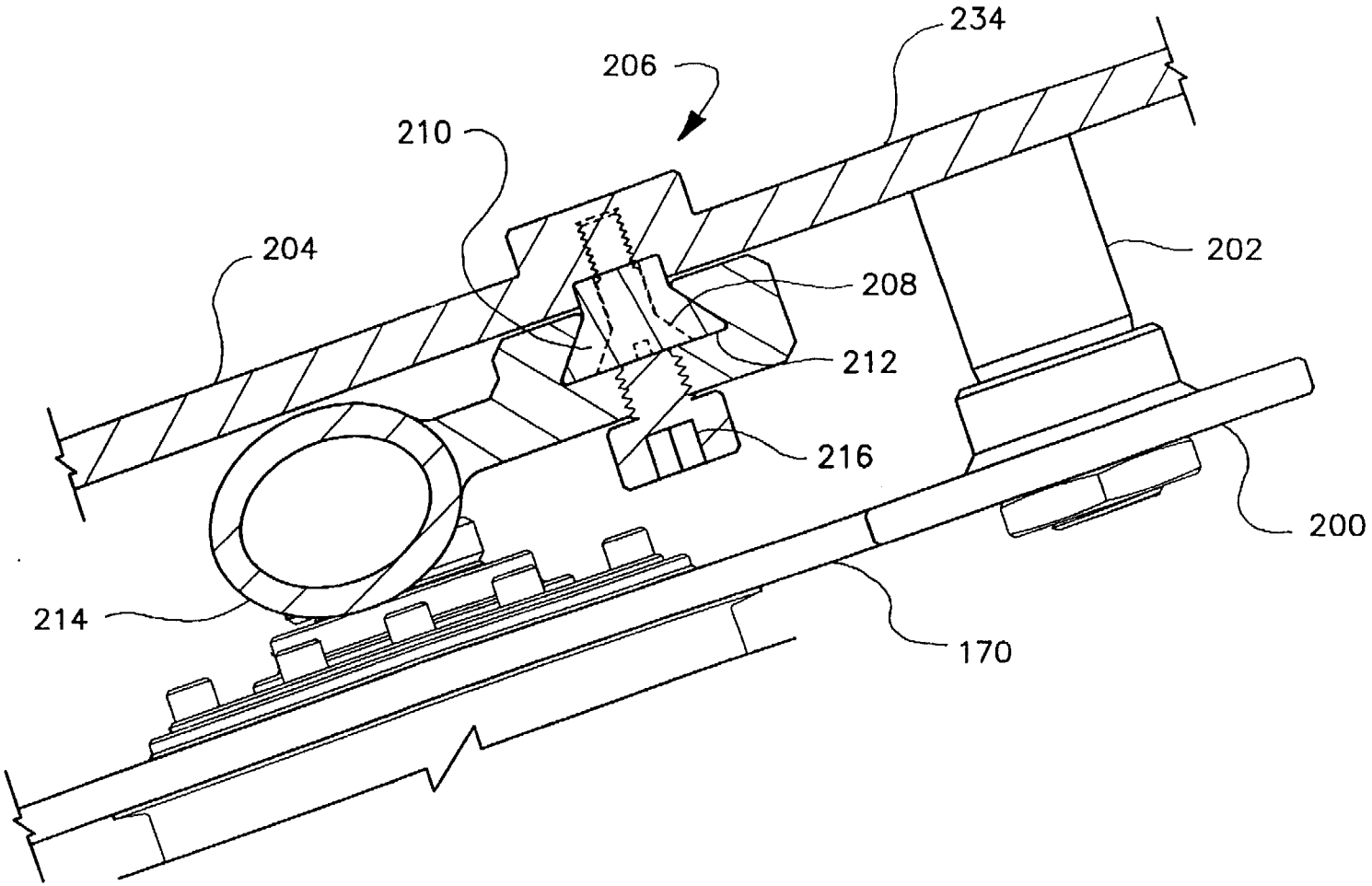
FIG. 10 is a cross-sectional detail view of a tensioning mechanism shown at line 10—10 of FIG. 7.

Referring also to FIG. 10, tension in the drive chain 196 may be adjusted with an adjustment mechanisms 206. A threaded fastener 208 rigidly fixes a dovetail 210 to the pump 204. The dovetail 210 is slidingly received in a groove 212 and may be fixed relative to a structural member 214 by a threaded fastener 216. An adjustment screw 218 as shown in FIG. 7 maintains the desired tension in the drive chain 196.

Figure 11:
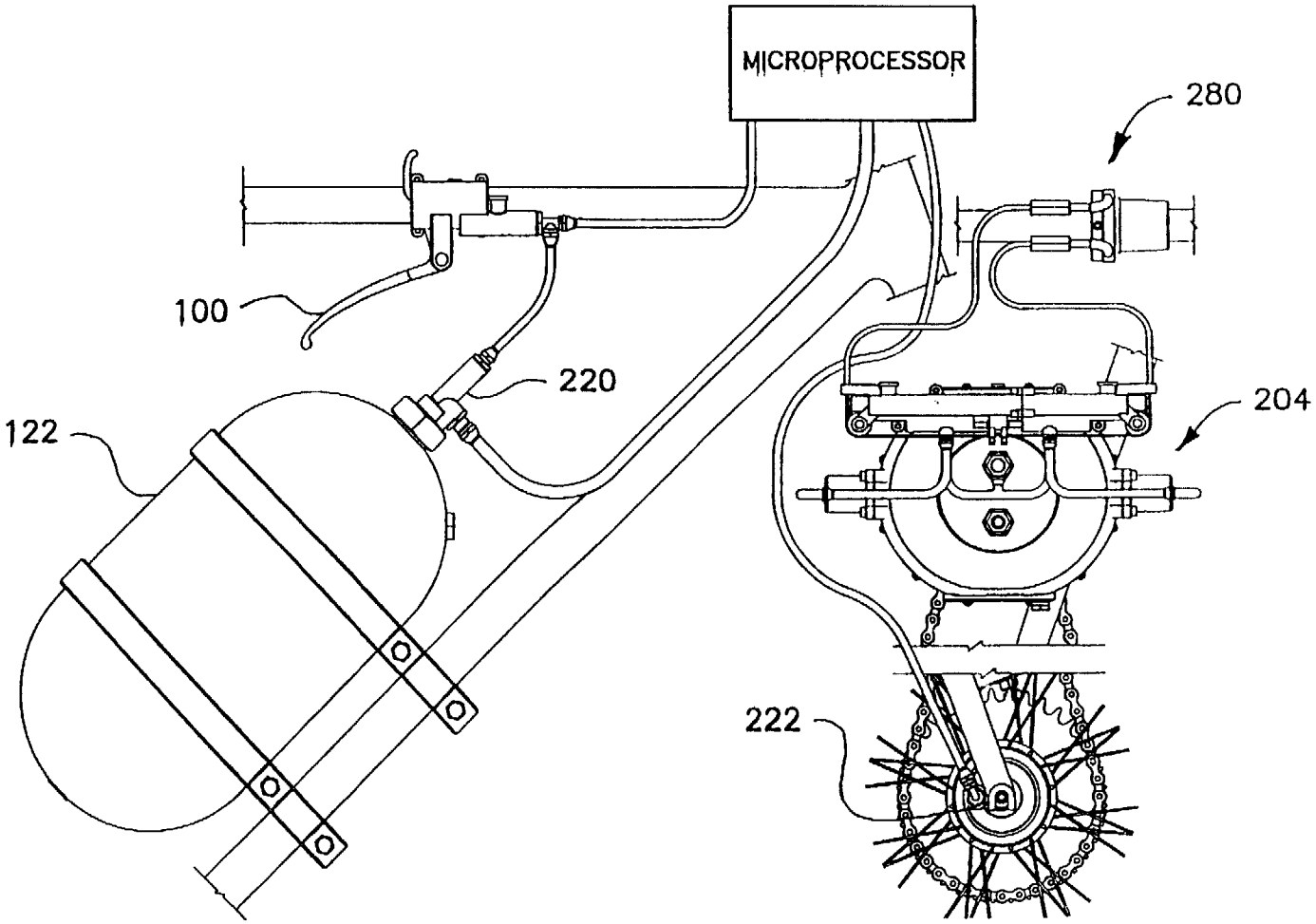
FIG. 11 is a partial environmental perspective view of the invention including a diagrammatic representation of a microprocessor.

Referring to FIG. 11, an electromechanicaL embodiment of the enabling means is shown. The invention provides a microprocessor responsive to the lever 100. When the enabling lever 100 is actuated, the microprocessor directs power to solenoids 220 and 222. The solenoid 220 advances the reservoir closure piston 140, described supra. The solenoid 222 urges the hub dog 174 to engage with the sprocket 170, ibidem.

Once the invention is enabled either by mechanical or electromechanical means, the user may brake the rotating element and store the associated kinetic energy. Braking is achieved by transmitting to the tire the compressive resistance experienced by the pump 204 as it compresses fluid. As fluid pressure within the reservoir 122 increases, braking torque increases.

In order to brake a vehicle effectively, the invention must be able to operate similar to conventional friction breaking systems. The user must be able to precisely apply and control the braking torque from a very small value to full braking. The apparatus must respond at the desired torque level the user demands. Also, when the operator makes a sudden brake demand, or slams on the brakes, the invention must react immediately to this signal minimizing any lag between the demand and the response.

To accommodate rapid torque demands, the invention provides a reversible variable displacement pump which pumps against a pressure head. Pump displacement is varied to alter the desired torque. When configured to compress fluid, varying the displacement fully in a second direction produces maximum brake torque. When configured to expand fluid, varying the displacement fully in a first direction produces maximum drive torque.

Two types of variable displacement pumps lend themselves well to acceding to the user's demands: a radial eccentric ring pump and an axial valve plate pump, or axial piston pump. Both have unique control mechanisms for configuring the pump to either compress or expand fluid. Both have mechanisms for adjusting the displacement of each pump. The control mechanisms will be covered in seriatim and followed by comparative analysis of their applicability.

B. Eccentric Ring Pump and Control Means Therefor

1. Eccentric Ring Pump.

One embodiment of the present invention includes an eccentric ring pump. Small eccentric ring pumps deliver large torque relative to the size of the apparatus. While compressing fluid, the user may increase pump eccentricity and compel the pump to compress a greater volume of fluid. Compressing a greater volume generates greater brake torque that may be transmitted to the rotating element for braking. While expanding fluid, the user may increase pump eccentricity and compel the pump to expand a greater volume of fluid. Expanding a greater volume generates greater drive torque that may be transmitted to the rotating element.

Figure 12:
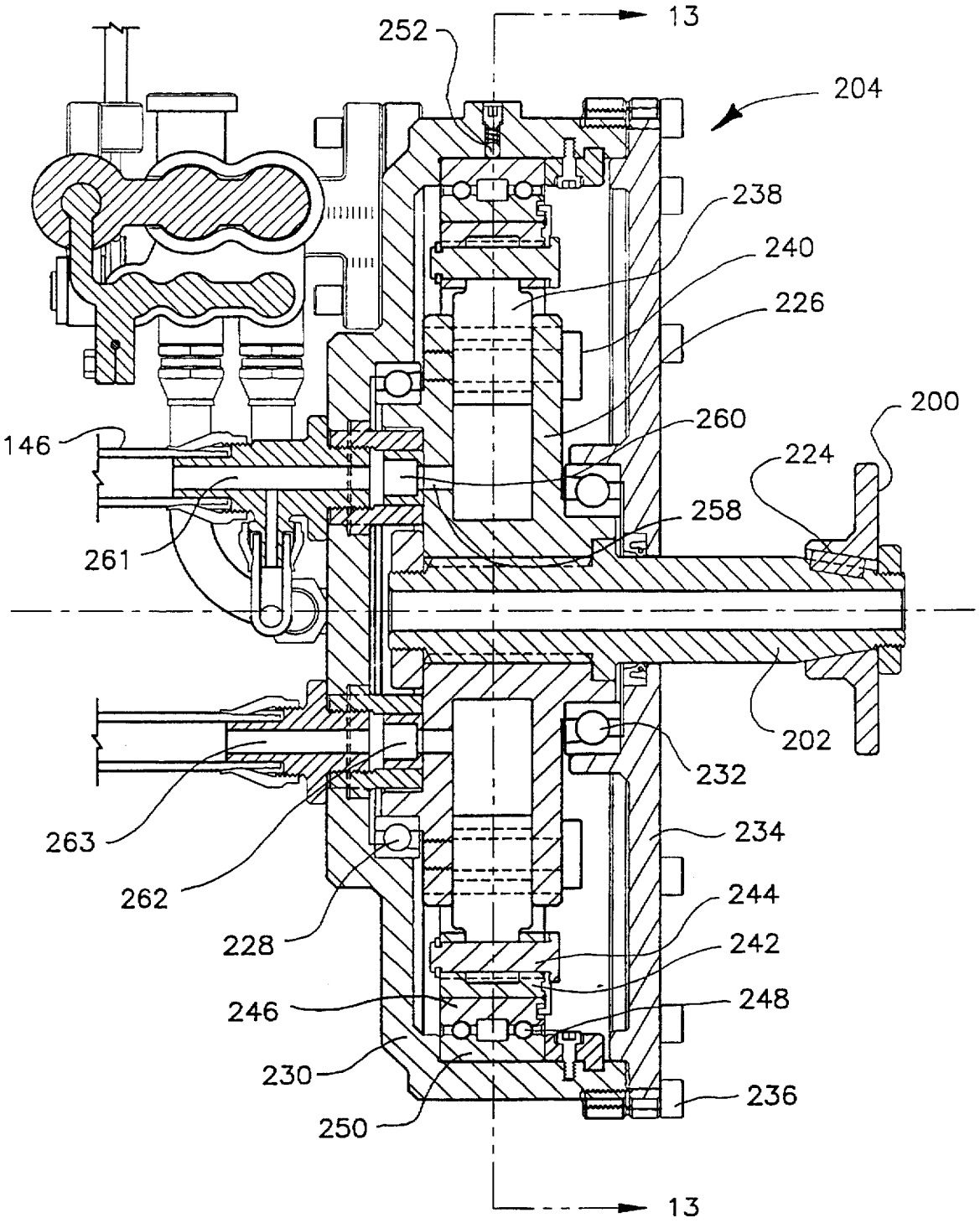
FIG. 12 is a cross-sectional detail view of an eccentric ring pump-motor and control mechanisms associated therewith drawn across line 12—12 of FIG. 13.
Figure 13:
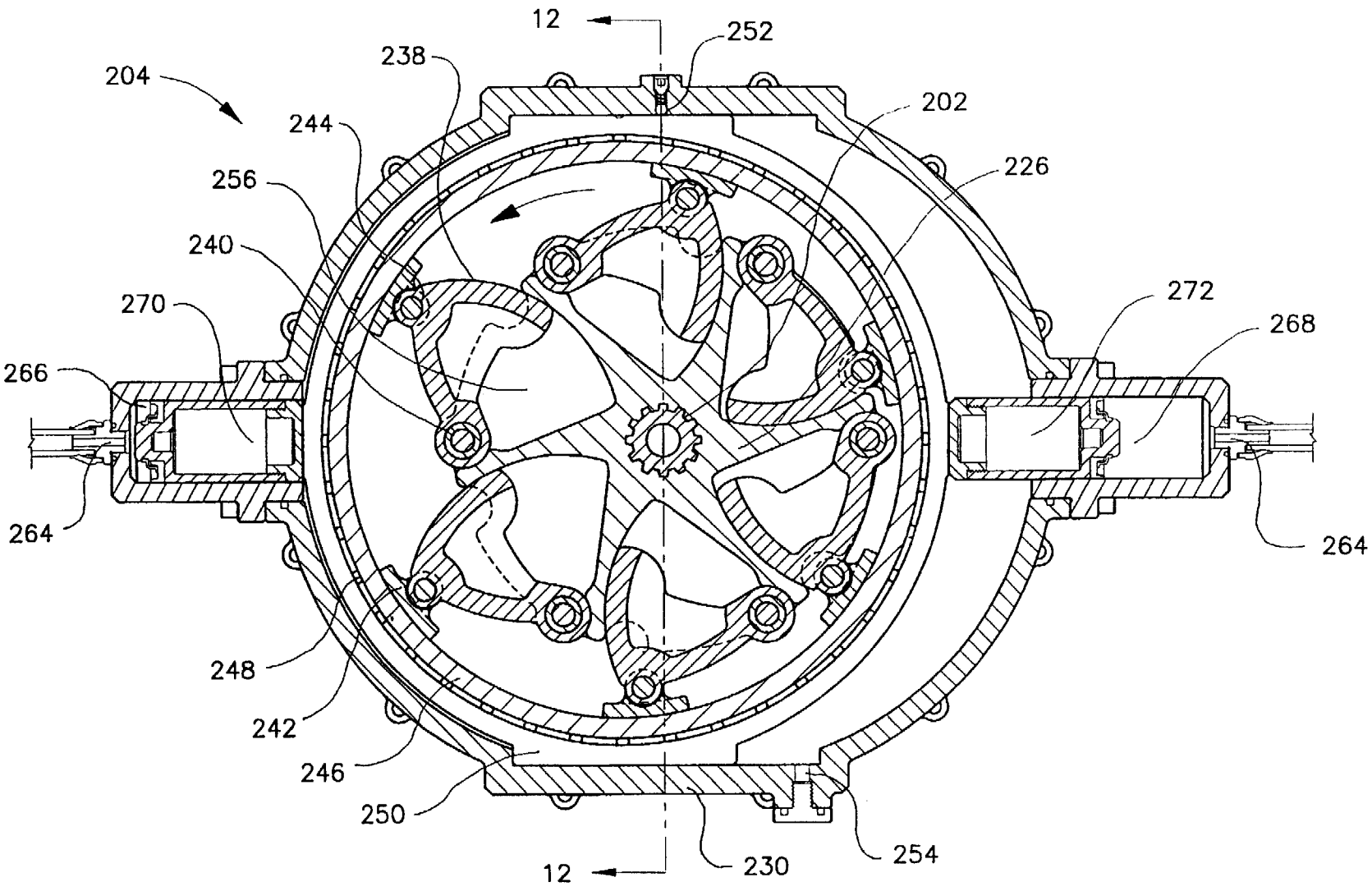
FIG. 13 is a cross-sectional detail view of the pump-motor shown at line 13—13 of and rotated ninety degrees from FIG. 12.

Referring to FIGS. 12 and 13, a sprocket 200 is rotationally fixed relative to the input shaft 202 by a key 224. The shaft 202 is rotationally fixed relative to a piston housing 226. Bearings 228 provide for relatively frictionless relative rotation between the piston housing 226 and a pump housing 230. Bearings 232 provide for relatively frictionless relative rotation between the piston housing 226 and a face plate 234. The pump housing 230 and face plate 234 are fixed relative to each other by a plurality of threaded fasteners 236.

The piston housing 226 sealingly and slidingly receives a plurality of pistons 238 pivotally mounted thereto by pins 240. The pistons 238 each have a foot 242, pivotally mounted with a pin 244, which is urged against an inner ring 246.

Bearings 248 permit relatively frictionless relative rotation between the inner ring 246 and an eccentric ring 250. The eccentric ring 250 is slidlngly received in the pump housing 230. A centering ball 252 urges the eccentric ring 250 to be centered within the pump housing 230. This centering convention aids in calibrating the system. An oil port 254 permits drainage of the lubrication from the pump housing.

When the pump 204 is engaged and loaded for braking, as described below, the sprocket 170 rotates synchronously with the sprocket 200 and shaft 202. The piston housing 226 rotates in a counter-clockwise direction as shown in FIG. 13.

Figure 14:
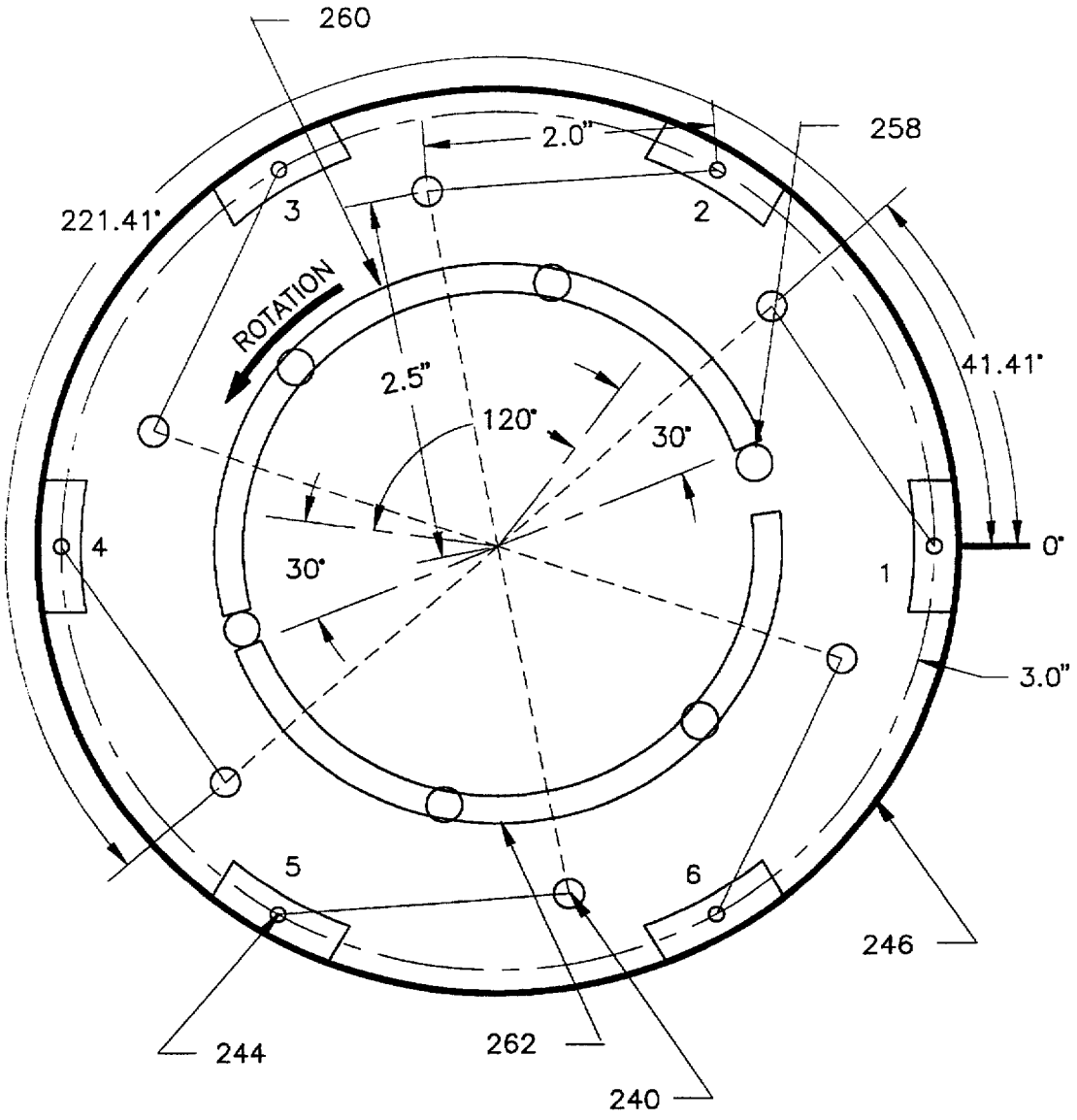
FIG. 14 is a diagrammatic representation of an undamped eccentric ring pump at zero eccentric ring offset.
Figure 15:
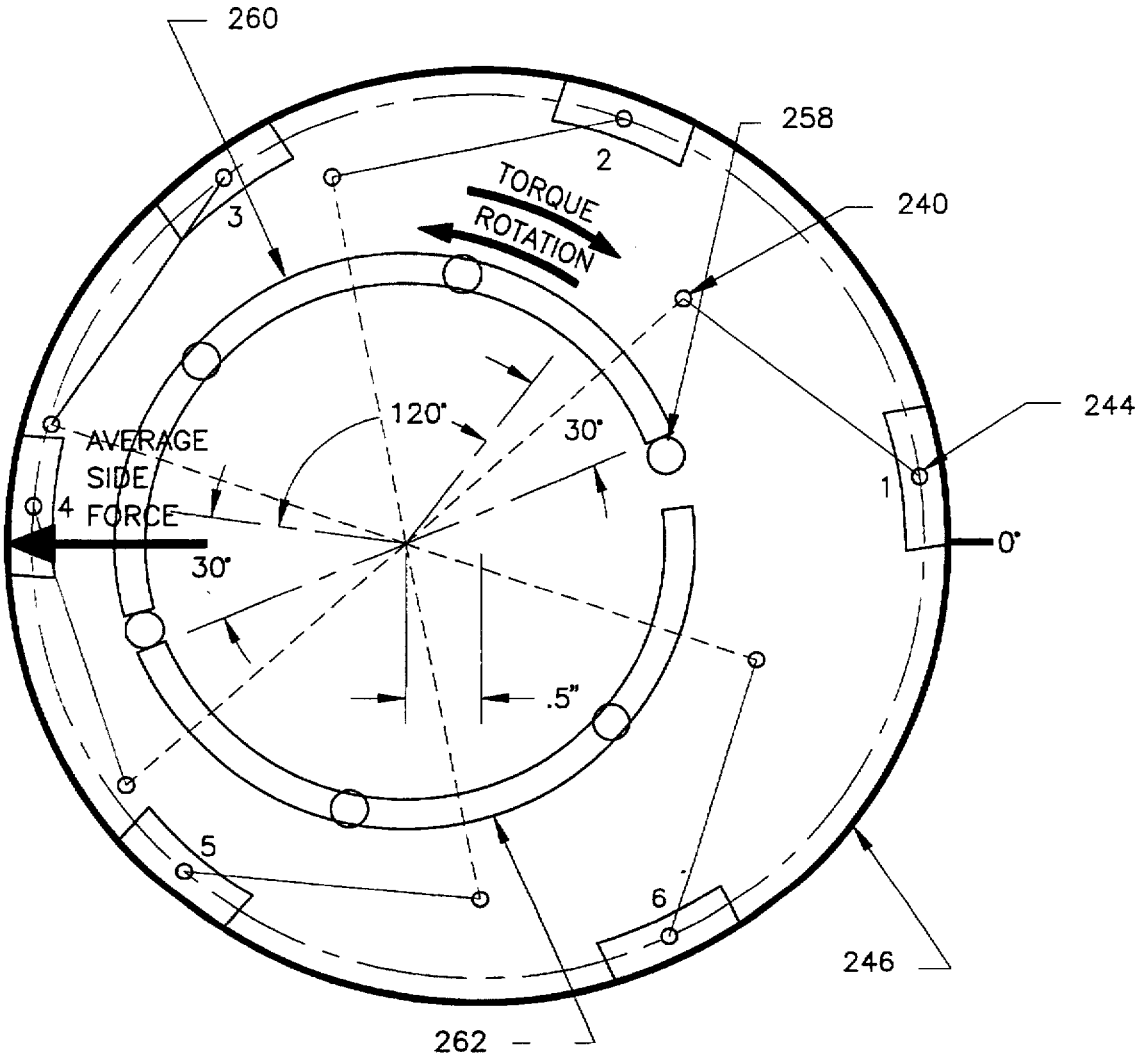
FIG. 15 is a diagrammatic representation of an undamped eccentric ring pump at 0.5-inch eccentric ring offset.

Referring also to FIGS. 14 and 15, diagrammatic representations of the eccentric ring pump are shown at zero and 0.5 inch offset, respectively. As shown in FIG. 15, fluid is introduced into a piston chamber 256, defined by the piston 238 and piston housing 226, via a cylinder inlet 258. Due to the eccentricity of the inner ring 246 relative to the piston housing 226, the piston chamber 256 rotates toward position 4 and the fluid therein is compressed. As the piston 238 rotates, the resultant compression generates a torque in the clockwise direction and an average leftward side force against the inner ring 246. The average side force is transmitted to the eccentric ring 250. Throughout the compression cycle, the piston chamber 256 forces fluid through a high pressure port 260. Referring also to FIGS. 3 and 12, fluid from the high pressure port 260 flows through a passageway 261 into a conduit 146 which conducts the compressed fluid into the reservoir 122.

Preferably, each piston 238 rotates about a 2.5-inch radius relative to the central axis of the shaft 202. Each piston 238 defines a 2 square-inch area over which the high-pressure fluid works. The pins 244 and 240 are located two inches apart. Each piston foot 242 axis orbits about the shaft 202 within a path having a six-inch diameter. The pump 204 has a high pressure port 260 and a low pressure port 262. As the piston chambers 256 rotate counter-clockwise, they pass over the high pressure port 260 and then the low pressure port 262.

As best shown in FIGS. 13 and 14, after an incremental counter-clockwise shaft rotation, the cylinder inlet 258 of the piston 238 at position 1 receives fluid and rotates through the high pressure port 260, toward the low pressure port 262. In the extreme case, the chamber 256 may be pressurized to the same pressure as the high pressure port 260 at the instant the chamber 256 is exposed to it. Similarly, the chamber 256 may instantaneously release the pressurized air when exposed to the low pressure port 262. While unrealistic for pumps operating at high speeds and low pressures, pump performance more closely approximates the extreme case as pumps operate at lower speeds and higher pressures.

As diagrammed in FIG. 14, the inner ring 246 is centered with respect to the shaft 202 axis. At zero offset, pump displacement is 0 cubic inches. During rotation, a small amount of fluid escapes from the high pressure port 260 to the low pressure port 262. This occurs due to high pressure fluid compressing residual air in the chamber 256, which then is expelled along with high pressure air at the low pressure port 262. These losses are minimized as the pistons 238 more fully envelope the piston chambers 256 when the eccentric ring 250 is not offset relative to the pump housing 230.

Figure 16:
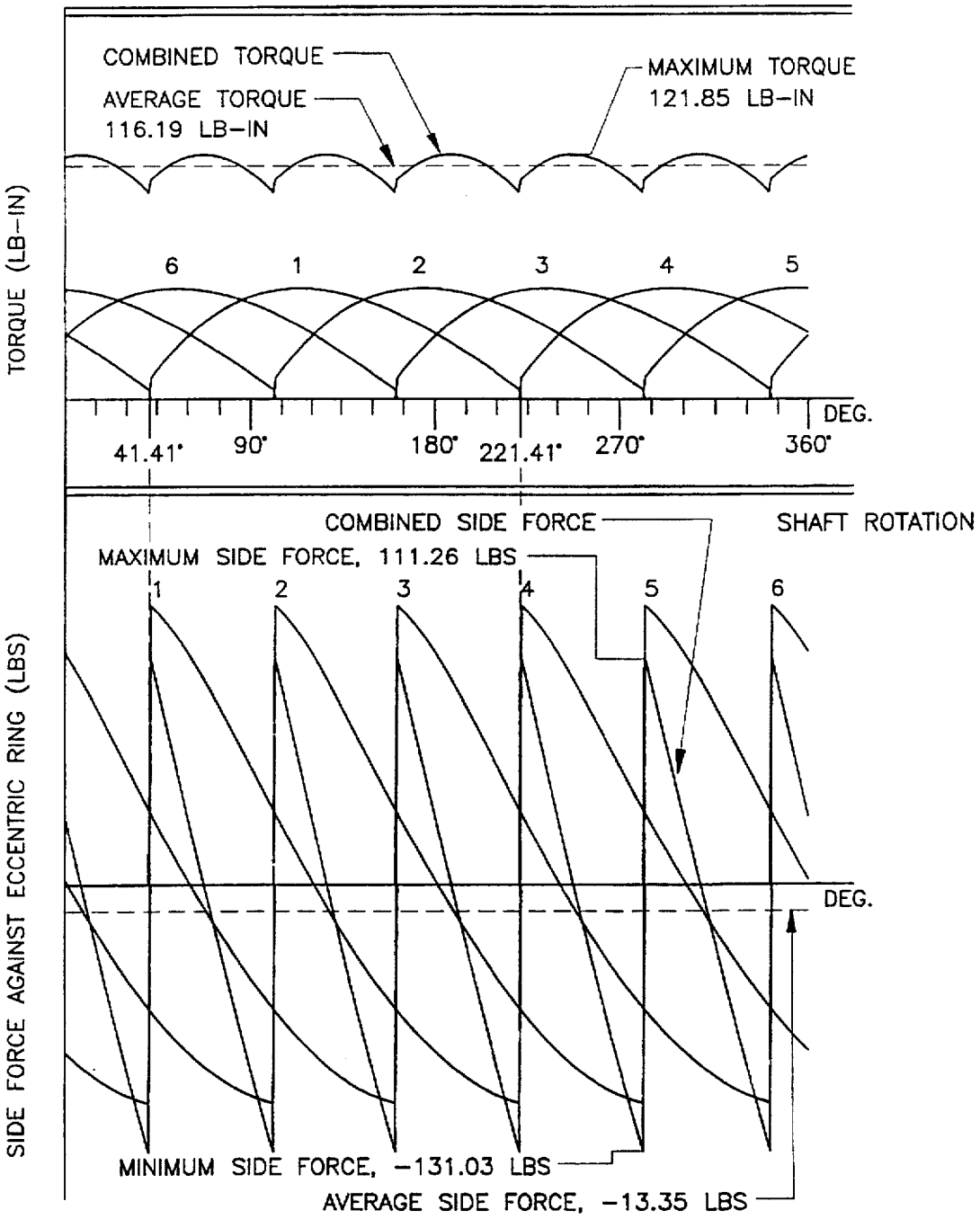
FIG. 16 is a graphical representation of pump performance showing shaft torque and side force versus rotation for an undamped eccentric ring pump.

Referring also to FIG. 16, when the eccentric ring 250 is offset to compress fluid as shown in FIG. 15, each piston chamber 256 experiences the pressure cycle and generates a torque and side force as shown. FIG. 16 shows the extreme case in which the piston chambers 256 are instantaneously pressurized and relieved of pressure: the undamped embodiment. The average combined torque, shown as a dashed line, represents the braking torque at the user's disposal for braking a rotating element. Preferably, the pressure difference between the high pressure port 260 and the low pressure port 262 is 100 pounds per square inch (psi). When the piston housing 226 has rotated approximately 41.41°, the cylinder inlet 258 receives high pressure fluid from the high pressure port 260. A small torque is imparted on the shaft 202 and a large side force is imparted on the eccentric ring 250. Since more than one chamber 256 is pressurized ac any one time, individual torques, summed, produce a combined braking torque that peaks at 121.85 inch-pounds and averages 116.19 inch-pounds. The combined torque curve is marred by severe spikes. A user will realize these spikes as brake surges and experience pulsing sensations as the torque spikes. Individual side forces, summed., produce a combined side force that ranges between 111.26 pounds and −131.03 pounds and averages −13.35 pounds. The side force immediately peaks in the positive direction when a cylinder inlet 258 is exposed to the high pressure port. The side force tapers to 0 pounds when the piston is perpendicular to the horizontal axis, increasing to a maximum value in the opposite direction. The counteracting forces generate eccentric ring wobble, or oscillation, as the shaft 202 rotates, the oscillations occurring 6 times per revolution. If unchecked, the oscillations operate like a jackhammer against mechanisms in contact therewith. Repeated hammering will eventually degrade affected mechanical systems. In operation, a significant amount of hard braking degrades the apparatus rapidly.

Figure 17:
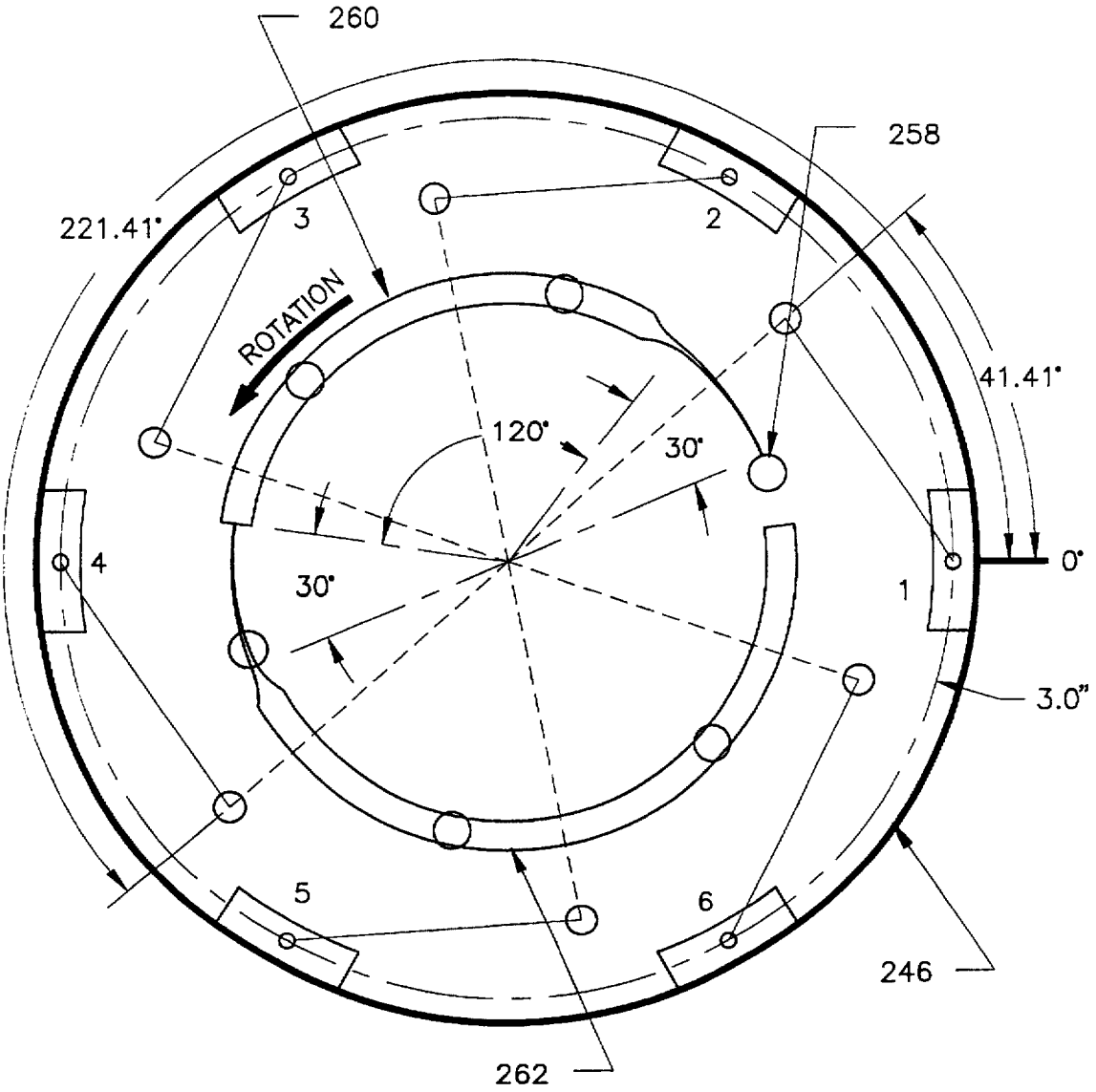
FIG. 17 is a diagrammatic representation of a damped eccentric ring pump at zero eccentric ring offset.
Figure 18:
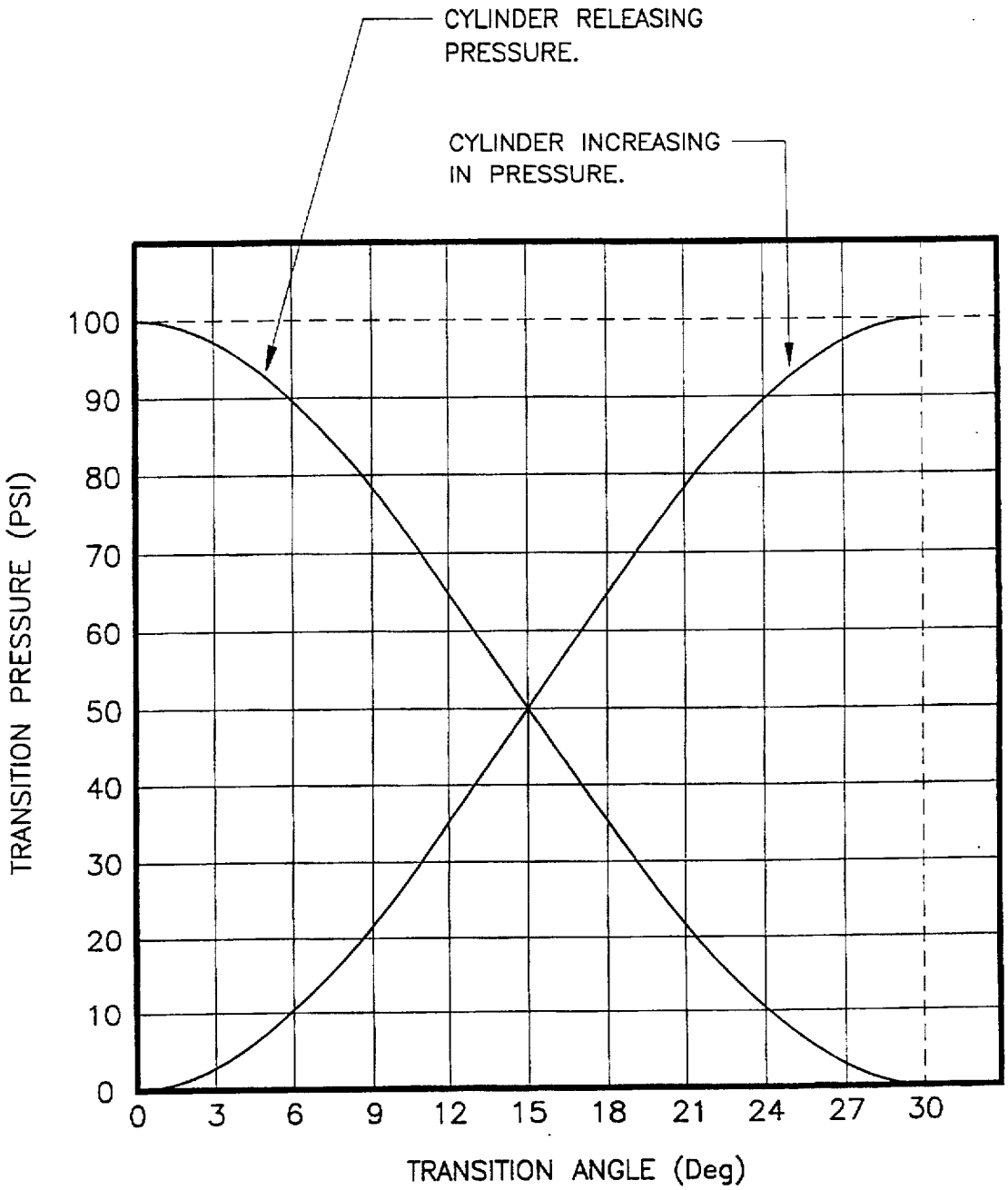
FIG. 18 is a graphical representation of damped eccentric ring pump performance showing transition pressure versus transition angle.

Referring to FIGS. 17 and 18, the invention includes means for damping the oscillating side forces. Ports 260 and 262 are shown having tapered approaches. When the piston chamber 256 advances toward the high pressure port 260, it experiences the narrow portion of the taper which limits fluid flow therefrom. As the piston housing 226 rotates approximately 30°, the cylinder inlet 258 advances over the untapered portion and becomes fully pressurized; the piston chamber 256 becomes fully pressurized gradually over a transitional rotation of the piston housing 226. As the piston chamber 256 reaches full compression and approaches the low pressure port 262, it experiences the narrow portion of the taper which limits fluid flow therein. As the piston housing 226 rotates approximately 30°, the cylinder inlet 258 advances over the untapered portion and voids the pressurized fluid therein; the piston chamber 256 becomes fully depressurized gradually over a 30° transitional rotation of the piston housing 226. These transitional rotation angles are contingent on operating pressure differential and the speed at which the piston housing 226 rotates. Higher pressure differential and/or lower rotational speed reduces the transitional angles, thus generating more pronounced peaks on the torque and side force curves.

Figure 19:
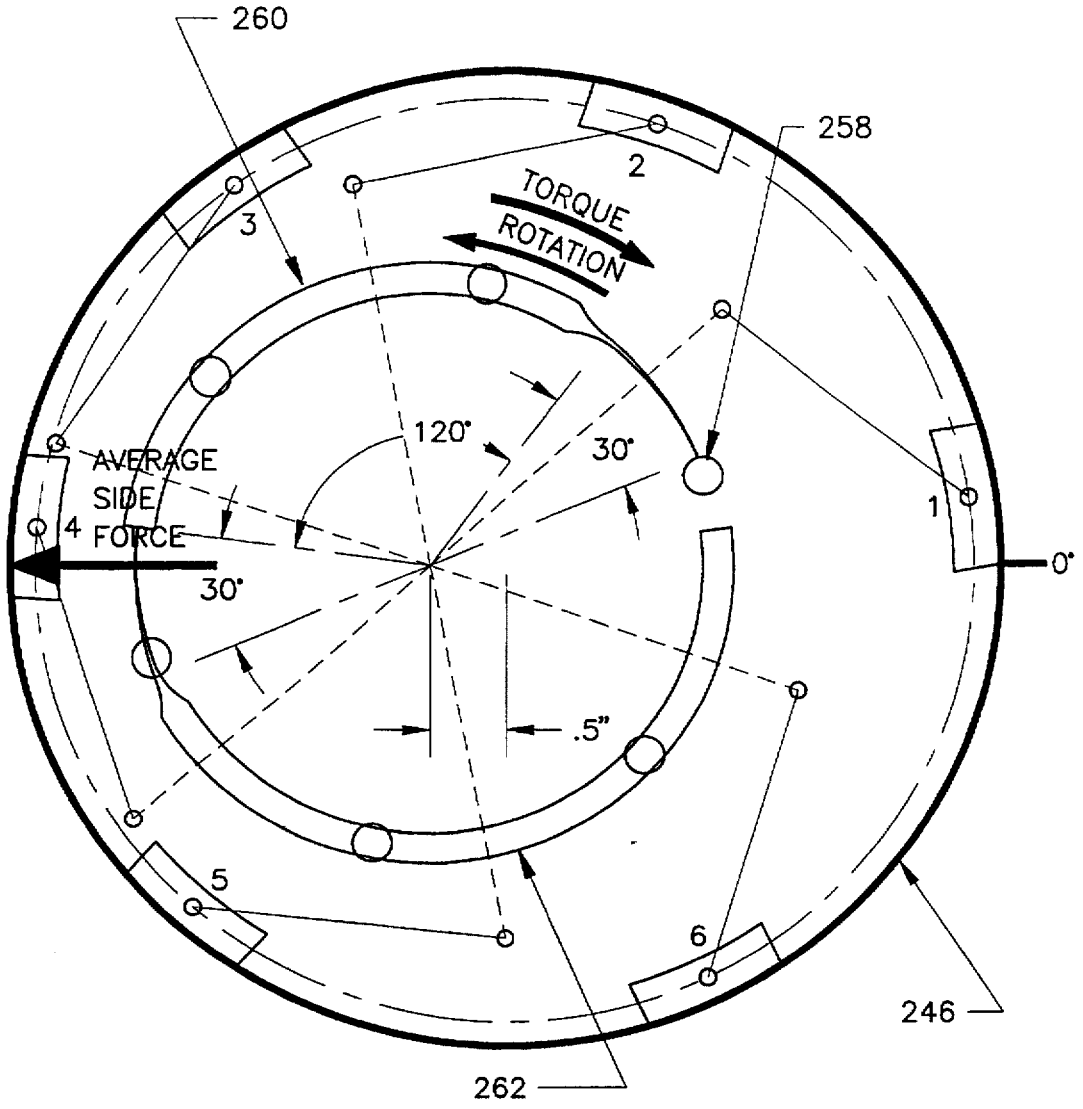
FIG. 19 is a diagrammatic representation of a damped eccentric ring pump at 0.5-inch offset.
Figure 20:
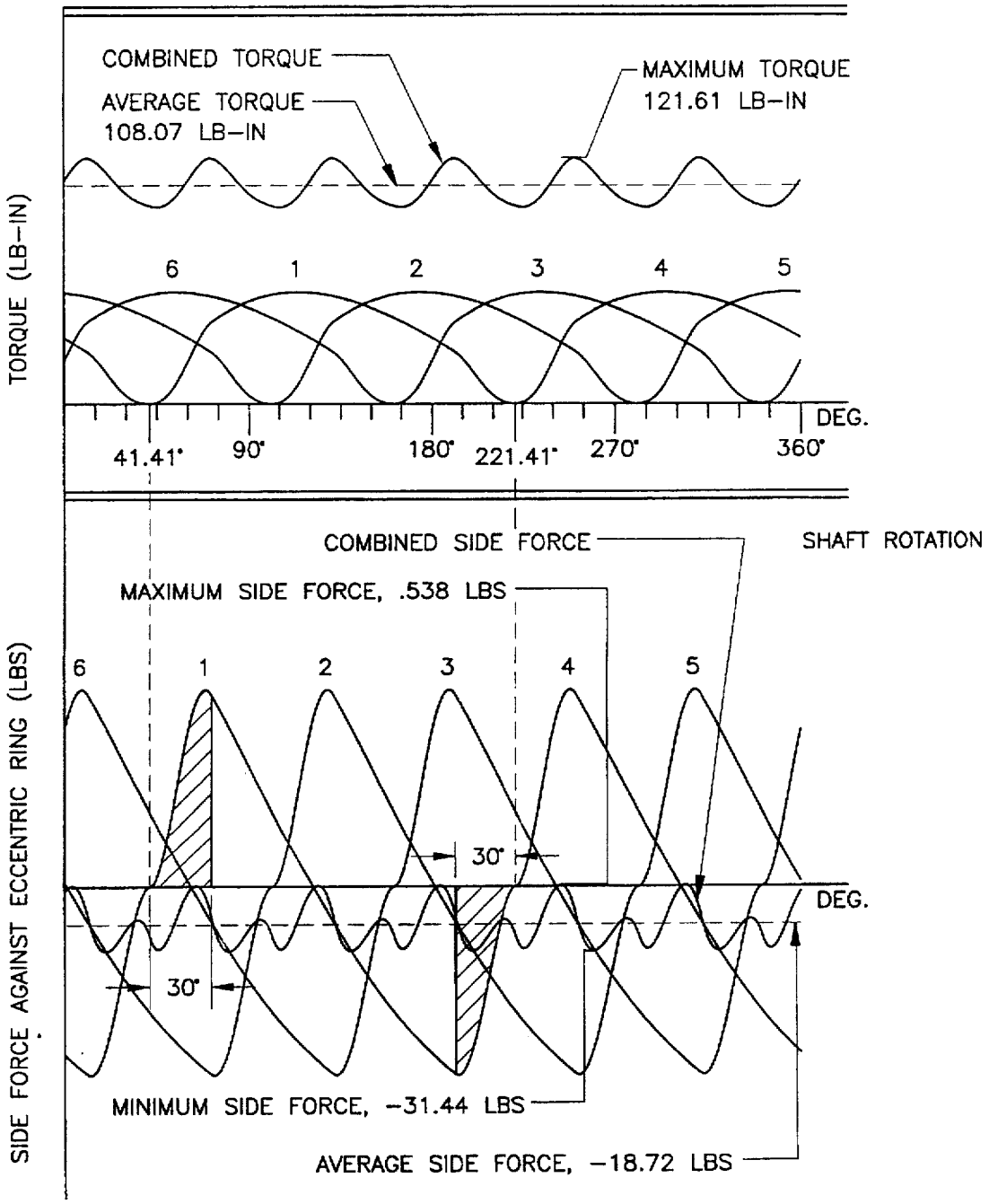
FIG. 20 is a graphical representation of pump performance showing shaft torque and eccentric ring side force versus rotation for a damped pump.

Referring to FIGS. 19 and 20, the combined torque and side force curves for the damped pump are shown as having a smoother shapes. The smoother shape represents less degradive oscillations imparted on the apparatus. The shape of the curves are more pronounced in applications having greater pressure differences and/or lower shaft speeds. The transition angle for pressurization of the piston chamber 256 is 30° as above.

When the piston housing 226 is rotated 41.41°, the cylinder inlet 258 shown at position 1 passes over the high pressure port 260 and pressure builds in the piston chamber 256. Maximum side force occurs at approximately 70°; minimum side force occurs at approximately 192°. The damped inlet and outlet port configuration results in a significantly reduced combined side force compared to that of the undamped pump, since the maximum pressures experienced in one cylinder tend to cancel the minimum pressures experienced in another simultaneously.

The combined torque generated by the damped pump peaks at 121.61 inch-pounds and averages at 108.07 inch-pounds. The combined side force ranges between 0.538 pounds and −31.44 pounds and averages −18.72 pounds. Since the torque applied to the shaft 202 by each piston 238 peaks nearly at the midpoint between the inlet and outlet ports, pressure reduction at the beginning or end of travel will not significantly reduce the net torque applied by that piston. This will, however significantly reduce side forces since the side forces peak at the inlet and outlet ports. A comparison of FIGS. 16 and 20 demonstrates that the average torque of the damped pump, 108.7 inch-pounds, is only 6.4 percent less than the average torque of the undamped pump, 116.19 inch-pounds. However, the combined side forces of the damped pump, 31.98 pounds peak to peak, are 87 percent less than the combined side forces of the undamped pump, 242.29 pounds peak to peak. Although the combined torque capability is reduced marginally, the user experiences much less severe pumping effect, on account of mitigated torque oscillations, with a damped pump. Additionally, the damped oscillations in side force are less harsh on mechanisms affected, enhancing the life of the invention.

Figure 21:
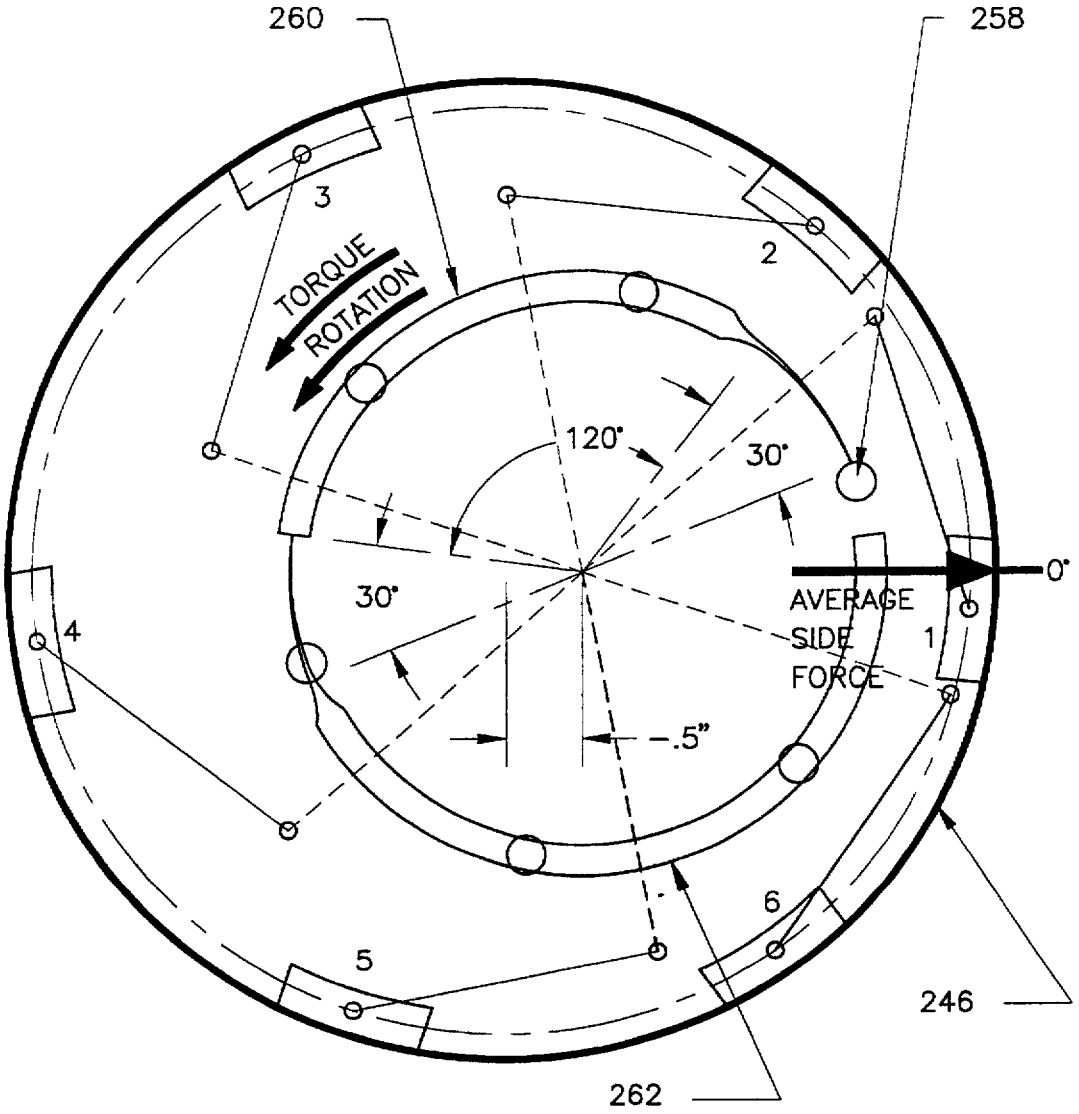
FIG. 21 is a diagrammatic representation of a damped eccentric ring pump at –0.5-inch offset.
Figure 22:
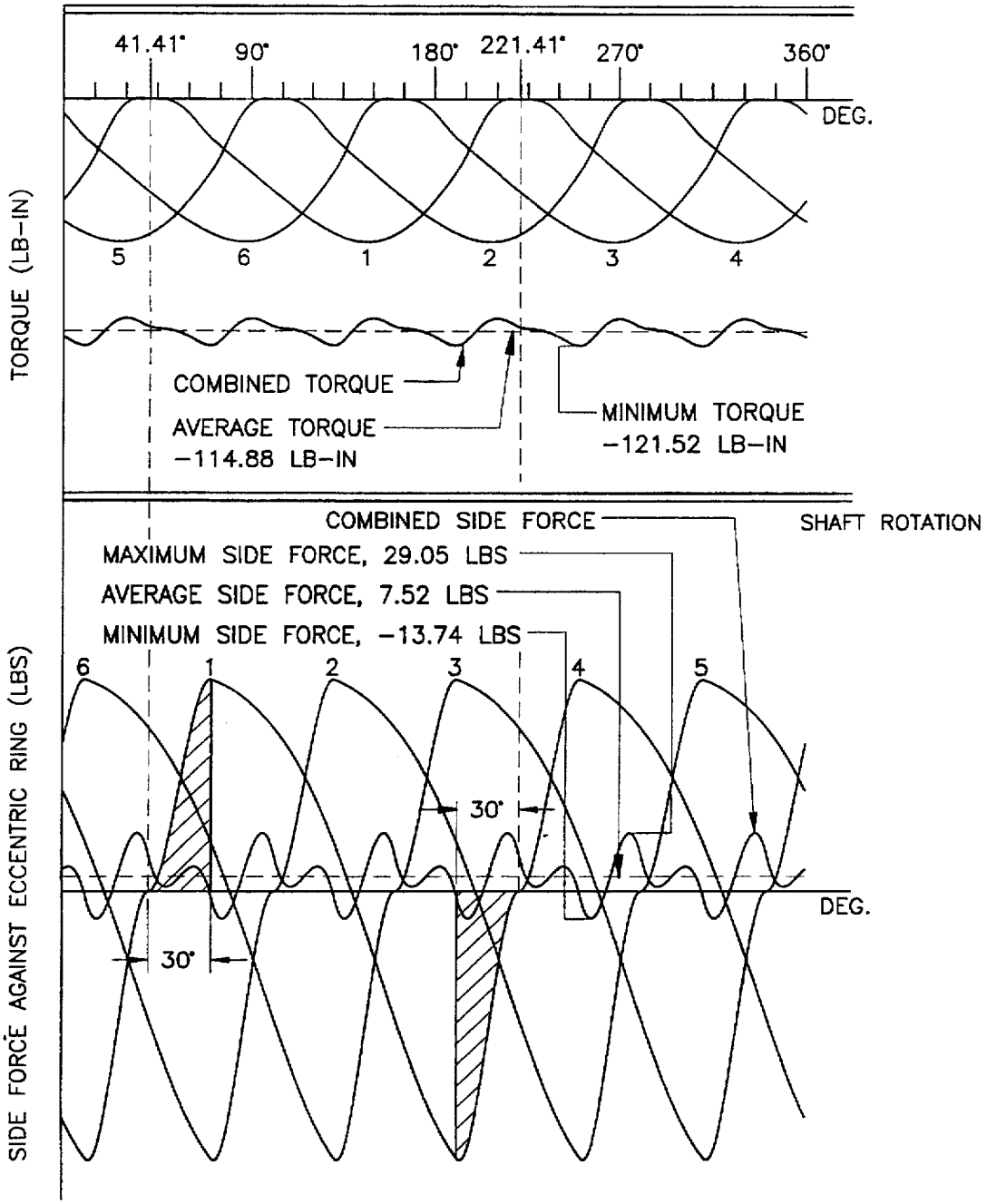
FIG. 22 is a graphical representation of the performance of a damped eccentric ring pump performance snowing shaft torque and eccentric ring offset versus rotation.

Referring to FIGS. 13, 21 and 22, a damped pump 204 expanding fluid is modeled and the dynamic modeling analysis therefor are shown, respectively. Compressed fluid is introduced from the reservoir 122 into the piston chamber 256 through cylinder inlet 258. Due to the eccentricity of the eccentric ring 250 relative to the pump housing 230, the compressed fluid encourages the piston chamber 256 to expand and rotate the piston housing 226 in a counterclockwise direction. At the end of the expansion cycle, the piston 238 forces fluid through a passageway 263, shown in FIG. 12, via the low pressure port 262. The passageway 263 conducts the compressed fluid to the ambient atmosphere.

As shown in the upper graph in FIG. 22, the resultant expansion generates a combined torque in the counterclockwise direction, the same rotational direction as the shaft 202. As shown in the lower graph in FIG. 22, a resultant rightward side force also is generated. The damped high pressure port 260 and low pressure port 262 mitigate the torque and side force oscillations. The combined torque peaks at −121.52 inch-pounds and averages −114.88 inch-pounds. The combined side force ranges between 29.05 pounds and −13.74 pounds and averages 7.52 pounds. The side force always acts to center the eccentric ring 250 as is demonstrated in the lower graphical representations shown on FIGS. 20 and 22. This phenomenon occasions pump stability.

Referring again to FIG. 13, the invention includes another means for reducing the degradive effects of oscillating side forces. The passageways 264 conduct fluid to the fifth and sixth chambers 266 and 268, respectively, as discussed below in further detail. These passageways 264, configured to constrict fluid flow, essentially operate as dashpots. The fifth and sixth pistons 270 and 272 are not able to translate instantaneously due to this viscous damping phenomenon.

Figure 23:
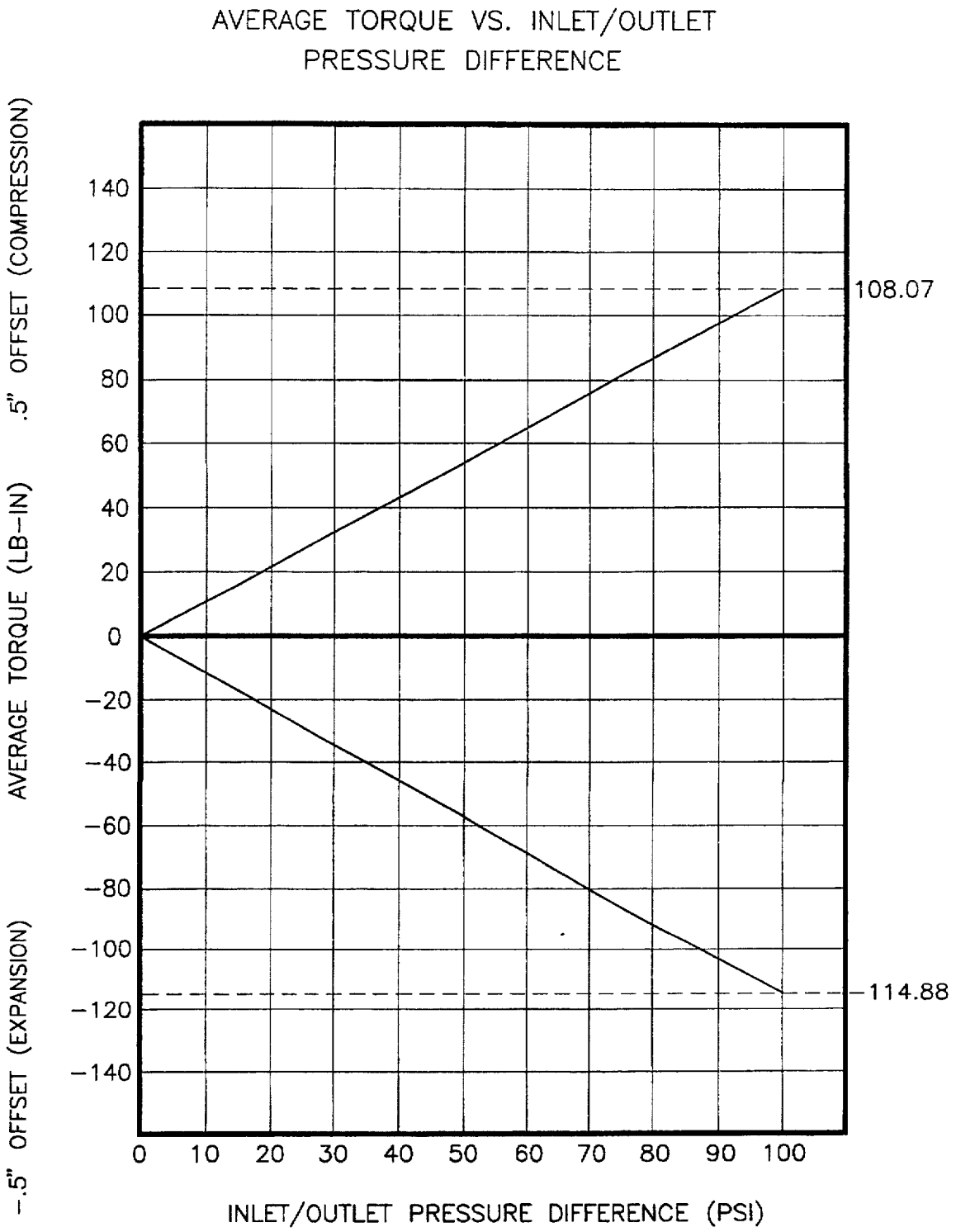
FIG. 23 is a graphical representation of damped pump performance showing average shaft torque versus inlet-outlet pressure difference.
Figure 24:
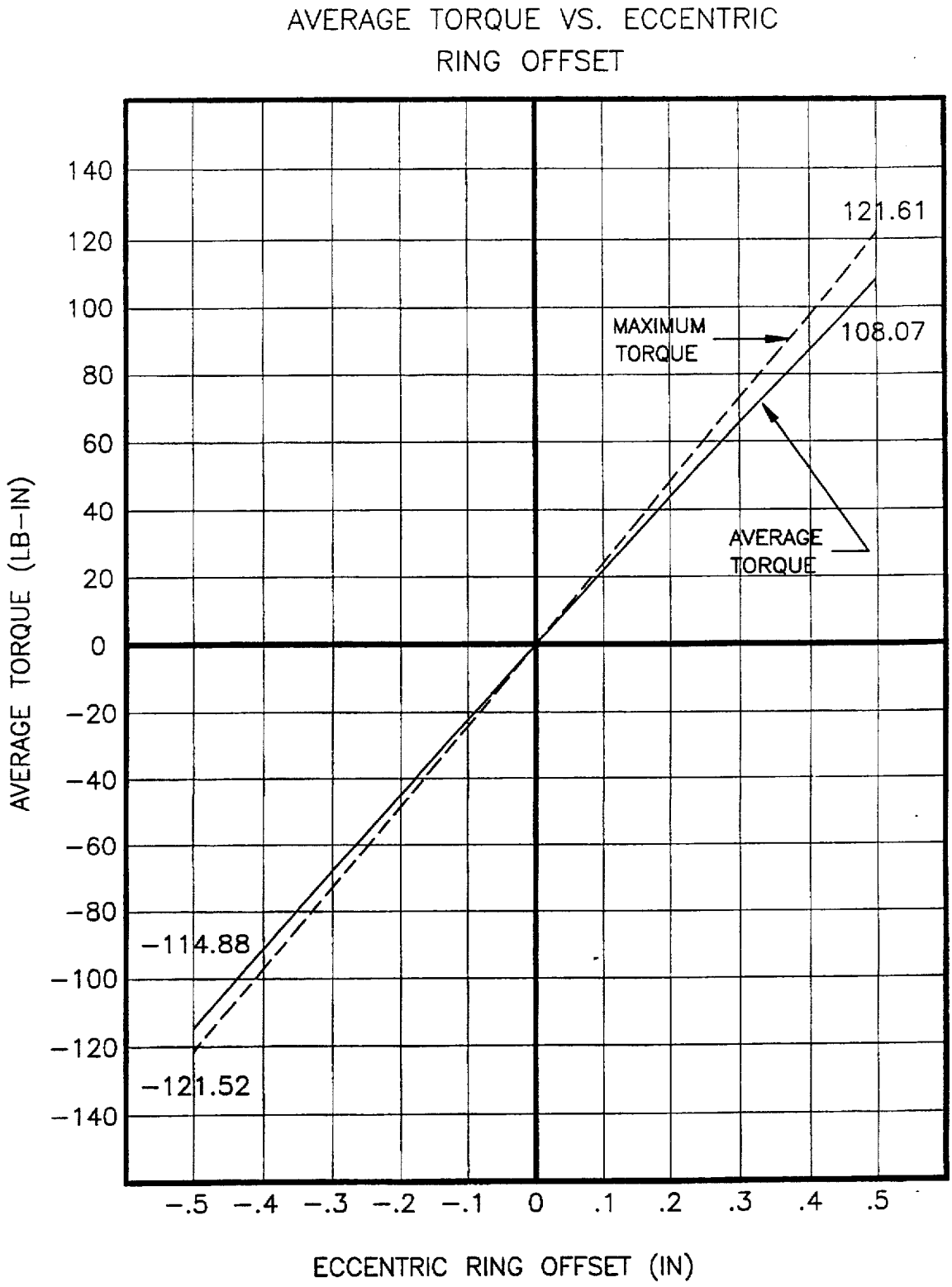
FIG. 24 is a graphical representation of damped eccentric ring pump performance showing average shaft torque versus eccentric ring offset.
Figure 25:
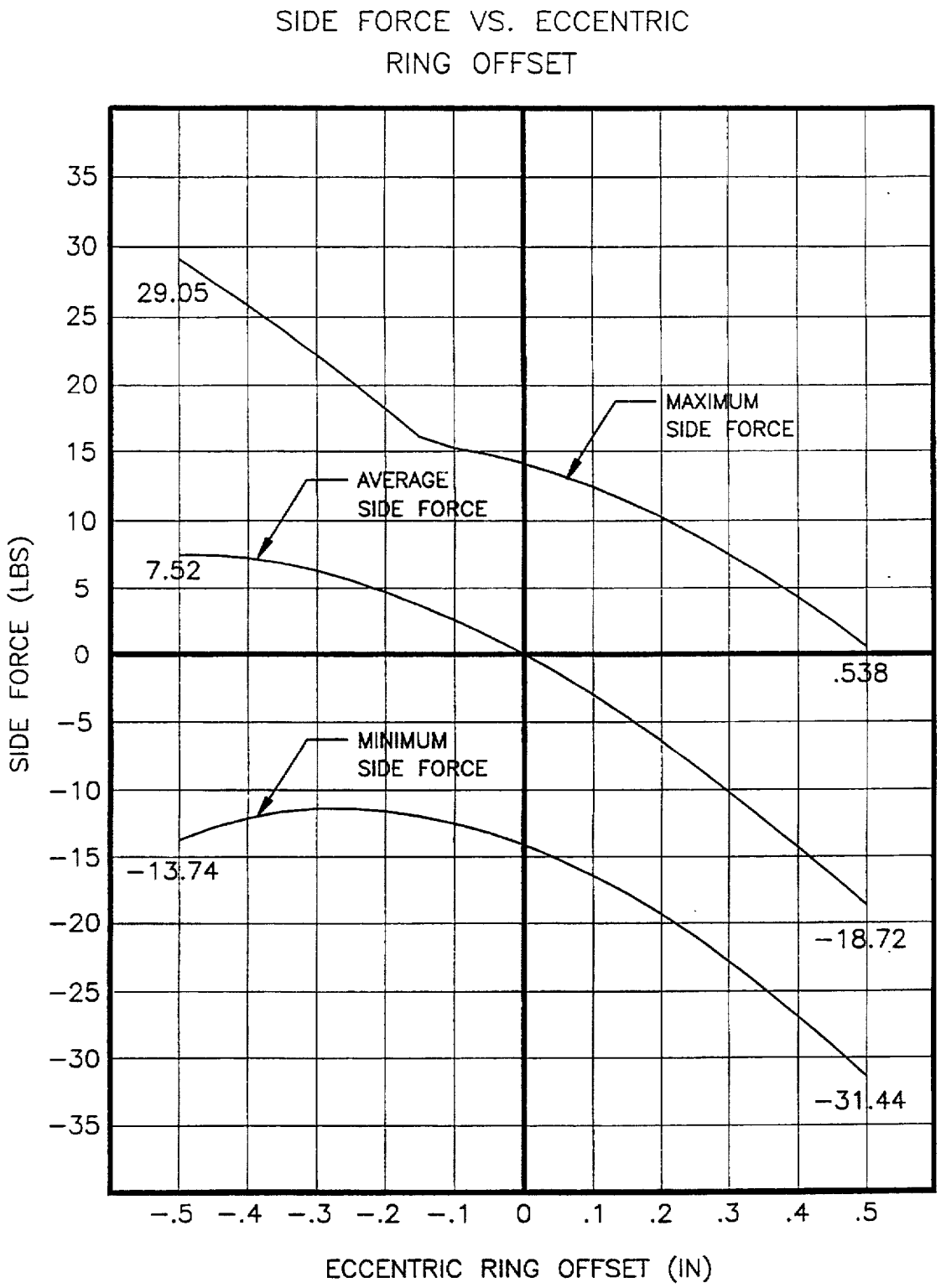
FIG. 25 is a graphical representation of damped pump performance showing average side force versus eccentric ring offset.

FIGS. 23, 24 and 25 show the performance characteristics associated with pressure difference and eccentric ring offset for a damped pump.

2. Eccentric Ring Pump Control Means.

The invention includes control means which simultaneously configures the pump to either compress or expand fluid and establishes pump displacement as well.

Referring again to FIGS. 12 and 13, controlling the eccentricity of the eccentric ring 250 becomes problematic as pressure increases. As the shaft 202 rotates, the chambers 256 are charged intermittently with high pressure fluid. The intermittent charges generate a high steady-state component and an oscillating component of force on the eccentric ring 250. When the reservoir 122 contains high pressure fluid and extreme braking or drive is demanded, charging approaches maximum, therefore the force against the eccentric ring approaches maximum. Typically, maximum torque is demanded in response to urgent situations, where such is needed instantaneously. Unfortunately, the situation poses an engineer's nightmare: instantaneous translation under maximum loading.

The invention provides control mechanisms for ready translation of the eccentric ring 250 under maximum loading conditions. The control mechanism shown combats the steady state and oscillating forces in two ways: First, when eccentricity is steady, the mechanism becomes hydraulically locked in place. When eccentricity is altered, the mechanism employs two fluid circuits having different configurations which afford the user a mechanical advantage that overcomes counteractive forces imparted by the eccentric ring 250.

Figure 26:
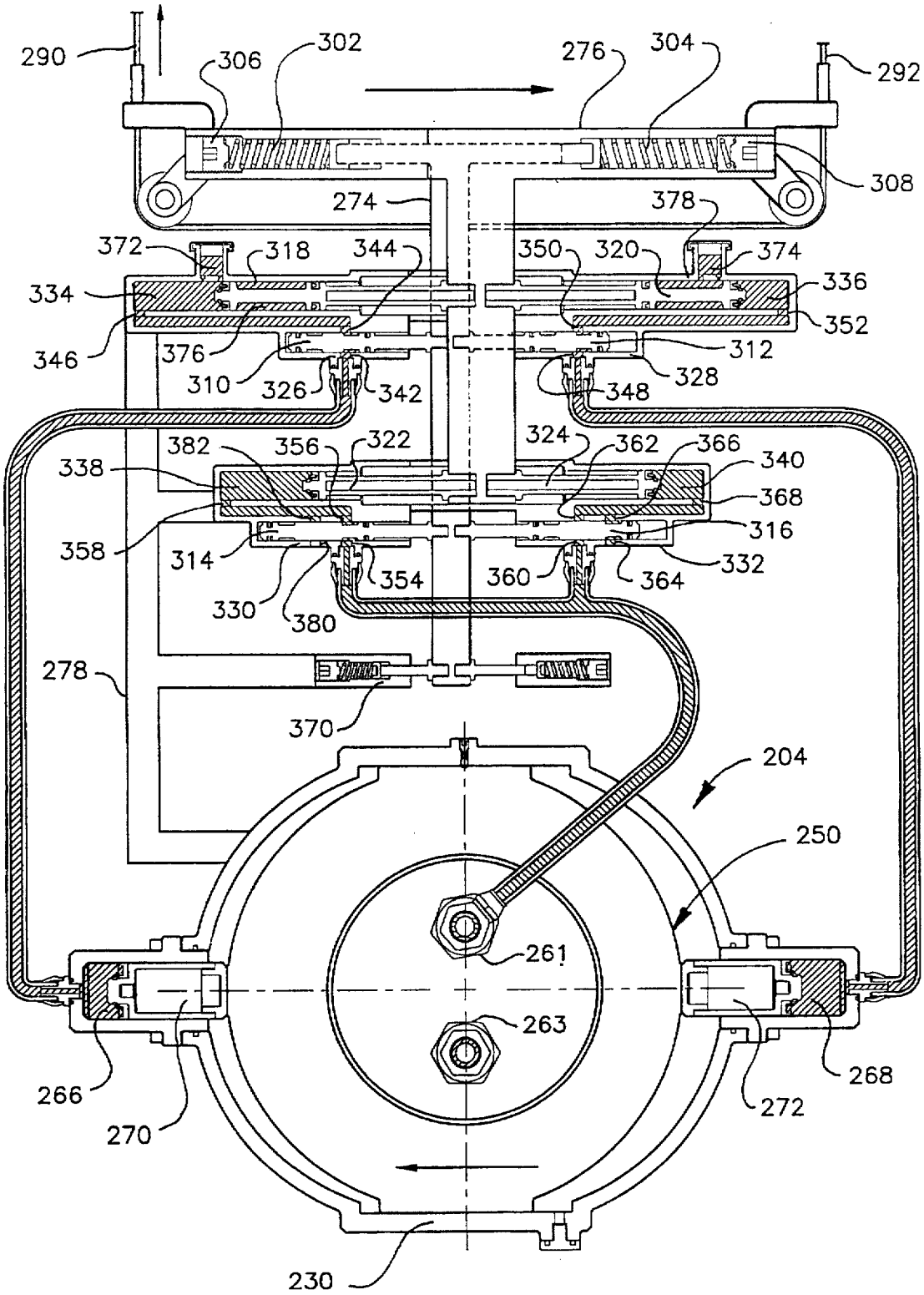
FIG. 26 is primarily a diagrammatic detail view of the reservoir, pump-motor and the control mechanisms associated with fluid communication between the reservoir and the pump-motor.

FIG. 26 shows the preferred embodiment of the control mechanism which consists entirely of mechanical means having three basic components: signal bar 274, centering member 276 and pump housing 230. Each component moves independently with respect to the other components. The pump housing 230 is shown integral with a fictional "support frame" 278 for the pistons and cylinders shown. The "support frame" 278 is presented as a teaching aid only. In the preferred embodiments disclosed, the signal bar 274 centering member 276 and eccentric ring 250 translate either left or right, viz. a first or second direction, respectively, as shown. Pump displacement depends on the offset of the eccentric ring 250 relative to the pump housing 230. Translation of the eccentric ring 250 from the right to the left, or from the second direction toward the first direction, induces less braking. Translation beyond the transition point between the first and second direction induces drive. Reversing the process decreases acceleration and induces braking. The control mechanism described herein precisely positions the eccentric ring 250 relative to the pump housing 230 linearly proportional to the displacement of the signal bar 274 relative to the pump housing 230. FIGS. 29 through 33 show the true nature of the mechanisms so depicted.

Referring again to FIG. 3, the signal bar 274 is displaced by rotating a demand lever 280.

Figure 28:
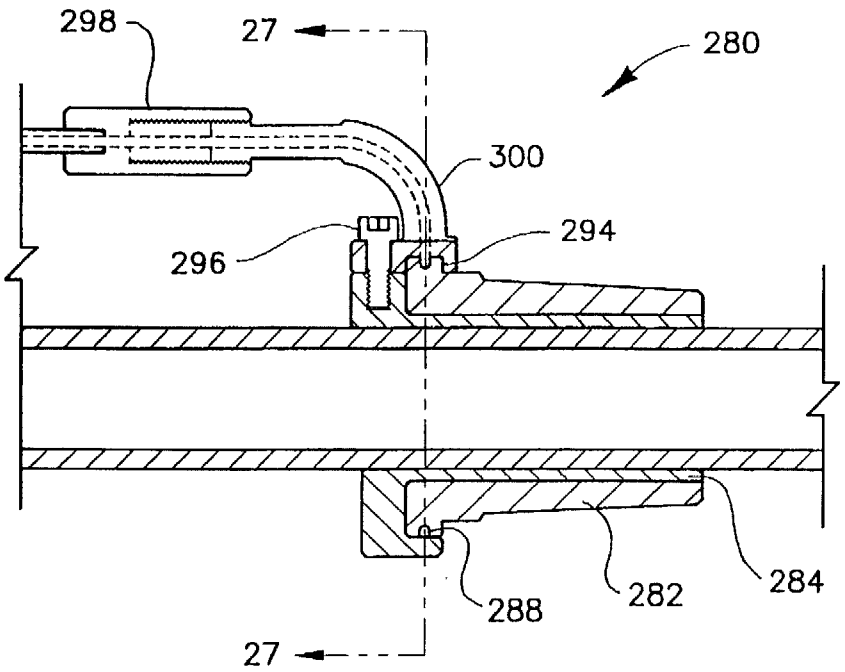
FIG. 28 is a cross-sectional detail view of the braking lever drawn across line 28—28 of FIG. 27.
Figure 27:
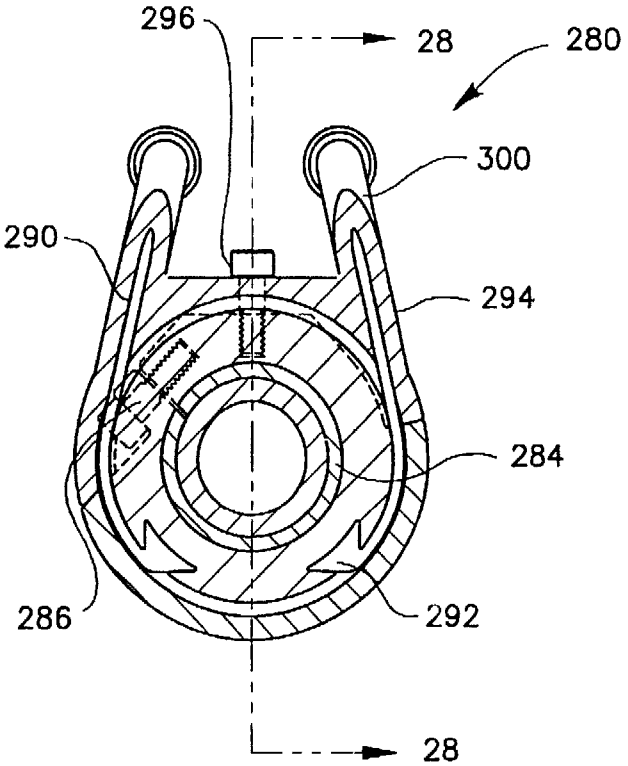
FIG. 27 is a cross-sectional detail view of the braking lever drawn across line 27—27 of FIG. 28.
Figure 29:
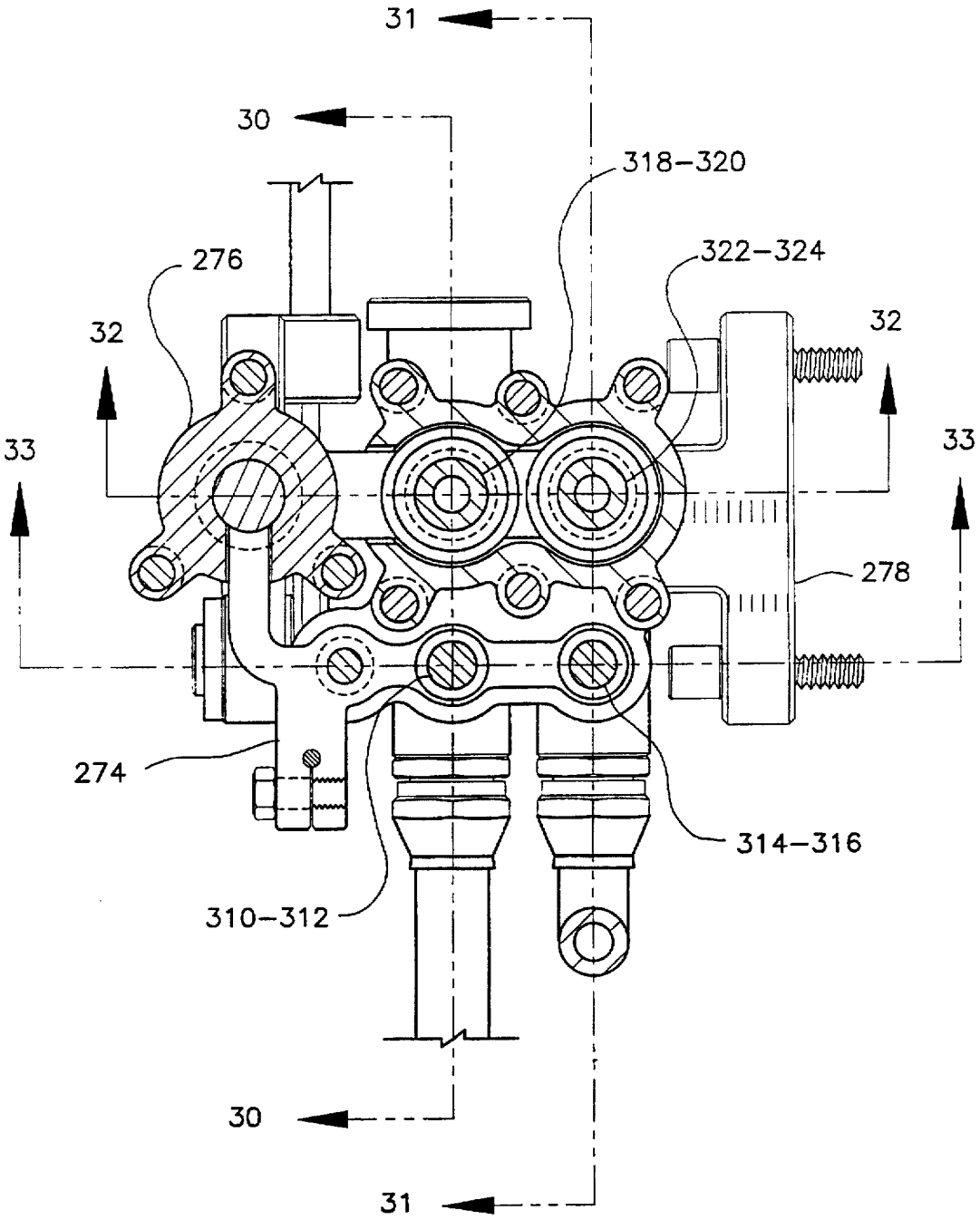
FIG. 29 is a transverse cross-sectional detail view of the control mechanisms associated with fluid communication between the reservoir and the pump-motor drawn across line 29—29 of FIG. 30.
Figure 30:
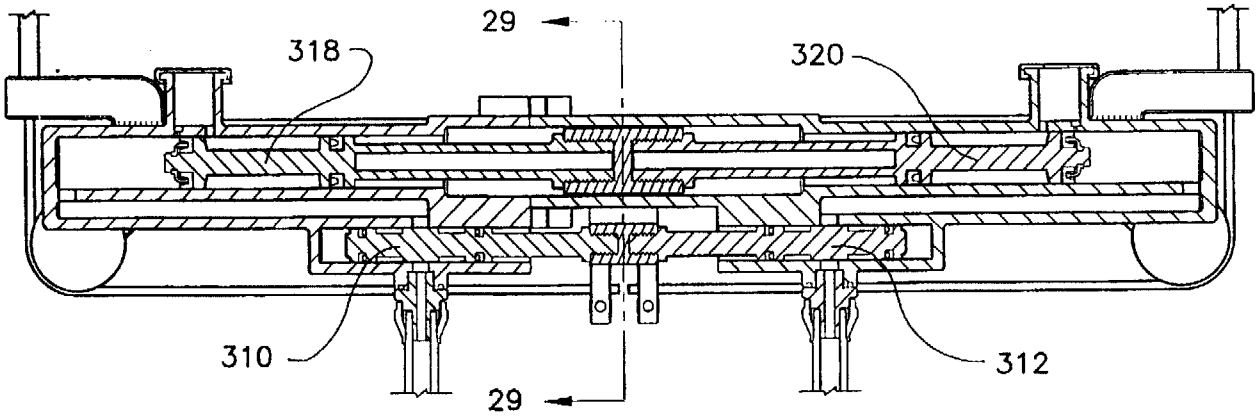
FIG. 30 is a longitudinal, side cross-sectional detail view of the non-compressible fluid chambers of the control mechanisms associated with fluid communication between the reservoir and the pump-motor drawn across line 30—30 of FIG. 29.
Figure 31:
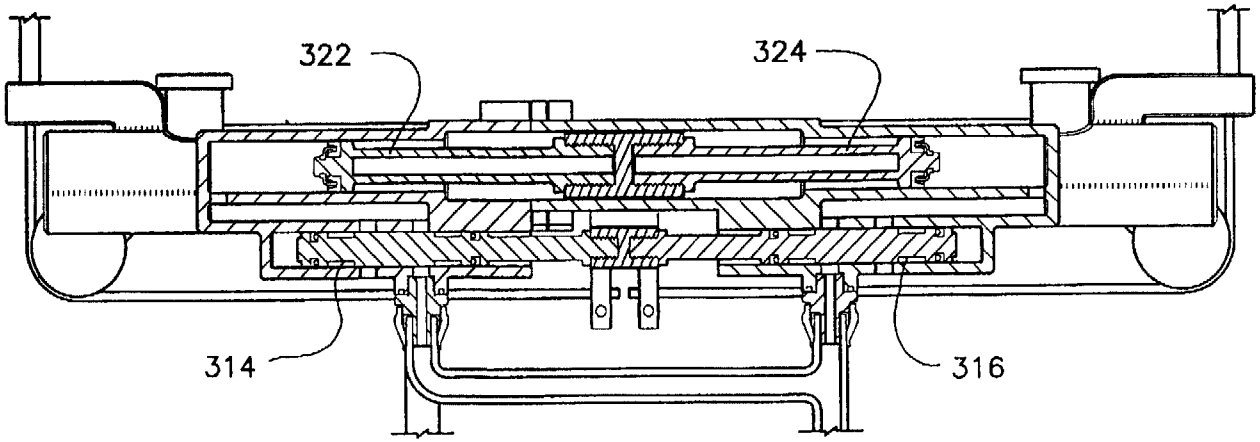
FIG. 31 is a longitudinal, side cross-sectional detail view of the compressible fluid chambers of the control mechanisms associated with fluid communication between the reservoir and the pump-motor drawn across line 31—31 of FIG. 29.
Figure 32:
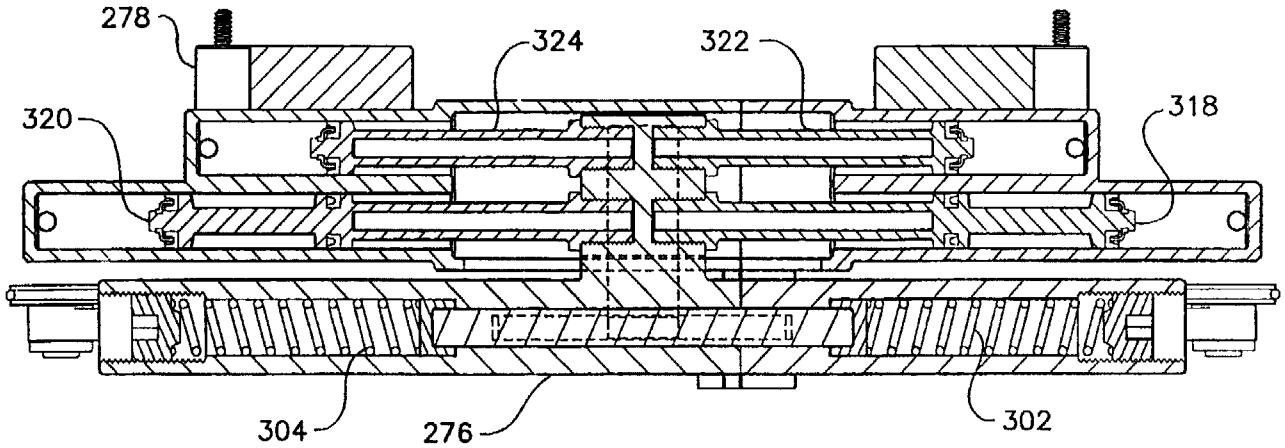
FIG. 32 is a longitudinal, top plan cross-sectional detail view of the non-compressible and compressible fluid chambers of the control mechanisms associated with fluid communication between the reservoir and the pump-motor drawn across line 32—32 of FIG. 29.
Figure 33:
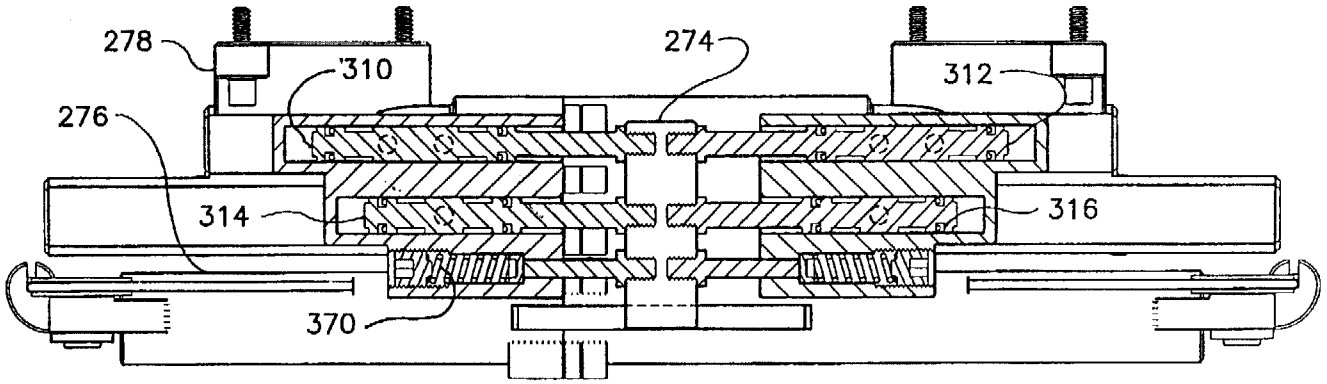
FIG. 33 is a longitudinal, bottom plan cross-sectional detail view of the control spools which control non-compressible and compressible fluid flow to the appropriate compressible and non-compressible fluid chambers of the control mechanisms associated with fluid communication between the reservoir and the pump-motor drawn across line 33—33 of FIG. 29.

Referring to FIGS. 27 and 28, a grip 282 is slidably mounted about a clamping sleeve 284. The sleeve 284 is fixed relative to a vehicle, a bicycle in this embodiment, with a clamping screw 286. The grip 282 includes a cable guide 288 to which the cables 290 and 292 are attached. The cable guide cover 294 is secured onto the clamping sleeve 284 by a screw 296. Cable tension may be adjusted by tensioner 298 which is threadingly engaged with the cable housing 300. The cable housing 300 may be integral with the guide cover 294.

Referring again to FIGS. 3, 26 and 27, rotating the grip 282 counter-clockwise, as best seen on FIG. 27, induces tension in the cable 290, displacing the signal bar 274 relative to the centering member 276 and relative to the pump housing 230. As shown on FIG. 26, the signal bar is urged leftwardly, toward the first direction, linearly corresponding to the amount of demand lever displacement. Displacement of the signal bar 274 to the left, the first direction, eventually urges the eccentric ring 250 toward the left, increasing pump displacement for driving. When the eccentric ring 250 is centered, displacement is zero. Displacement of the signal bar 274 to the right, the second direction, eventually urges the eccentric ring 250 to the right, decreasing pump displacement for braking.

The signal bar 274 is biased toward the centering member 276 by springs 302 and 304. The bias of the springs 302 and 304 may be adjusted by adjustment screws 306 and 308, respectively. As offset between the signal bar 274 and centering member 276 increases, the biasing force increases. As the user increases demand lever displacement, the user experiences increased resistance from the grip 282. The user will experience the same resistance from the grip 282 regardless of the location of the centering member 276 relative to the pump housing. increased tension in cable 290 creates more offset between signal bar 274 and centering member 276 and greater signal bar-centering member bias force.

The following table provides a quick reference to components discussed below and their representations on the drawings:

ECCENTRIC RING CONTROL MEANS PARTS TABLE

| PART | NO. |
|---|---|
| first spool | 310 |
| second spool | 312 |
| third spool | 314 |
| fourth spool | 316 |
| first piston | 318 |
| second piston | 320 |
| third piston | 322 |
| fourth piston | 324 |
| fifth piston | 270 |
| sixth piston | 272 |
| first cylinder | 326 |
| second cylinder | 328 |
| third cylinder | 330 |
| fourth cylinder | 332 |
| first chamber | 334 |
| second chamber | 336 |
| third chamber | 338 |
| fourth chamber | 340 |
| fifth chamber | 266 |
| sixth chamber | 268 |

When the signal bar 274 is offset to the left relative to the pump housing 230, the signal bar 274 drives the first, second third and fourth spools, 310, 312, 314 and 316, respectively, in their respective first, second, third and fourth cylinders, 326, 328, 330 and 332. Translation of the spools initiates fluid communication through two, bifurcated fluid circuits. The first fluid circuit includes noncompressible fluid, preferably hydraulic fluid. The second fluid circuit includes compressible fluid, preferably ambient air.

In the first circuit, the first spool 310 initiates fluid communication between a first piston chamber 334 and a fifth piston chamber 266 via apertures 342, 344 and 346 in the first cylinder 326. The second spool 312 initiates fluid communication between a second chamber 336 and a sixth chamber 268 via apertures 348, 350 and 352 in the second cylinder 328.

In the second fluid circuit, the third spool 314 initiates fluid communication between the high pressure port 260 of the pump 204 and the reservoir 122 and a third chamber 338 via the passageway 261 and the apertures 354, 356 and 358 in the third cylinder 330. The fourth spool 316 blocks fluid communication between the high pressure port 260 of the pump 204 along with the reservoir 122 and the fourth chamber 340 via apertures 360 and 362 in the fourth cylinder 332. However, the fourth spool 316 does permit fluid communication between the fourth chamber 340 and the atmosphere via the apertures 364, 366 and 368 in the fourth cylinder 332.

In the second fluid circuit, fluid from the reservoir 122 is directed to the pump 204 via conduit 146 and expanded therein. This fluid also is introduced into the third chamber 338 and urges the third piston 322 to translate the centering member 276 toward the right or second direction, opposite the direction toward which the signal bar 274 was urged. The relative distance between the signal bar 274 and centering member 276 does not decrease, so long as demand lever displacement remains constant; thus the signal bar 274 and centering member 276 remain positionally fixed.

The eccentric ring 250 naturally tends toward being centered within the pump housing 230, imparting zero displacement on the pump 204. Thus, as represented on FIG. 26, the average oscillating side force urges the eccentric ring 250 to translate toward the right. The eccentric ring 250, in turn, imparts force against the sixth piston 272 and increases fluid pressure in the sixth chamber 268. Fluid from the sixth chamber 268 is urged into the second chamber 336 against the second piston 320. The head created by the pump in the third chamber 338 drives the third piston 322 against the centering member 276, overcoming the opposing force imparted by the second piston 320. In short, the initial urging of the signal bar 274 to the left eventually causes the centering member 276 along with the pistons 318, 320, 322 and 324 to translate to the right, urging the sixth piston 272 and eccentric ring 250 to the left.

The force required from the sixth piston 272 to translate the eccentric ring 250 is a function of system pressure and the cross sectional areas of the first, second, third, fourth, fifth and sixth pistons 318, 320, 322, 324, 270 and 272, respectively. These face areas may be configured to adjust the error between signal bar translation and eccentric ring translation.

As the centering member 276 translates to the right, or second direction, the signal bar 274 translates with it and urges the spools, 310, 312, 314 and 316, to translate within their respective cylinders, 326, 328, 330 and 332. Eventually, the spools will be induced to interrupt fluid communication within the fluid circuits, hydraulically locking the eccentric ring 250 of the pump 204 between the fifth and sixth pistons, 270 and 272, fixing the eccentricity of the pump 204. The pump 204 expands fluid from the reservoir 122 at a newly fixed displacement As noted above, signal bar displacement linearly corresponds to demand lever displacement. The centering member 276 translates until the spools 310, 312, 314 and 316 interrupt fluid communication within the fluid circuits, occurring when the centering member 276 has translated the initial distance the signal bar 274 was offset relative to the centering member 276. Since the eccentric ring 250 of the pump 204, which defines pump eccentricity, translates in direct proportion to the distance the centering member 276 translates, pump eccentricity linearly corresponds to demand lever displacement. This linear relationship occurs, however, after the brief hysteresis as discussed.

The dimensions of the first and second spools, 310 and 312, respectively, differ from those of the third and fourth spools, 314 and 316, such that the apertures 354, 356, 360 and 362 open slightly before apertures 342, 344, 348 and 350 when the signal bar 274 is urged in either direction. This convention permits the third chamber 338 or fourth chamber 340 to charge up with compressed fluid prior to permitting the eccentric ring 250 to translate freely. This slight delay introduces a small error between the input signal to the signal bar 274 and the desired eccentric ring translation. When the system is employed with negligible pressure in the reservoir 122, and the eccentric ring 250 is centered, no pneumatic force is available to urge the eccentric ring 250 off center. A spring 370, acting against the signal bar 274, in this case, urges the centering member 276 in the opposite direction from that in which the signal bar 274 was moved. Recall that tension in the demand lever 280 is caused only by relative displacement between the signal bar 274 and the centering member 276. The force placed on the signal bar 274 by the spring 370 acts equally against the centering member 276, thus urging the first and second pistons 318 and 320 to drive the eccentric ring 250 off center. Another means for imparting an initial quantum of offset between the eccentric ring 250 and the pump housing 230 includes a means for maintaining an initial, predetermined amount of pressure in the reservoir 122, such as a valve.

To encourage close contact between the fifth and sixth pistons 270 and 272 and the eccentric ring 250, accumulators 372 and 374, similar to accumulator 124, are in fluid communication with first and second chambers 334 and 336. When second piston 320 is translated right, as shown in FIG. 26, the second chamber 336 is sealed from accumolator 374 allowing pressure to build in this chamber and the associated hydraulic circuit. Secondary chambers 376 and 378, in conjunction with the accumulators 372 and 374, prevent air from entering the first fluid circuit while maintaining a store of hydraulic fluid to make up for any leakage.

Referring again to FIGS. 3, 26 and 27, to brake the rotating element, the user displaces the demand lever 280 toward the second direction and imparts offset between the signal bar 274 and centering member 276 in the second direction, or toward the right as shown on FIG. 26. Rotating the grip 282 clockwise, as best seen on FIG. 27, induces tension in cable 292, drawing the signal bar 274 to the right. When the signal bar 274 drives the spools, 310, 312, 314 and 316, in their respective cylinders, 326, 328, 330 and 332, fluid communication is initiated through the two fluid circuits.

In the first fluid circuit, the first spool 310 initiates fluid communication between the first piston chamber 334 and the fifth piston chamber 266 via apertures 342, 344 and 346 in the first cylinder 326. The second spool 312 initiates fluid communication between the second chamber 336 and the sixth chamber 268 via apertures 348, 350 and 352 in the second cylinder 328.

In the second fluid circuit, the third spool 314 blocks fluid communication between the high pressure port 260 of the pump 204 along with the reservoir 122 and the third chamber 338 via the apertures 354, and 356 in the third cylinder 330. However, the apertures 380, 382 and 358 permit venting of the fluid from the third chamber 338 to the atmosphere preventing pressure from building therein. The fourth spool 316 initiates fluid communication between the high pressure port 260 of the pump 204 along with the reservoir 122 and the fourth chamber 340 via the passageway 261 and the apertures 360, 362 and 368 in the fourth cylinder 332.

In the second fluid circuit, the pump 204 compresses fluid into the reservoir 122 through conduit 146. The fluid also is introduced into the fourth chamber 340 and urges the fourth piston 324 to translate the centering member 276 to the left, opposite the direction the signal bar 274 was urged. Since hydraulic fluid may freely flow from the first chamber 334 to the fifth chamber 266, the pressure building against the fourth piston 324 urges fluid from the first chamber 334 into the fifth chamber 266. Simultaneously, fluid is urged from the sixth chamber 268 by the sixth piston 272 into the second chamber 336. The eccentric ring 250 is urged to the right, promoting breaking, and the centering member 276 translates to the left.

As the centering member 276 translates toward the left or first direction, the signal bar 274 translates with it and urges the spools, 310, 312, 314 and 316, to translate within their respective cylinders, 326, 328, 330 and 332. As above, the spools eventually interrupt fluid communication within the fluid circuits, hydraulically locking the eccentric ring 250 of the pump 204 between the fifth and sixth pistons, 270 and 272, fixing its eccentricity. The pump 204 compresses fluid at a newly fixed displacement.

The pump 204 has a passageway 263 which provides fluid communication between it and the ambient atmosphere. As the pump 204 compresses fluid into the reservoir 122, it draws in fluid from the atmosphere.

Figure 34:
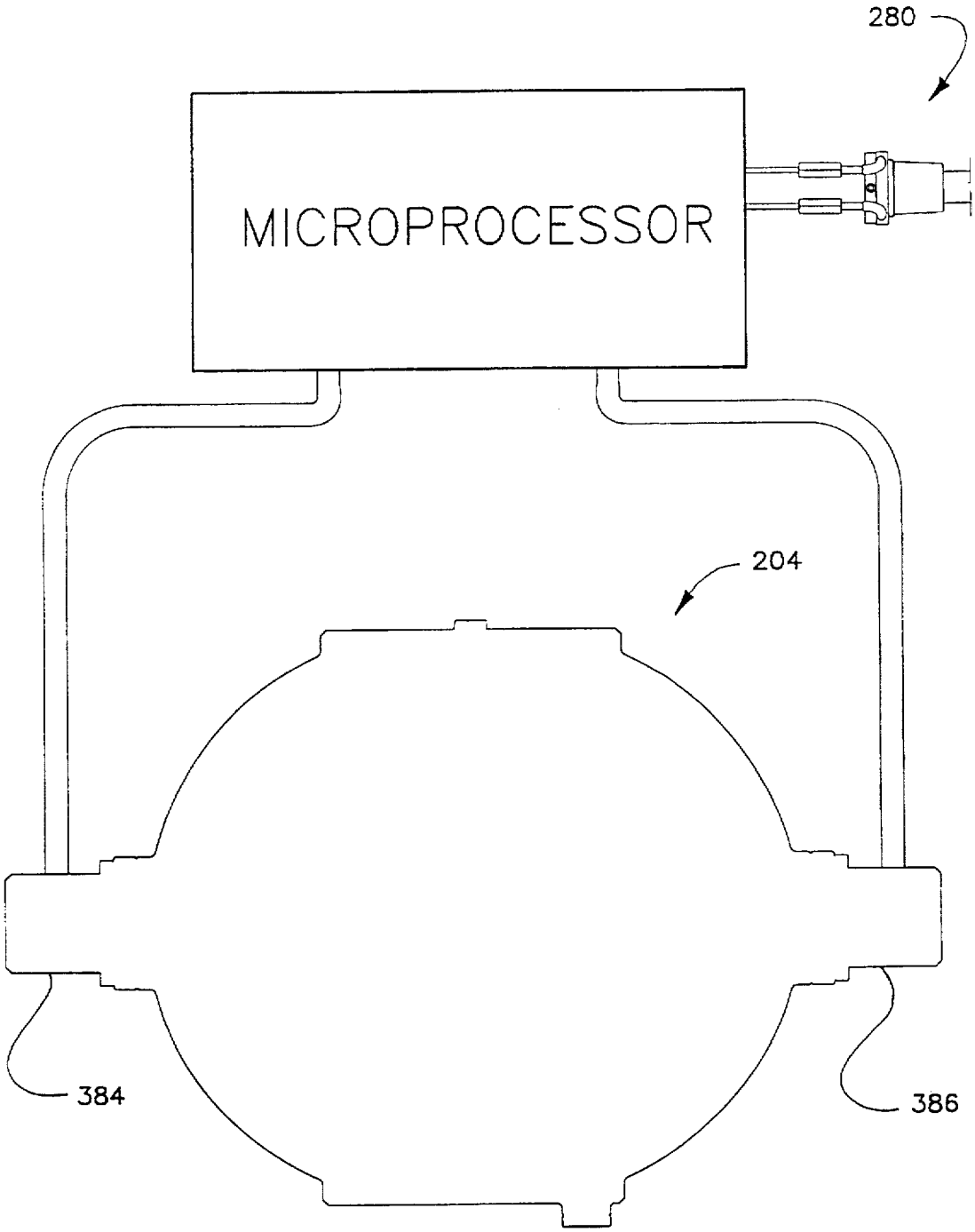
FIG. 34 is a diagrammatic view of a braking/accelerating lever, pump and microprocessor in communication therewith.

Referring to FIG. 34, a secondary embodiment of the control mechanism is shown. The second embodiment utilizes switches, microprocessors and solenoids for controlling eccentricity of the pump 204. The microprocessor registers the amount of displacement of demand lever 280. The microprocessor, provided with data correlating a demand value to a braking or driving value, divides energy appropriately between the solenoids 384 and 386 commensurate with the demand received. The eccentric ring 250 according the eccentric ring 250 accordingly. To work against high eccentric ring side forces, an alternative embodiment (not shown) would have solenoids 384 and 386 urging the signal bar 274 in master-slave type arrangement using pneumatic and hydraulic fluid circuits to drive the eccentric ring, as described supra.

C. Auxiliary Braking and Driving Means

Figure 35:
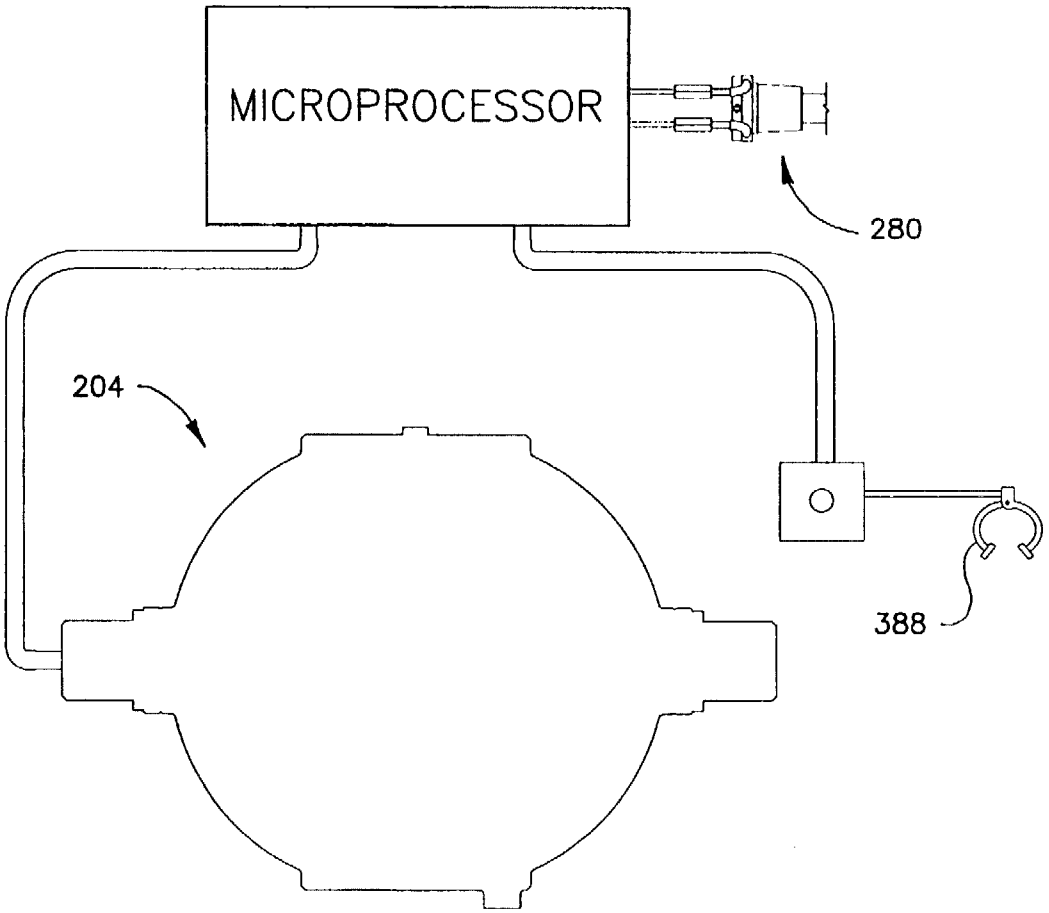
FIG. 35 is a diagrammatic view of a braking lever, pump, conventional calliper brake and microprocessor in communication therewith.

Referring to FIG. 35, an auxiliary braking means is shown. When the pump 204 can not supply sufficient braking means, the invention provides for employing auxiliary braking to insure vehicle braking. The braking means shown includes a conventional caliper-type brake 388, however, the invention may use a disk-type brake (not shown) or the like. In one embodiment, the user, perhaps a velocipedist, would simultaneously employ the auxiliary braking means sufficient to satisfy the difference between the braking need and the readily-discernible pump braking potential. A second embodiment, shown on FIG. 35, employs a microprocessor and solenoids for controlling the auxiliary braking means. The user displaces the demand lever 280 and sends a brake demand to the microprocessor. The microprocessor registers the brake demand and monitors the braking capability of the pump. The microprocessor employs the auxiliary braking means sufficient to satisfy the difference between the braking demand and the pump braking potential.

Where the present invention potentially may not supply sufficient drive, the invention also includes a means to regulate the amount of torque imparted on the rotating element by a separate means to supplement that of the pump. The user displaces the demand lever 280 which sends a drive demand to the microprocessor. The microprocessor registers the drive demand and monitors the drive capability of the pump. The microprocessor will direct a signal to an auxiliary power plant to satisfy the difference between the drive demanded and drive capability of the pump. Naturally, this embodiment is not applicable to velocipedes.

D. Axial Piston Pump and Control Means Therefor

1. Axial Piston Pump

Figure 36:
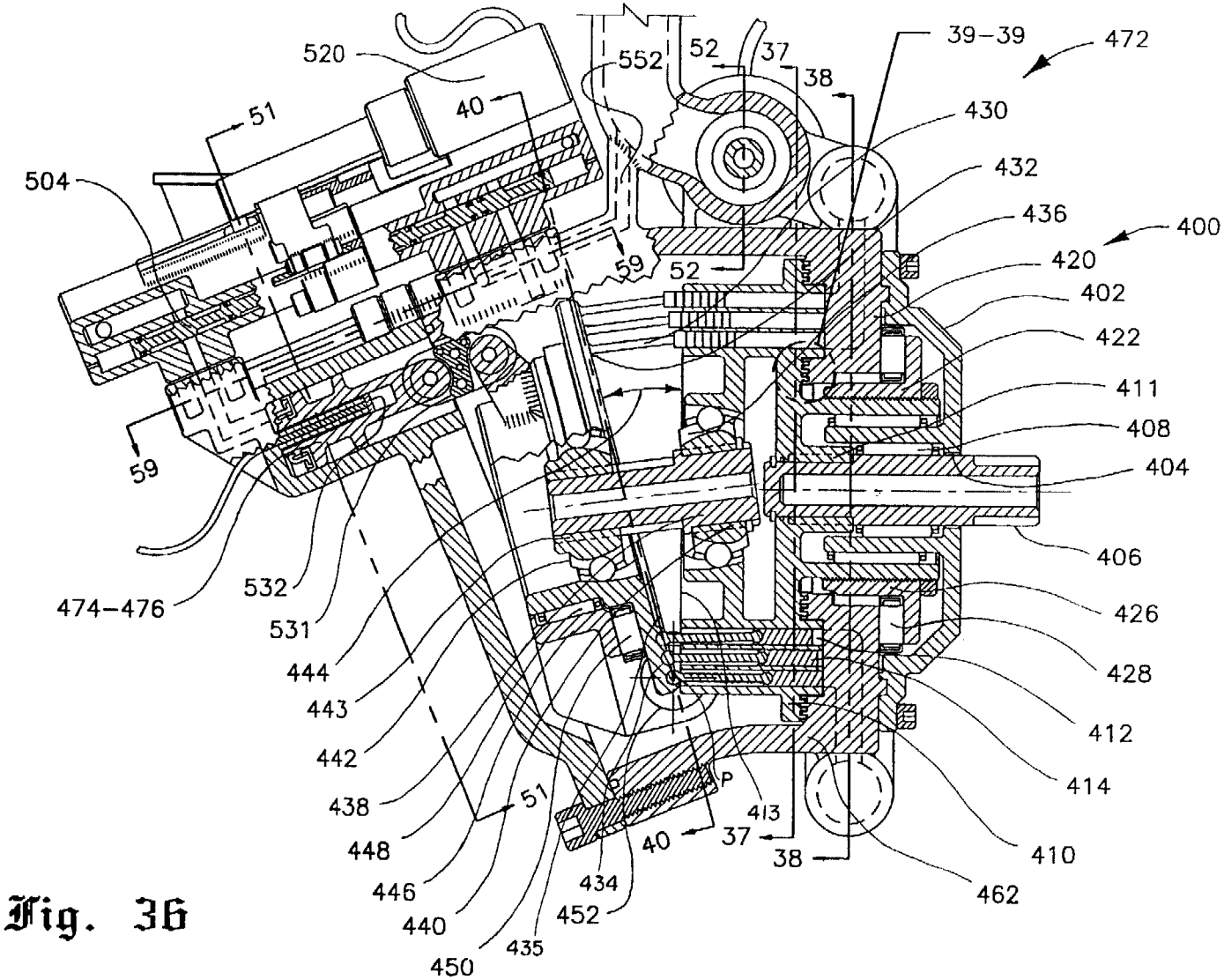
FIG. 36 is a cross-sectional detail view of an axial piston pump drawn along line 36—36 of FIG. 51.

Referring to FIG. 36, another embodiment of the invention is shown including an axial piston pump 400. The pump 400 is shown including a face plate 402 having an axial bore 404. A shaft 406 is maintained in the axial bore 404 by needle bearings 408 interposed between the housing 402 and shaft 406. The shaft 406 is drivingly connected to a chamber barrel 410 with splines 411.

Figure 37:
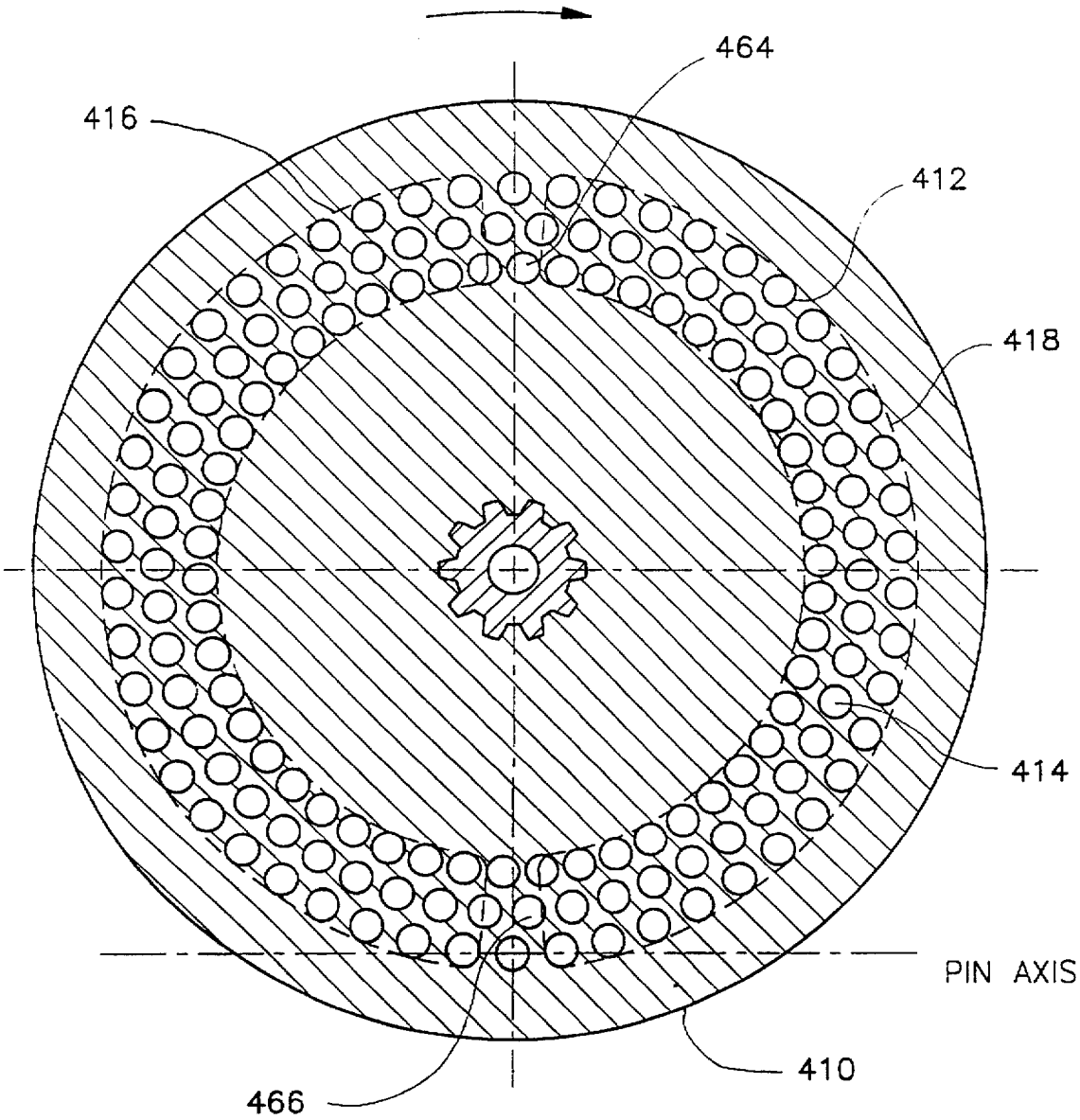
FIG. 37 is a cross-sectional detail view of the cylinder barrel taken along line 37—37 in FIG. 36.

Referring also to FIG. 37, the chamber barrel 410 has a plurality of radially and concentrically diverged axial chambers 412. A piston 414 is disposed in each chamber 412, each having a stroke between an expanded and a compressed position. Increasing the number of pistons 414 and chambers 412 disposed within the chamber barrel 410 increases the power handling capability of the pump 400. The concentric arrangement of pistons 414 and chambers 412 provides for smooth power transition from piston to piston. When one piston 414 is approximately mid-way through its power stroke, another piston 414 begins its power stroke and yet another piston 414 completes its power stroke. This offset convention also minimizes oscillating forces generated in the pump 400.

Figure 38:
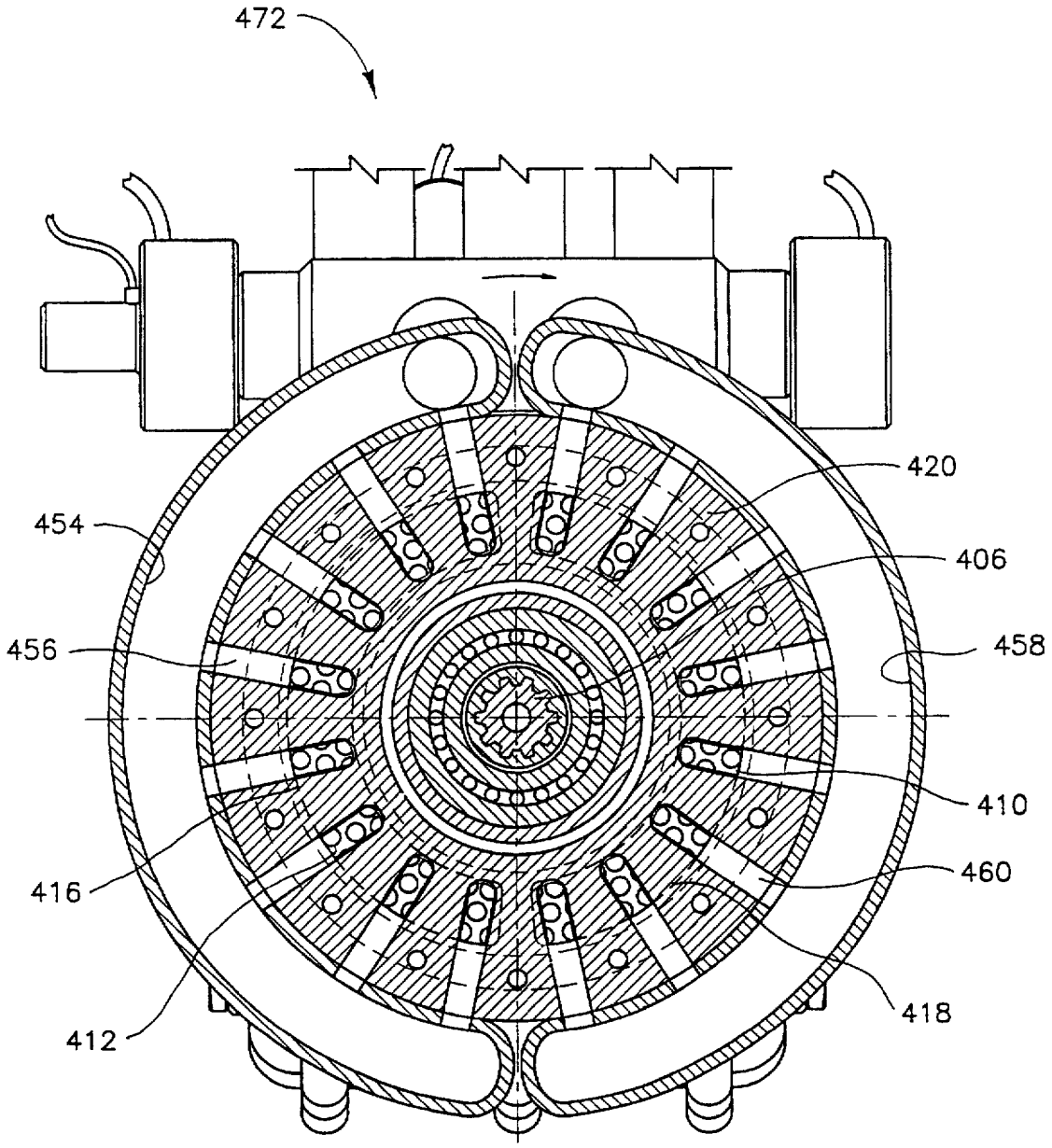
FIG. 38 is a cross-sectional detail view of the valve plate taken along line 38—38 in FIG. 36.

Referring also to FIG. 38, the shaft 406, chamber barrel 410 and kidney shaped ports 416 and 418 of a valve plate 420 are shown, port 416 being defined as an Inlet port and port 418 being defined as an outlet port by the clockwIse rotation of the chamber barrel relative to the valve plate 420. The high pressures maintained in the pump 400 strain the valve plate 420 at the member 422, as shown on FIG. 36, such that an adequate gap between the valve plate 420 and the chamber barrel 410 is maintained. As the chamber barrel 410 rotates, fluid flows into each chamber 412 in fluid communication with the inlet port 416. Further rotation results in release of the fluid into the outlet port 418. In this embodiment, either port 416 or 418 may be configured to be a low- or high-pressure port, depending on whether the pump 400 is configured to compress or expand fluid.

Figure 39:
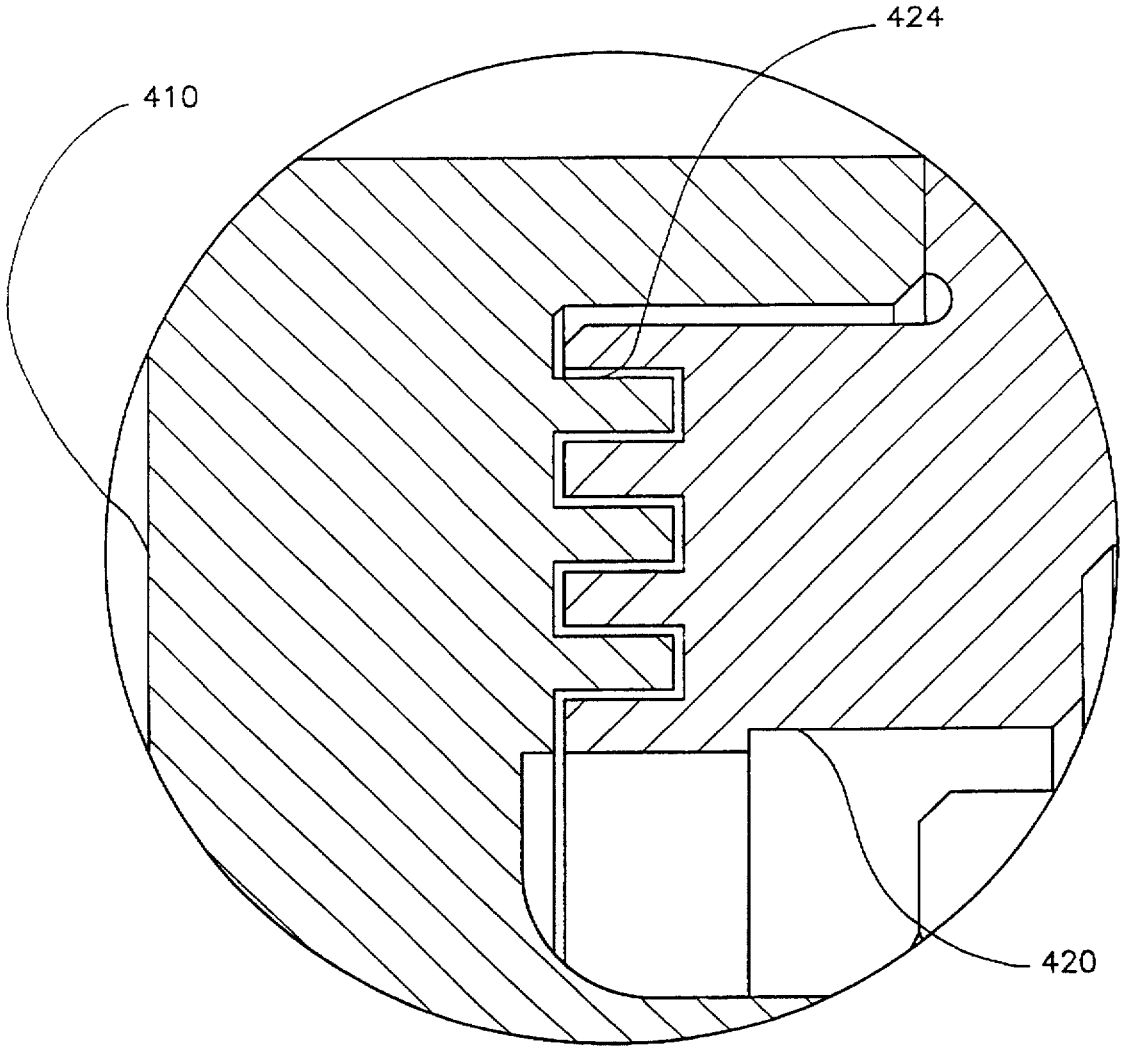
FIG. 39 is a cross-sectional detail view of the labyrinth seal convention between the cylinder barrel and valve plate taken along line 39—39 of FIG. 36 and drawn to an enlarged scale.

Referring to FIG. 39, a cross-sectional detail view of the labyrinth seal 424 is shown. The labyrinth seal 424 minimizes leakage between the chamber barrel 410 and valve plate 420.

Turning back to FIG. 36, high pressure fluid urges the chamber barrel 410 away from the valve plate 420. To counteract this force, a support ring 426, threadingly engaged with the chamber barrel 410, is resisted by a thrust bearing 428.

The pump 400 includes connecting rods 430, each having a first end, which terminates in a ball 432 that is slidingly received by a piston 414, and a second end, similarly terminating in a ball 432. A swash plate 434 has sockets for slidingly receiving each ball 432. As the swash plate 434 and chamber barrel 410 rotate, each piston 414 is urged through its respective chamber 412. Throughout the stroke of each piston 414, the angle between the connecting rod 430 and the swash plate 434 oscillates. Each ball 432 permits relatively frictionless rotation of the connecting rod 430 relative to the swash plate 434.

A constant velocity joint 436 is shown integral with the chamber barrel 410 and keyed. to a shaft 438 with splines 440. A second constant velocity joint 442 is shown integral with the swash plate 434 and slidably keyed to the shaft 438 with splines 443. Use of constant velocity joints 436 and 442 provides for synchronous rotation of shafts 406 and 438. This arrangement permits the swash plate 434 to rotate at a synchronized velocity with respect to the chamber barrel 410 irrespective of the deflection 444 maintained therebetween. The prior art utilizes universal joints which are not as facile. As the deflection 444 increases, universal joints suffer periodic hesitations throughout each rotation. This hesitation produces uneven power transmission and creates vibration.

The swash plate 434 rotates within a carriage 446, supported radially by needle bearings 448 and axially by thrust bearings 450. The displacement of the pump is varied by rotating the carriage 446 about pins 452 having a pivot axis P. A first plane, defined by a first face 413 of chamber barrel 410, and a third plane, define by a third face 435 of swash plate 434, intersect generally at the pivot axis P. The pivot axis P intersects with the central axis of a ball joint associated with an outermost chamber 412. This arrangement minimizes the gap between the pistons 414 and the valve plate 420 when a piston 414 is at the maximum compressed position and the displacement of the pump is zero, occurring when the deflection 444 is zero. A gap allows fluid from the high pressure port 416 or 418 to compress residual fluid in the gap. When the chamber barrel 410 rotates such that the pressurized chamber 412 is in fluid communication with the low pressure port 416 or 418, the pressurized fluid would be released therein. This fluid leakage from the high pressure port 416 or 418 to the low pressure port 416 or 418 would eventually deplete the contents of the reservoir 122. Elimination of the gap eliminates the leakage and preserves fluid pressure within the reservoir 122.

For simplicity, the inlet port 416 is configured to be the low pressure port and the outlet port 418 is configured to be the high pressure port, placing the pump 400 in the mode of compression.

Referring again to FIG. 38, intake air from a manifold 454 flows to the inlet port 416 via a plurality of radial passages 456. Compressed fluid flows from the outlet port 418 to the manifold 458 via a plurality of radial passages 460. The unique arrangement of radial passages emanating from the valve plate ports to common manifolds promotes resistance free flow and permits the pump to breath well, maximizing efficiency.

Figure 40:
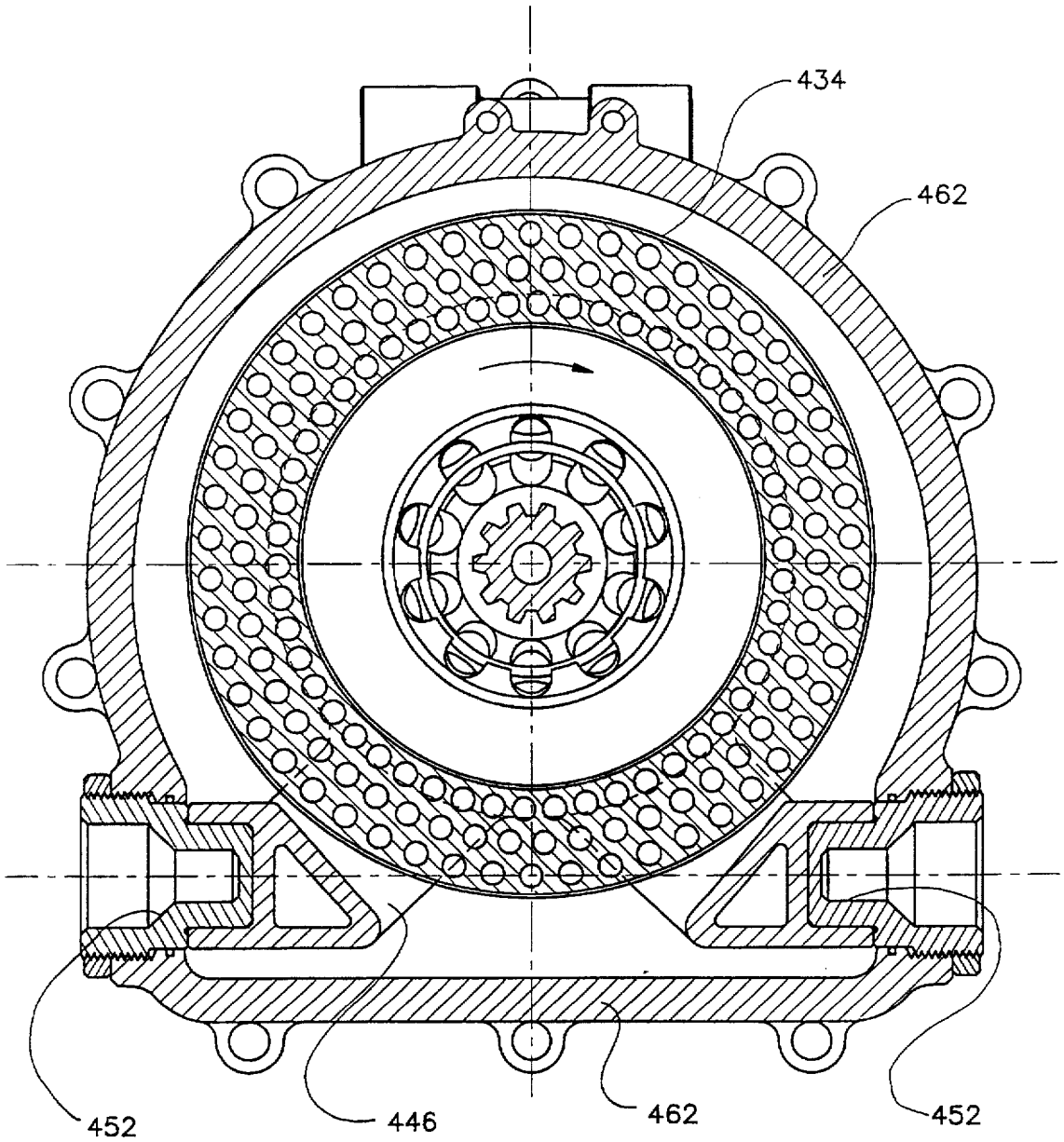
FIG. 40 is a cross-sectional detail view of the swash plate taken along line 40—40 in FIG. 36.

Referring also to FIG. 40, a cross section of the swash plate 434 is shown. The pins 452 are threadingly received in a housing 462 and rotatably received in the carriage 446. The carriage 446 and swash plate 434 pivot about the pins 452 during adjustment of the displacement of the pump 400.

Referring again to FIGS. 36 and 37, the invention includes a novel means for mitigating shaft torque spikes and vibration during compression and expansion. During compression, the inlet port 416 is the low pressure port, and the outlet port 418 is the high pressure port. High pressure fluid acts against the pistons 414 exposed to the outlet port 418. The net force acting on these pistons is applied to the carriage 446 through the swash plate 434, creating a moment about the pins 452. As shown in FIG. 37, 73 pistons 414 are exposed to the outlet port 418. The pistons 414 farther from the axis of the pins 452 generate more moment thereabout. As the chamber barrel 410 rotates clockwise, the piston 464 enters the outlet port 418 while the piston 466 rotates out of the port. The cumulative effect is a slight increase in the net moment about the axis of the pins 452. As chamber barrel 410 continues to rotate, the net moment decreases slightly until the next piston becomes exposed to the outlet port 418. The effect of the pistons 414 rotating in and out of the outlet port 418 is an oscillating moment about the axis of the pins 452. When the displacement of the pump is constant, the carriage 446 is hydraulically locked and less subject to vibration. When carriage 446 is in transition, however, it is not hydraulically locked. In this case, vibration due to oscillating forces is mitigated by the inertia of the carriage 446, friction, and the dashpot like action of the hydraulic fluid in the circuit. Vibration is also mitigated by minimizing the diameter and increasing the number of pistons 414. Minimizing the diameter of each piston 414 decreases the magnitude of the oscillating force for a given pressure, and maximizing the number of pistons 414 increases the frequency of oscillations for a given rotational speed. In the preferred embodiment, there are three rows of pistons 414, all of equal diameter. Each row is staggered with respect to next such that pistons 414 enter and exit ports 416 and 418 one at a time and in even intervals.

Figure 41:
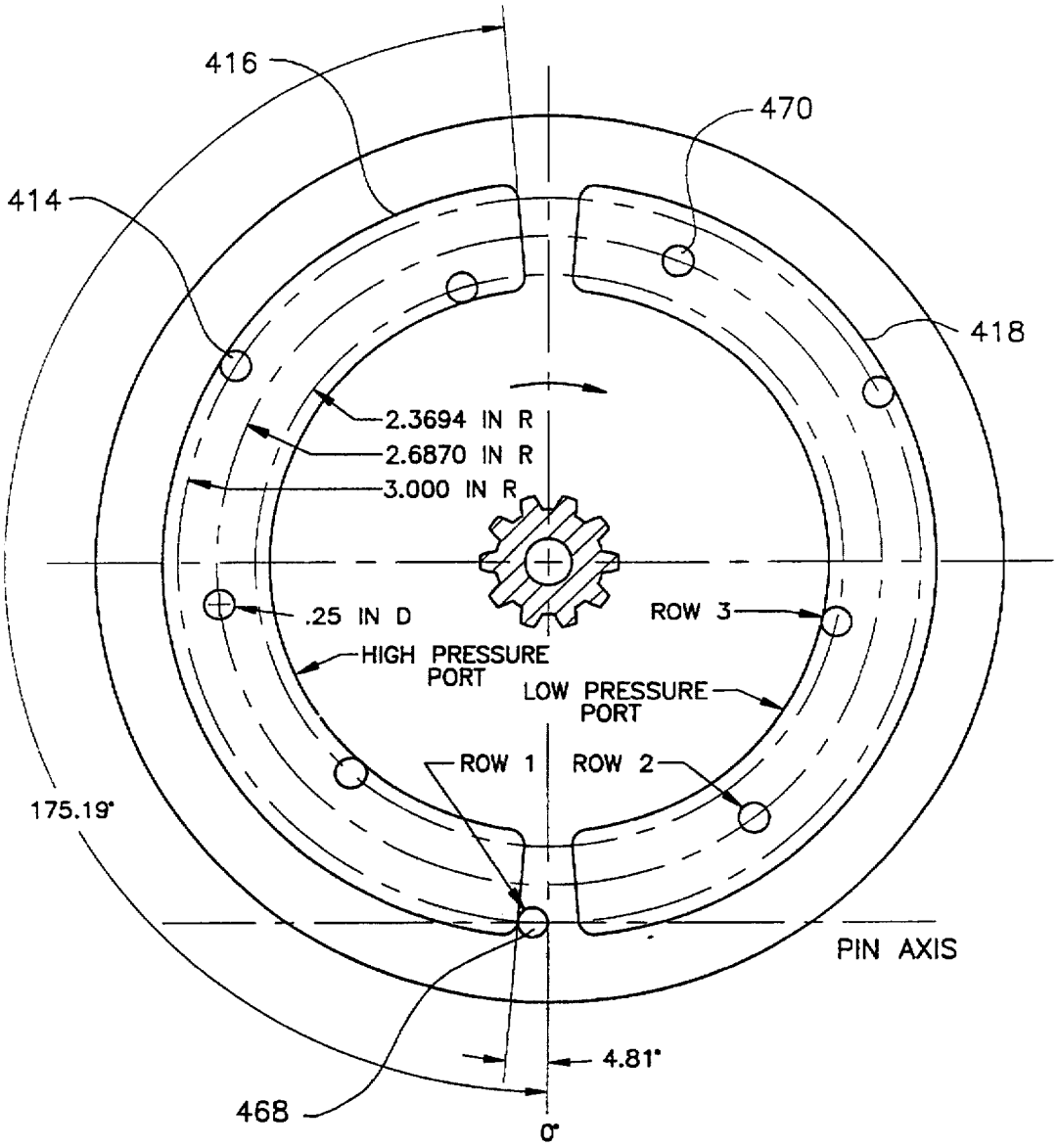
FIG. 41 is a diagrammatic representation of a simple axial piston pump.

Referring to FIG. 41, a simplified diagrammatic view of an axial piston pump is shown for analytical purposes only. The pump 400 uses three rows of three, 0.25-inch diameter pistons 414. The first row has a three-inch radius. The second row has a 2.6870-inch radius. The third row has a 2.3694-inch radius. As shown, the pump 400 is configured to expand fluid with torque imparted in the direction of rotation. During expansion, the inlet port 416 is the high pressure port, and the outlet port 418 is the low pressure port. Since the pump is symmetrical with respect to the vertical cutting plane, unlike the eccentric ring pump, discussed supra, the displacement, side force and torque curves of the motor are mirror images of those when the pump 400 compresses fluid.

Opposing chambers 468 and 470 enjoy fluid communication with the ports 416 or 418, respectively, where the chamber barrel rotates clockwise approximately 4.81° beyond the upper or lower vertical axes, respectively. Fluid communication with the chamber 468 ceases after the chamber barrel rotates approximately 175.19° past the vertical axis. As shown, the first piston chamber 468 of the first row is entering the inlet port 416. The shaft torque produced by this piston peaks after it rotates approximately 90°. The resultant swash plate moment produced by this piston peaks when it rotates to the uppermost position of the inlet port 416.

Figure 42:
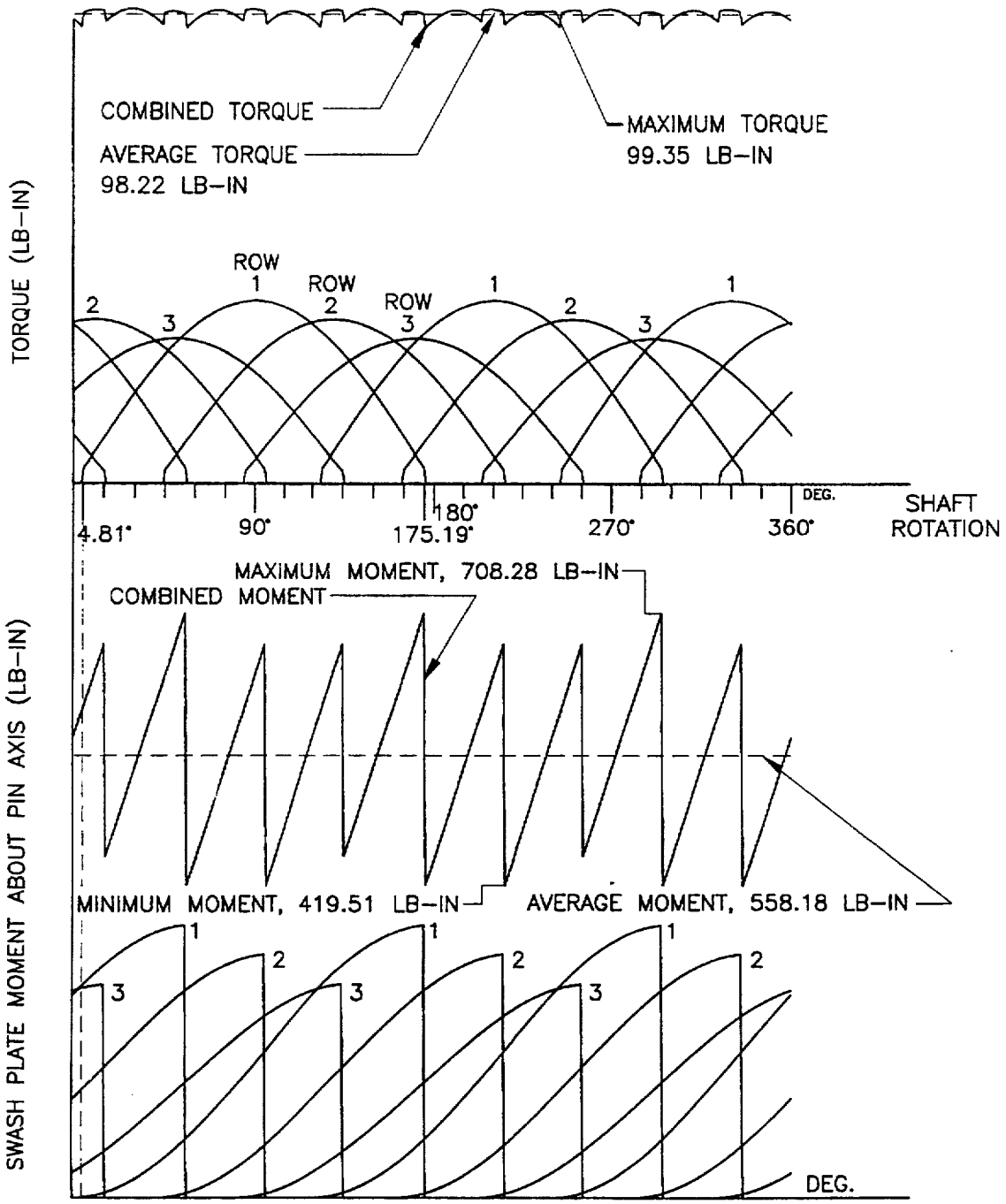
FIG. 42 is a graphical representation of axial piston pump performance showing shaft torque and swash plate moment versus rotation.

Referring to FIG. 42, a graphical performance analysis of the pump with the swash plate deflection 444 set at 15° and a pressure difference of 1000 PST is shown. The torque of any single piston 414 peaks midway through the high pressure port. The resultant swash plate moment peaks when a piston 414 rotates to the top portion of the inlet port 416. The moment drops off to zero abruptly upon entering the outlet port 418. The pistons 414 in the first row provide the greatest driving force, since the outermost row enjoys the greatest moment arm. Although the net swash plate moment oscillates, it always acts in one direction.

Figure 43:
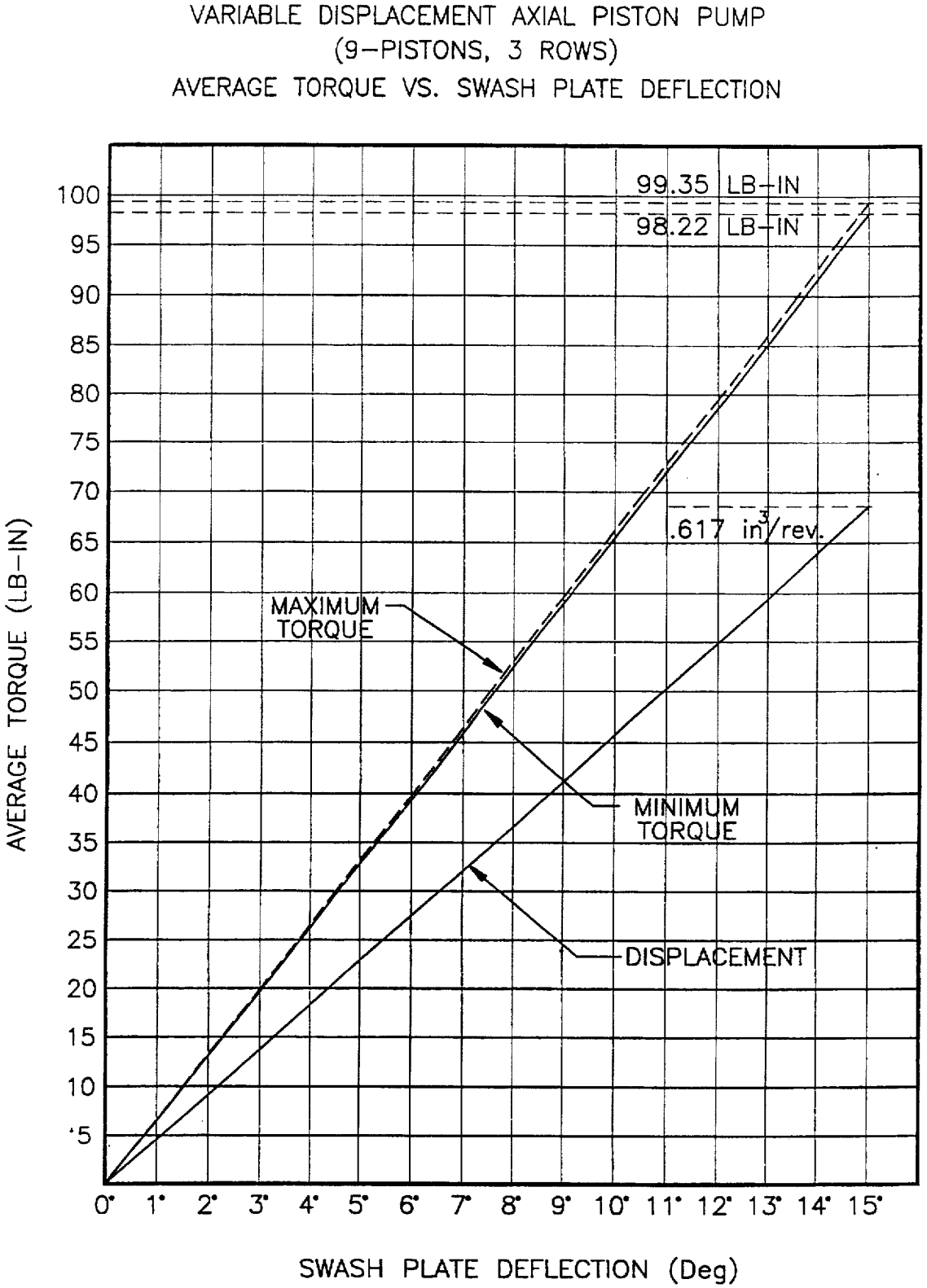
FIG. 43 is a graphical representation of axial piston pump performance showing shaft torque versus swash plate deflection.

Referring to FIG. 43, the linear relationship between swash plate deflection 444 and shaft torque is shown graphically. When the pump is configured to compress rather than expand fluid, the magnitude of the torque is the same, however the direction is reversed.

Figure 44:
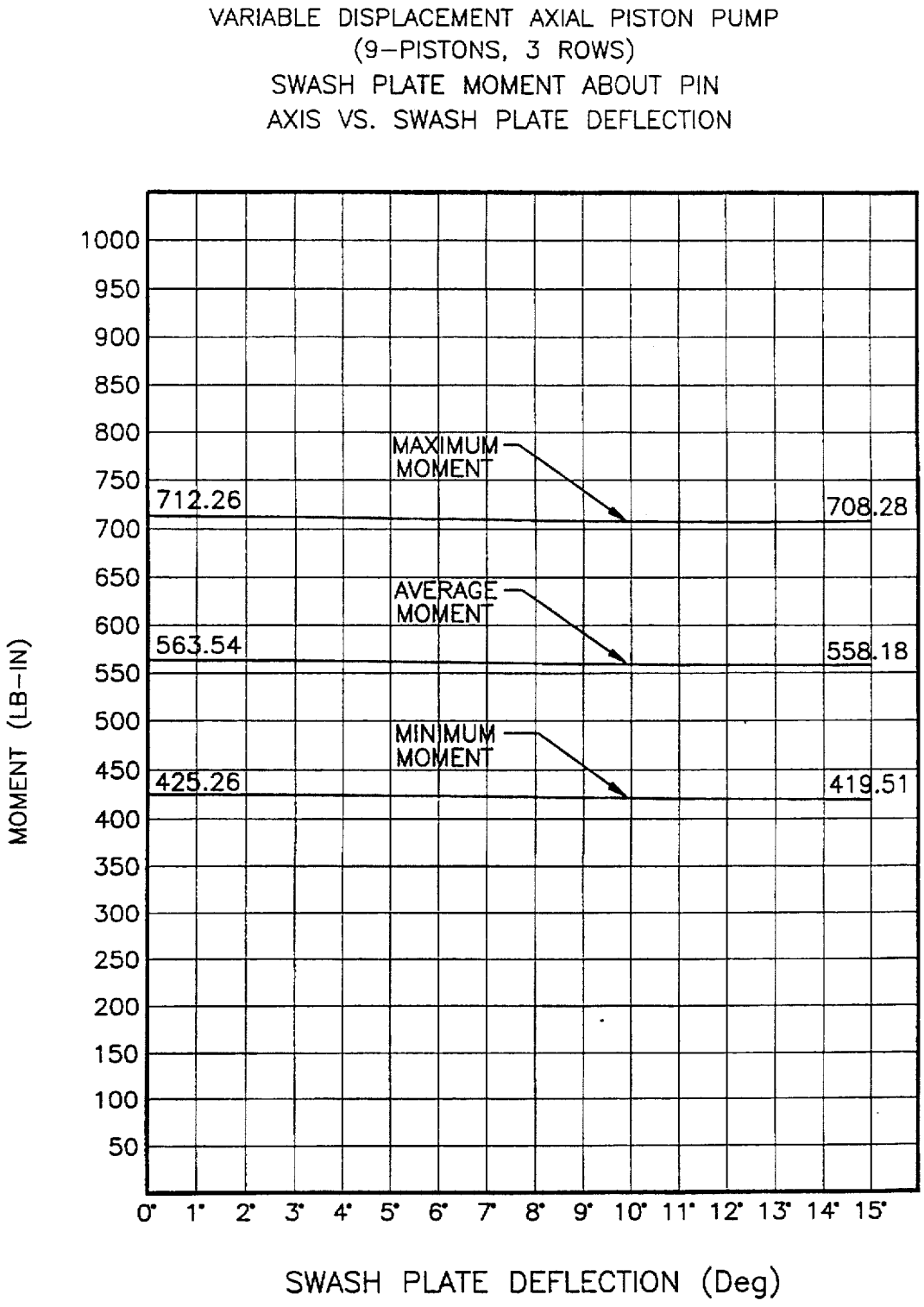
FIG. 44 is a graphical representation of axial piston pump performance showing swash plate moment versus swash plate deflection.

Referring to FIG. 44, the swash plate moment generated with respect to its deflection 444 is shown. Swash plate deflection 444 negligibly impacts the moment generated. This moment is identical whether the pump expands or compresses fluid.

Figure 45:
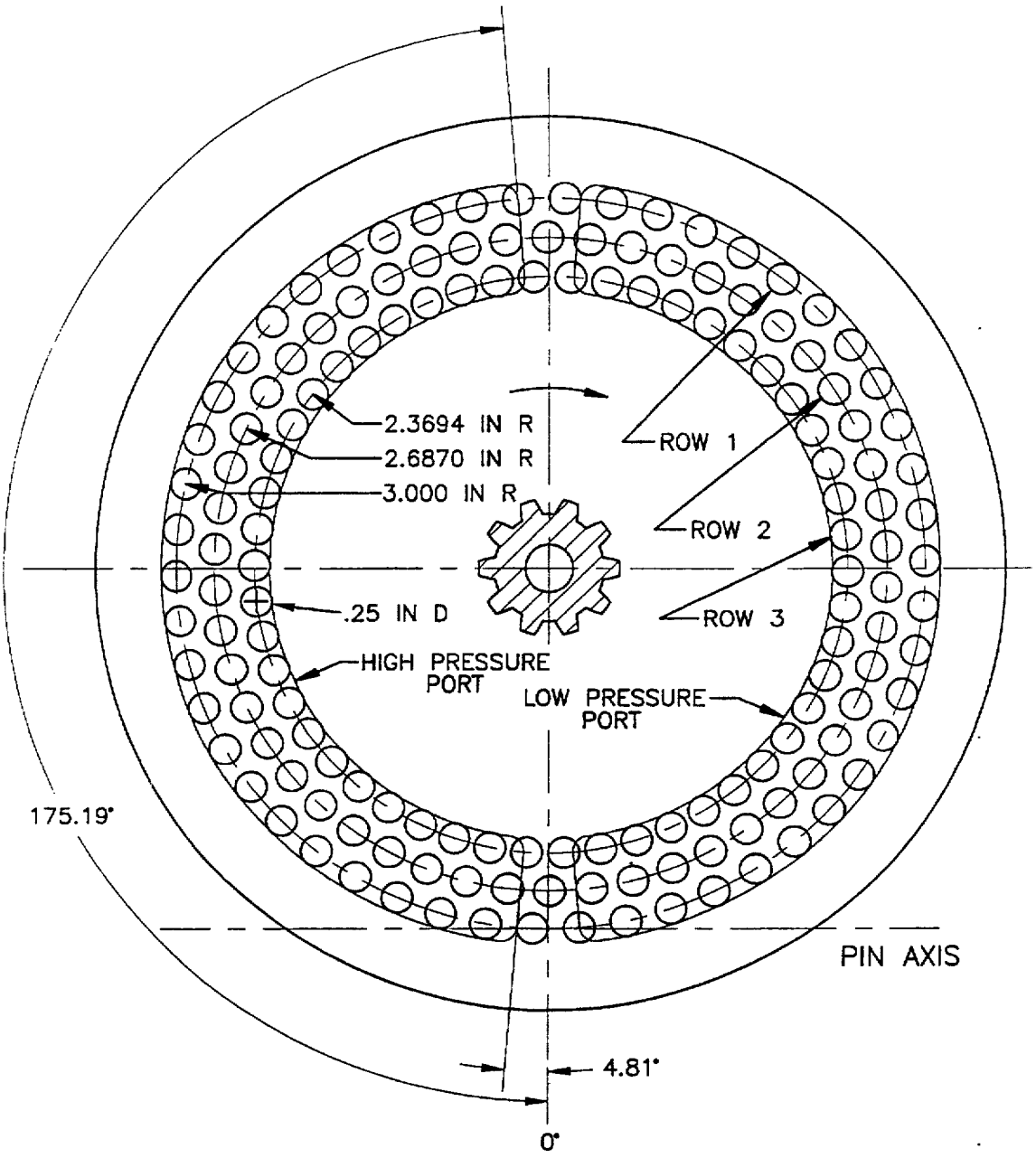
FIG. 45 is a diagrammatic representation of an axial piston pump more closely resembling the present axial piston pump.

Referring to FIG. 45, a model more closely resembling the present invention is shown, dimensioned similar to the above example, however, configured to receive fifty pistons per row. The rows are staggered so that pistons pass in and out of ports at even intervals. The overlapping, concentrically arranged rows of pistons minimize the magnitude of the oscillating force against the swash plate.

Figure 46:
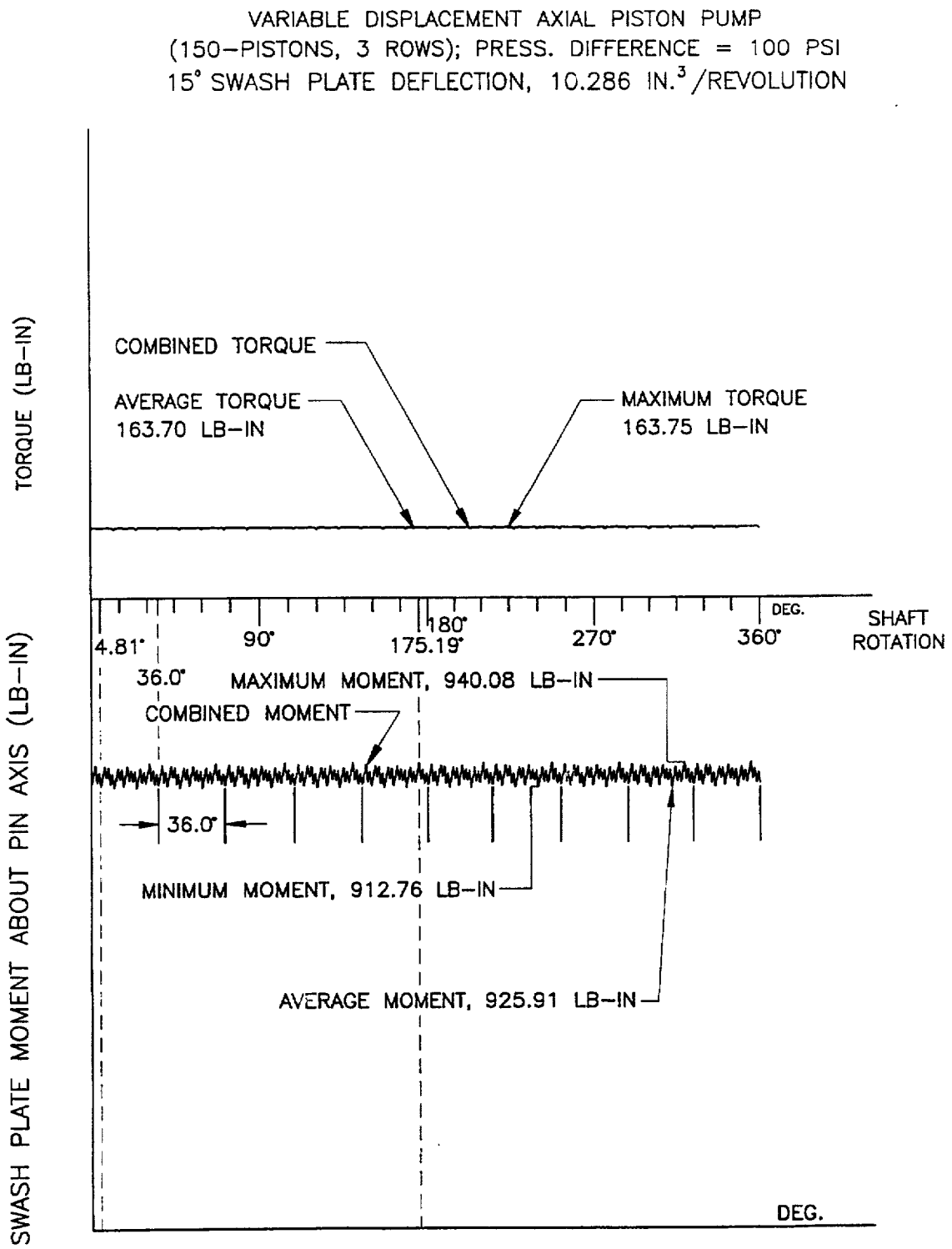
FIG. 46 is a graphical representation of axial piston pump performance showing shaft torque and swash plate moment versus rotation.

Referring to FIG. 46, a graphical performance analysis of the model in FIG. 45 is shown, with the swash plate deflection 444 set at 15° and a pressure difference set to 100 psi. The combined torque curve is nearly flat compared to the simpler version presented above. The combined moment curve is significantly reduced in amplitude. A pattern in the moment curve repeats at 36° intervals.

Figure 47:
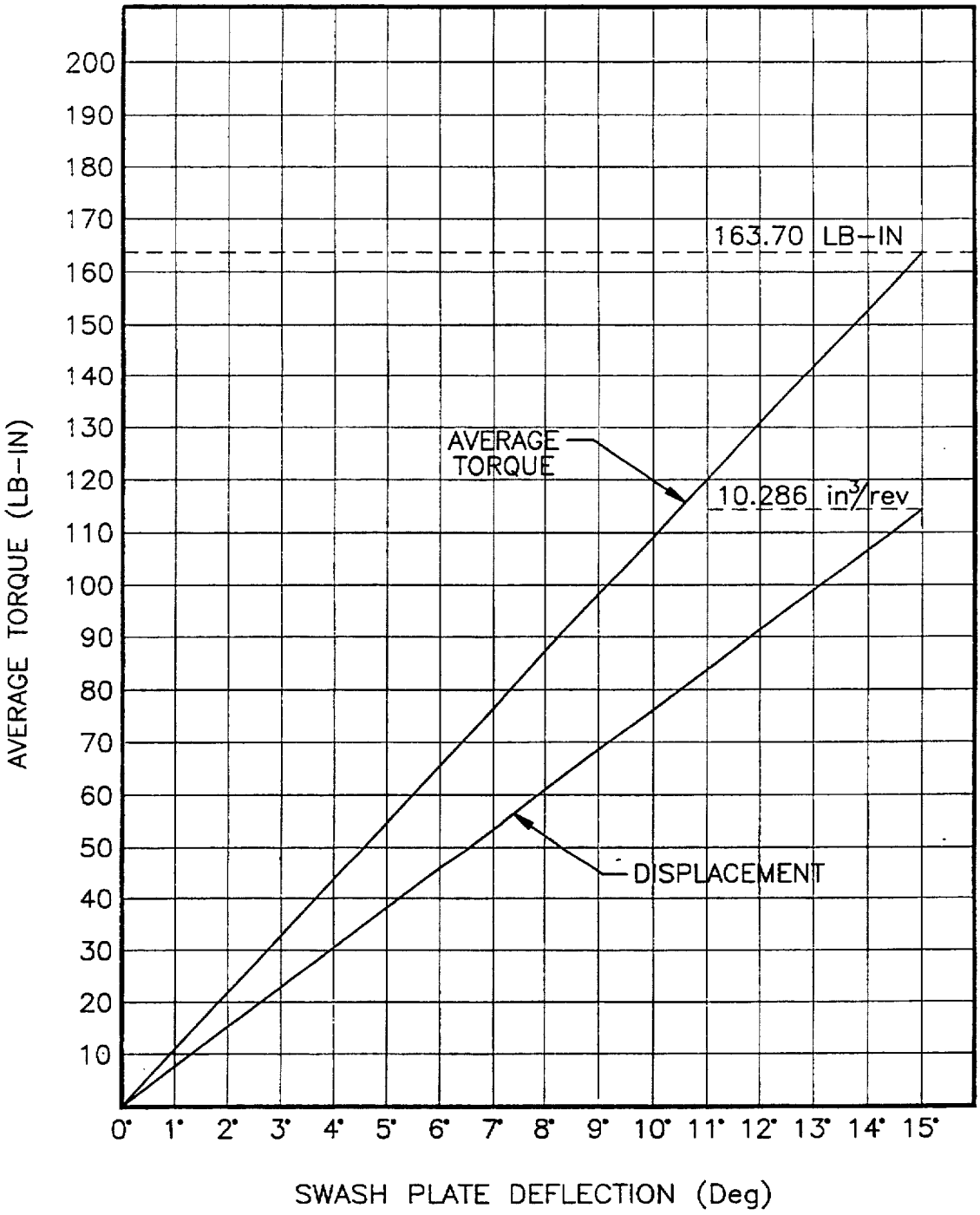
FIG. 47 is a graphical representation of axial piston pump performance showing shaft torque versus swash plate deflection.

Referring to FIG. 47, the linear relationship between swash plate deflection 444 and shaft torque is shown graphically. At a deflection 444 of 15°, the pump displaces 10.286 cubic inches per revolution and produces an average torque of 163.70 inch-pounds.

Figure 48:
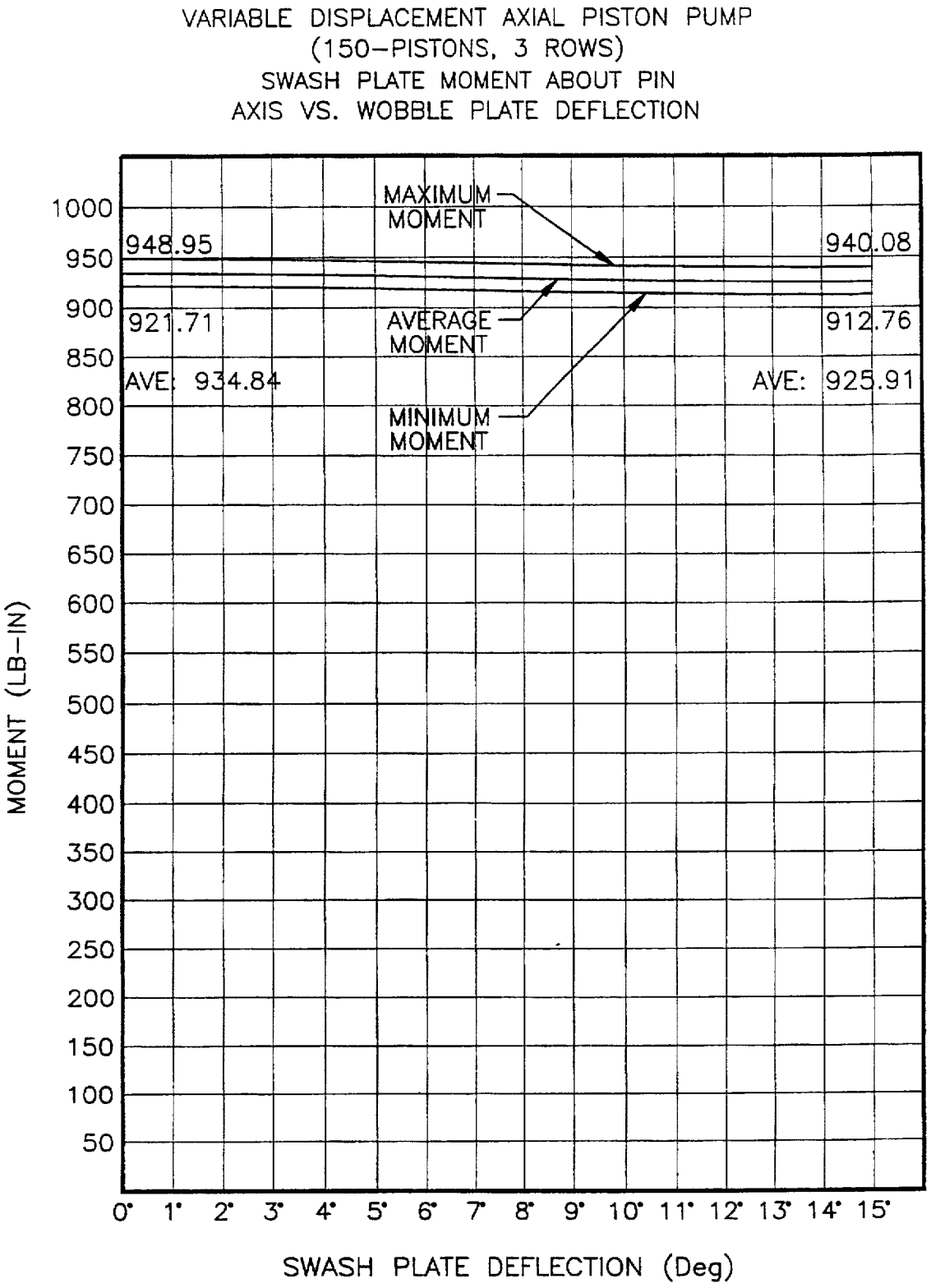
FIG. 48 is a graphical representation of axial piston pump performance showing swash plate moment versus swash plate deflection.

Referring to FIG. 48, swash plate moment is shown to slightly decrease as swash plate deflection 444 increases. The change is negligible.

Figure 49:
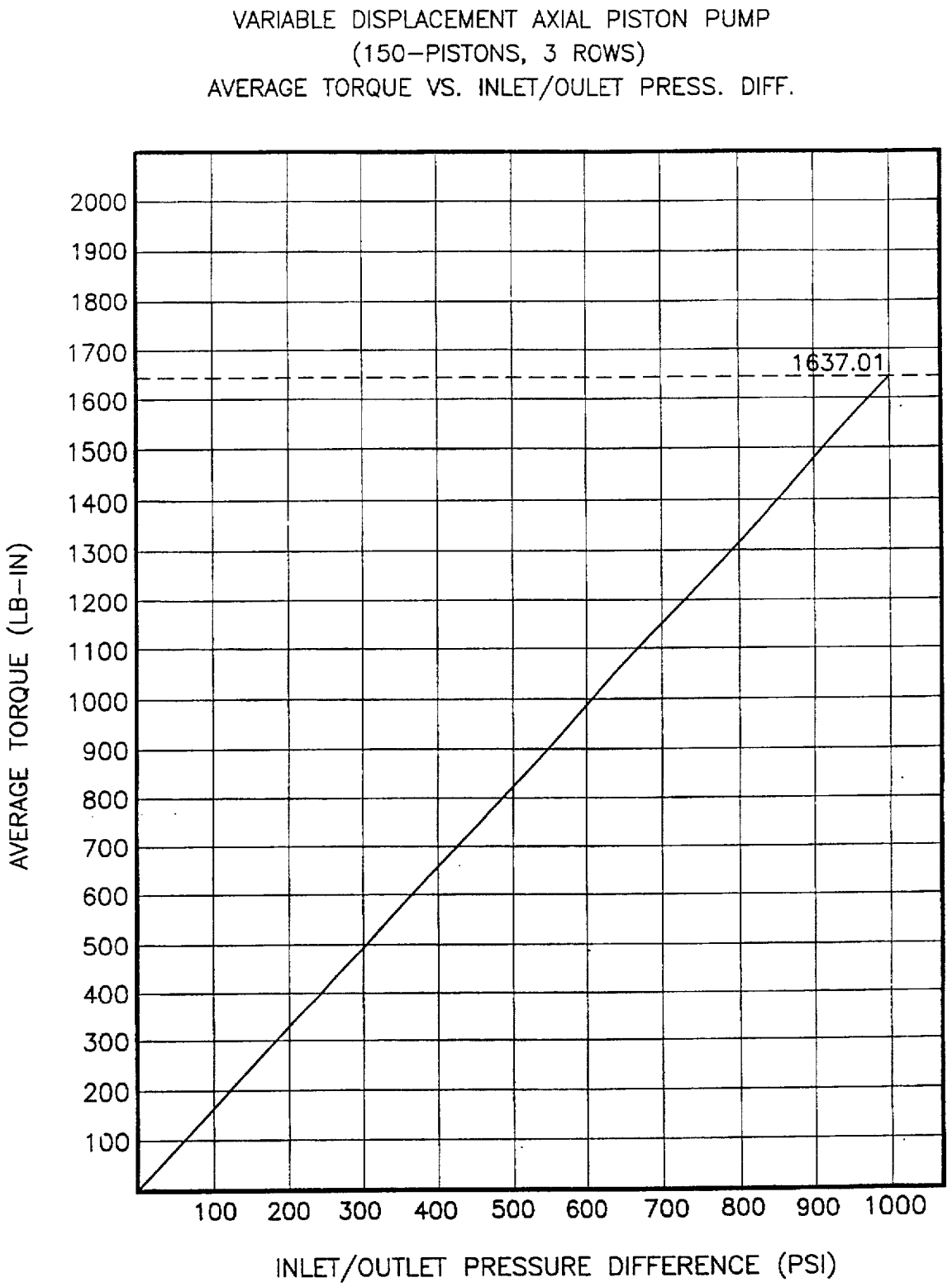
FIG. 49 is a graphical representation of axial piston pump performance showing shaft torque versus inlet-outlet pressure difference.

Referring to FIG. 49, the linear relationship between pressure difference and shaft torque is shown. At a 15° swash plate deflection 444 and a 1000 PSI difference across the inlet and outlet ports, the pump delivers 1637.01 inch-pounds, or 136.42 foot-pounds of torque.

Figure 50:
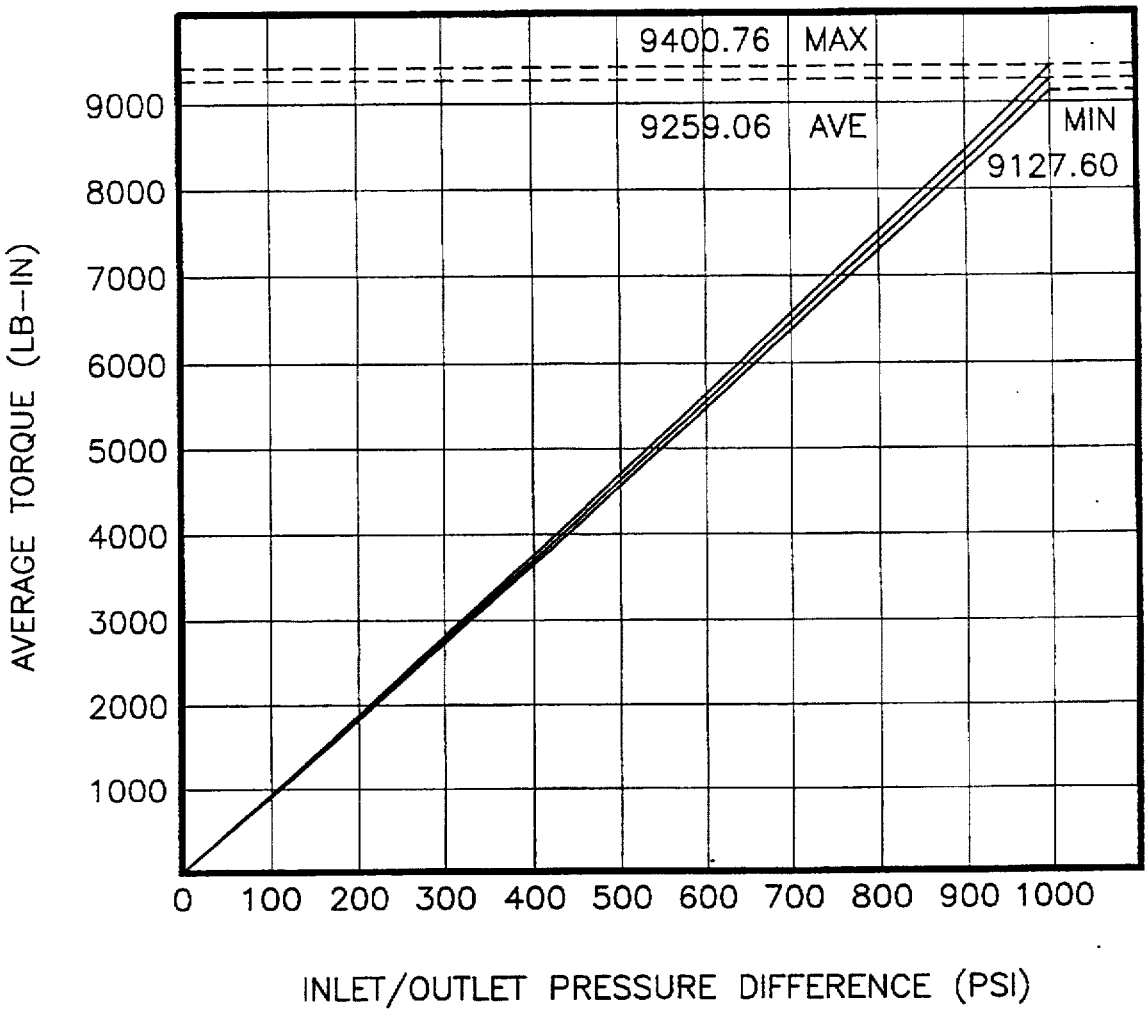
FIG. 50 is a graphical representation of axial piston pump performance showing swash plate moment versus inlet-outlet difference.

Referring to FIG. 50, swash plate moment versus inlet and outlet pressure difference is shown. Although the oscillating force magnitude increases linearly with pressure, the force does not inhibit operation, since the oscillation frequency is high, at 150 cycles per rotation. Also, in practice, individual chamber pressures do not spike, thus damping the swash plate moment significantly. The undamped model presented herein demonstrates a worst case scenario.

The potential braking and driving ability of a relatively small axial piston pump is significant. The pump 400, as modeled in FIG. 45, produces 1637.01 inch-pounds of torque at a 15° swash plate deflection 444. At a shaft speed of 3000 RPM, the pump requires 77.92 horsepower to pump against a constant head of 1000 PSI. In practice, head pressure increases as more fluid is pumped into the reservoir 122. Also, swash plate deflection 444 decreases steadily with increased head pressure in order to produce a constant braking torque. The pump 400 delivers, at a 15° swash plate deflection 444 and a 3000 RPM shaft speed, 17.86 cubic feet per minute. A relatively small axial piston pump compressing fluid into a small reservoir 122 effectively brakes or drives a mid-sized automobile.

2. Axial Piston Pump Control Means.

The invention includes two distinct control means, one for configuring the pump to compress or expand fluid, the other to adjust the displacement of the pump.

Referring to FIGS. 36, 38, 51 and 52, the configuration means includes a four-way valve 472. The four-way valve 472 may be actuated only when the pump is at zero displacement. To establish pump configuration, the pistons 474 and 476 rotate the carriage 446 until the deflection 444 is zero, thus maintaining the pump 400 at zero displacement. The valve 472 may assume three positions; the position of the four-way valve 472 determines whether the pump compresses or expands fluid. In the first position, the pump 400 is configured to compress fluid. The valve 472 provides for conducting fluid from port 478, the intake port, to port 480. Port 480 is in communication with the inlet port 416 of the valve plate 420. A filter (not shown) may be provided above port 478. In the first position, the valve 472 also provides for passage of fluid from port 482, which is in communication with the outlet port 418 of valve plate 420, to port 484 and the reservoir 122. In the second position, the pump 400 is configured to expand fluid. The valve 472 provides for conducting fluid from port 484 to port 480 and from port 482 to port 486, the exhaust port. In the third position, the valve 472 provides for blocking ports 480 and 482, allowing the pump 400 to rotate freely without compressing or expanding fluid. Regardless of the configuration of the valve 472, the chamber barrel 410 rotates clockwise.

The solenoids 488 and 490 control the positioning of a spool 492. The valve 472 is urged into the first position by energizing solenoid 490. Solenoid 490 draws the spool 492 against a spring 494. The valve 472 is urged into the second position by energizing solenoid 488. Solenoid 488 draws the spool 492 against a spring 496. The valve 472 is urged into the third position by de-energizing the solenoids 488 and 490, thus permitting springs 494 and 496 to center the spool 492.

Figure 53:
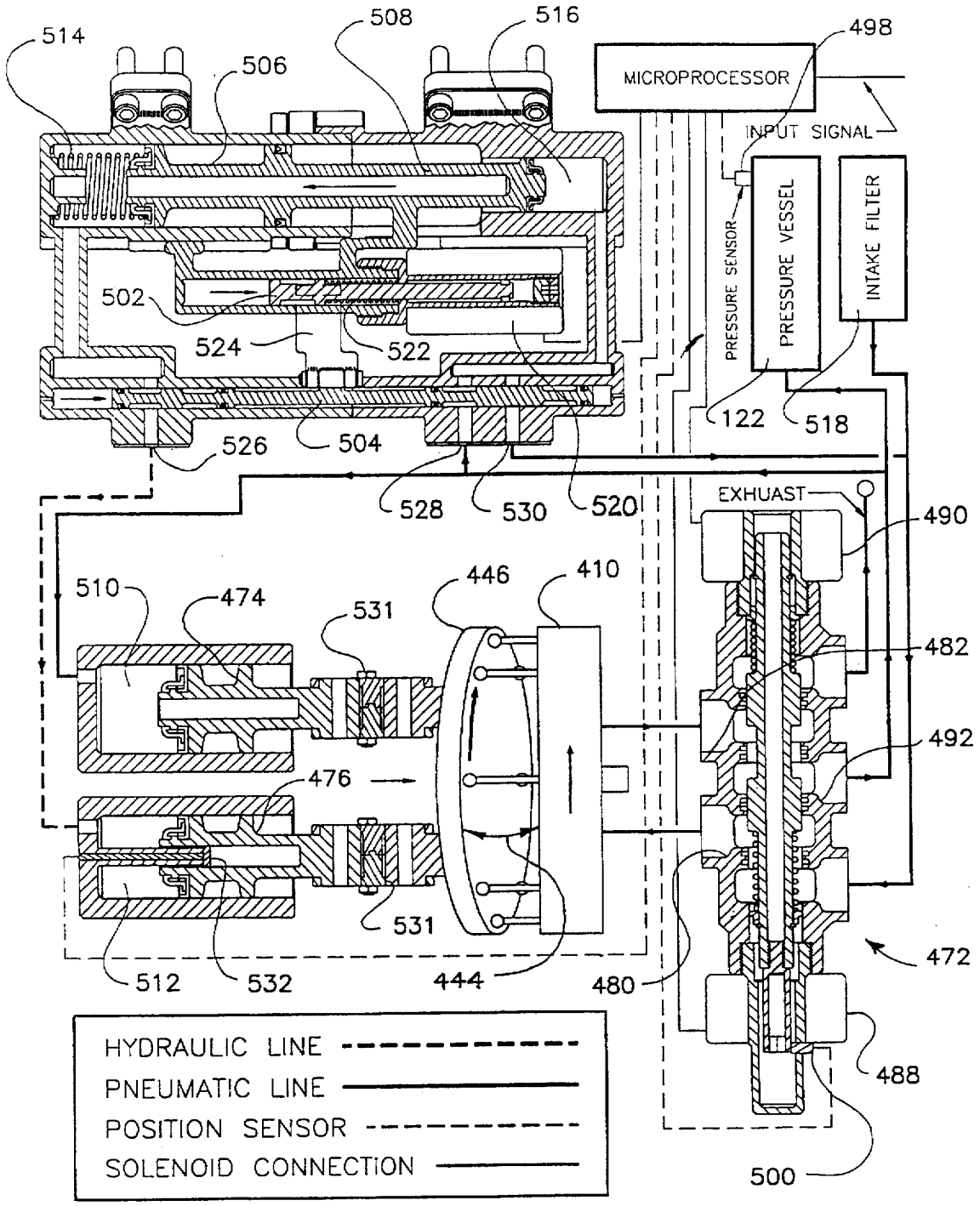
FIG. 53 is a primarily diagrammatic representation of the control mechanism for the axial piston pump.
Figure 54:
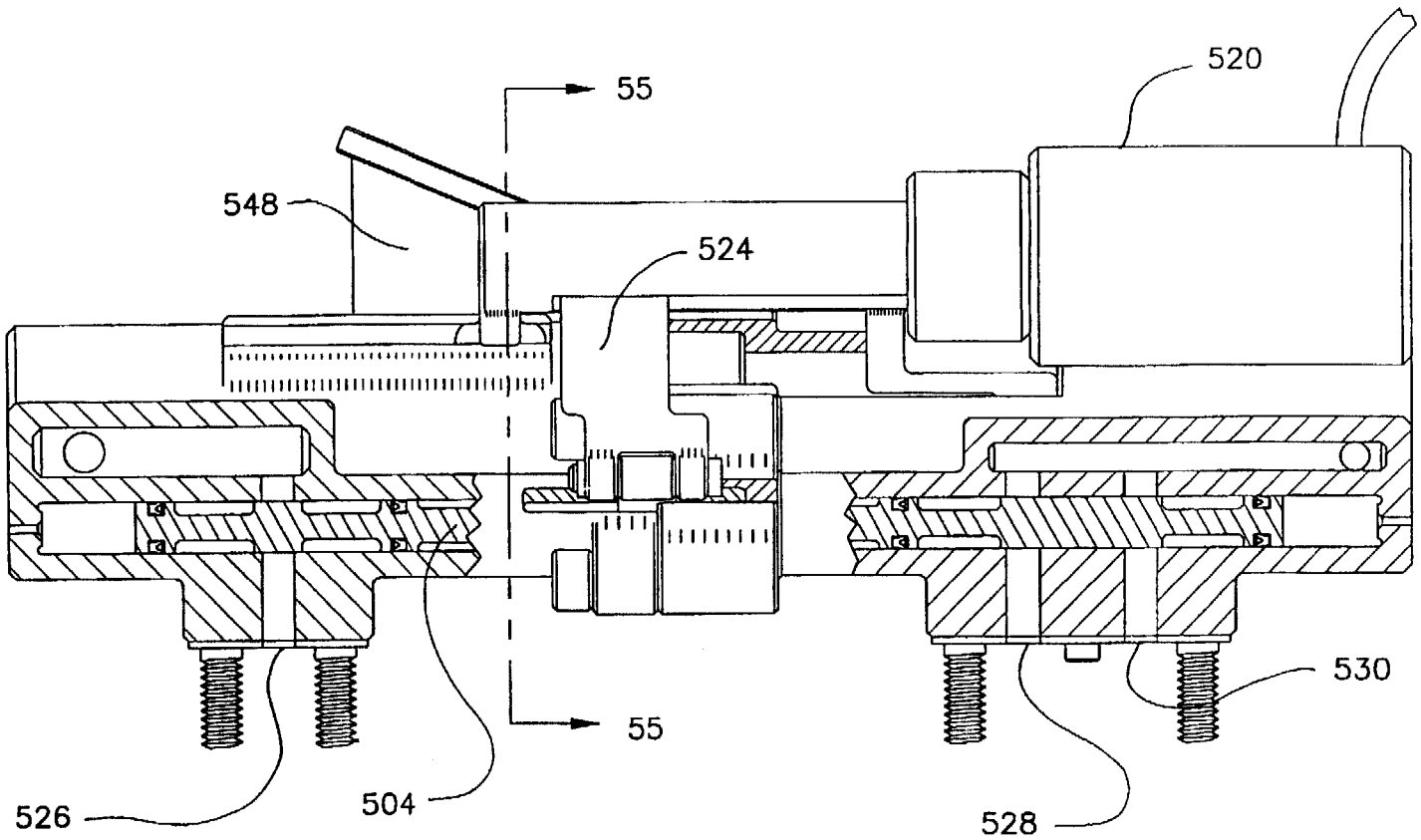
FIG. 54 is a partial, cross-sectional detail view of the axial piston pump displacement mechanism taken along line 54—54 of FIG. 55.
Figure 55:
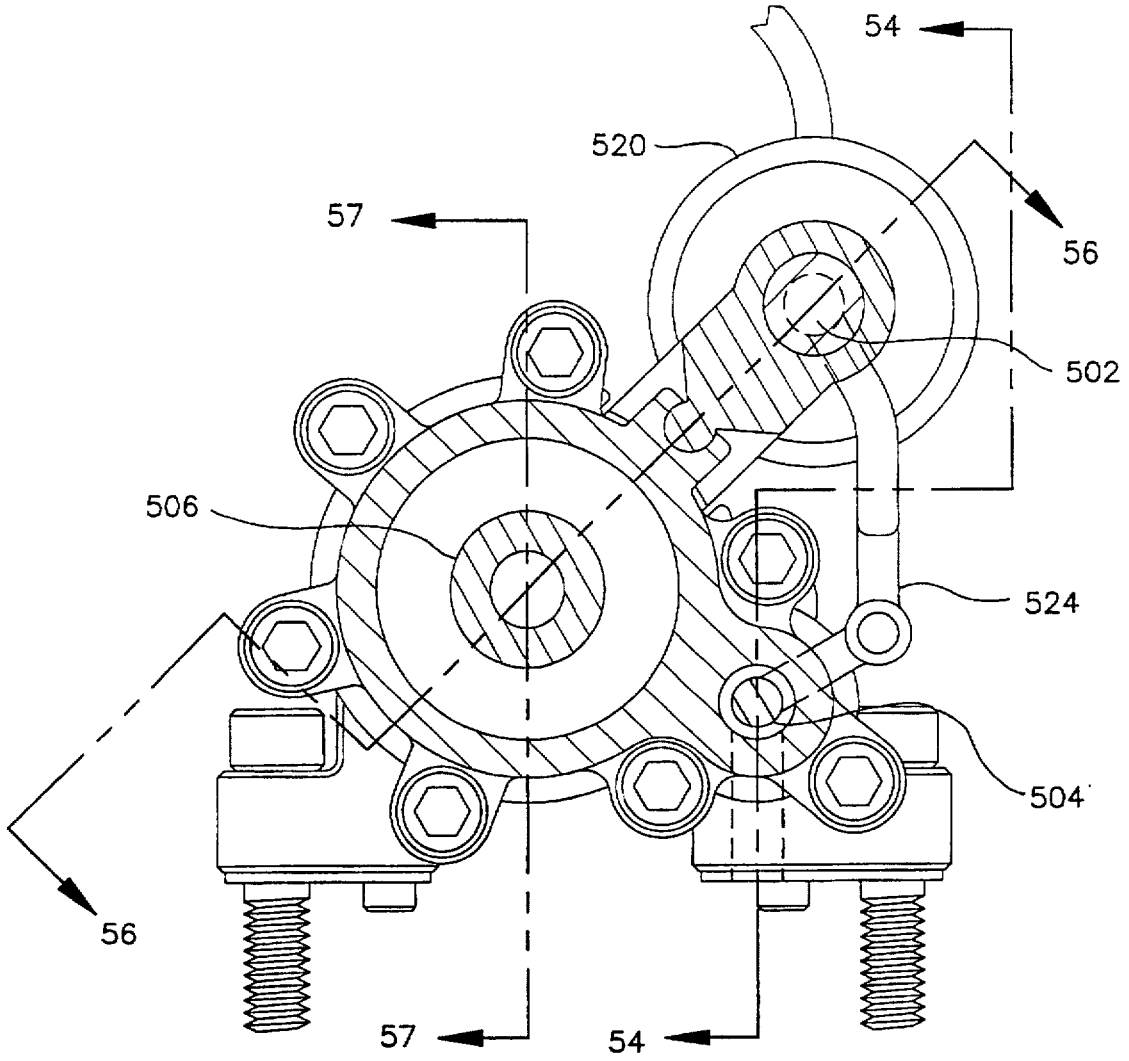
FIG. 55 is a cross-sectional detail view of the displacement mechanism taken along line 55—55 of FIG. 54.
Figure 56:
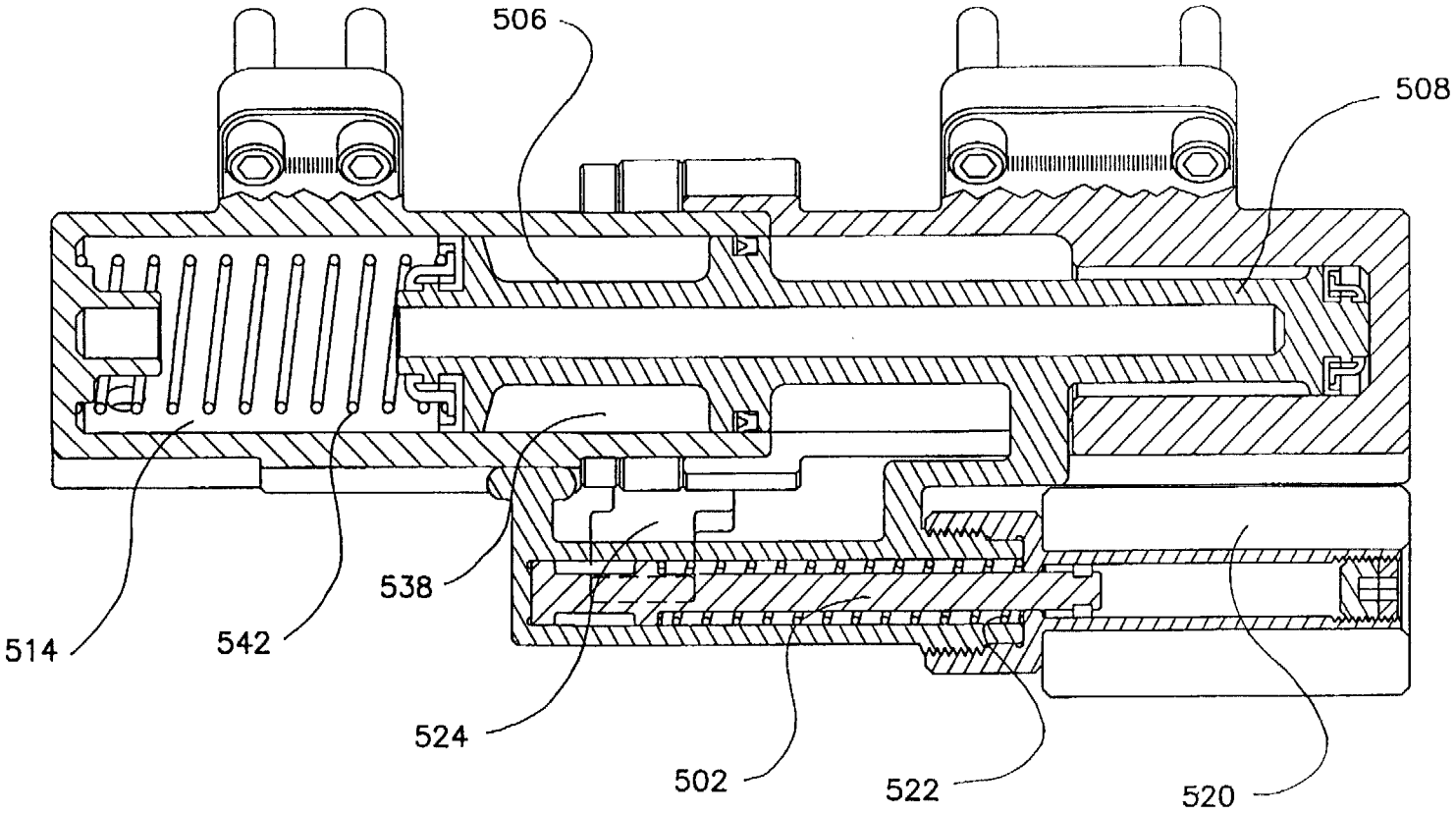
FIG. 56 is a cross-sectional detail view of the displacement mechanism taken along line 56—56 of FIG. 55.

Referring to FIG. 53, the displacement control means is diagrammatically shown. The diagram is presented as a teaching aid only. The true structure of the control mechanism is disclosed in FIGS. 54–59. Although an electromechanical means is presented and preferred, the pump may be controlled with mechanical means, similar to that described for controlling the eccentric ring pump, discussed supra.

A microprocessor receives an input signal from the user and determines whether the pump should compress or expand fluid. A pressure sensor 498 monitors the pressure in the reservoir 122 and delivers a pressure value to the microprocessor. The microprocessor shuts down the system in the event the reservoir 122 exceeds its pressure capacity.

The position of the valve 472 is monitored by a sensor 500. The sensor 500 provides a feedback signal to a microprocessor for controlling the current delivered to the solenoids 488 and 490, thus the position of the valve 472.

For clarity, the following table provides a quick reference to components discussed below and their representations on the drawings:

AXIAL PISTON PUMP CONTROL MEANS PARTS TABLE

| PART | NO. |
|---|---|
| first spool | 502 |
| second spool | 504 |
| first piston | 414 |
| second piston | 474 |
| third piston | 476 |
| fourth piston | 506 |
| fifth piston | 508 |
| first chamber | 412 |
| second chamber | 510 |
| third chamber | 512 |
| fourth chamber | 514 |
| fifth chamber | 516 |

The pump 400, as shown in FIG. 53, is configured to draw fluid through a filter 518 and compress the fluid into the reservoir 122. A microprocessor, responsive to a demand, energizes a solenoid 520 to decrease the deflection 444 between the carriage 446 and the chamber barrel 410 and thus pump displacement.

The solenoid 520 draws a first spool 502 toward it against biasing spring 522. The displacement of the first spool 502 is proportional to the current through the solenoid, which is controlled by the microprocessor. The first spool 502 is affixed to a second spool 504 with a signal bar 524. When the first spool 502 translates to the right, the second spool 504 uncovers the ports 526 and 528; the port 530 remains blocked. Uncovering the port 526 allows communication between the third chamber 512 and a fourth chamber 514. Uncovering port 528 allows communication between the reservoir 122 and a fifth piston chamber 516. Once uncovered, fluid pressure acts over a fifth piston 508 which, through the fourth piston 506, urges fluid into the third chamber 512. The fluid circuit between the third and fourth chambers 512 and 514 may be fitted with constrictions (not shown) which will damp any oscillations in the carriage, while the carriage is in transition. Fluid from the reservoir 122 is received in the second piston chamber 510 and urges the second piston 474 against the carriage 446 through linkage 531. As the second piston 474 is always urged against the carriage 446 by pressure from the reservoir 122, the second piston 474 always counteracts the forces exerted by the first piston 414 against the swash plate 434 with an oppositely-disposed force slightly less than equal thereto. Although the pressure acting over the face of the second piston 474 alone is not sufficient to overcome that of the swash plate 434, additional force imparted by the third piston 476 will overcome and pivot the carriage 446 toward the chamber barrel 410, altering the displacement of the pump 400. This arrangement causes the carriage 446 naturally to seek a maximum deflection 444. The control system need only vary pump displacement against an opposing force in one direction, thus simplifying the necessary control apparatus.

Affixed to the fourth piston 506 is the solenoid 520. As the fourth piston 506 translates, it urges the first spool 504 to translate, via the solenoid 520. During this translation, a constant current applied to the solenoid 520 fixes the first spool 502 relative thereto. Eventually, the second spool 504, being attached to the first interrupts fluid flow through ports 526 and 528, hydraulically locking the third piston 476 and fixing displacement of the pump 400. As a result, the second and third pistons 474 and 476 translate a distance linearly proportional to the distance the first spool 502 translated relative to the solenoid 520.

When the carriage 446 is not rotating, it is hydraulically locked, due to the port 526 being blocked. Drawing the first spool 502 toward the solenoid 520 decreases pump displacement. De-energizing the solenoid 520, permitting the spring 522 to urge the first and second spools 502 and 504 to the left, thus opening ports 526 and 530, increases displacement. When the second spool 504 is moved in either direction, it uncovers a pneumatic port 528 or 530 slightly before the hydraulic port 526. The hysteresis permits the fifth chamber 516 to be pressurized or relieved of pressure prior to the fourth piston 506 becoming hydraulically unlocked. This episode saves the device from abrupt, hammering shifts that may degrade its integrity.

The port 530 is in fluid communication with the low pressure side of the unit. Opening ports 526 and 530 allows the third piston 476 to urge fluid back into the fourth chamber 514. With no pressure imparted against the fifth piston 508, the carriage 446 overcomes the opposing force of the second piston 474 and moves the second and third pistons 474 and 476 to the left. This in turn urges the fourth piston 506 along with the solenoid 520 to the right until all three ports 526, 528 and 530 are blocked. As a result, the control pistons 474 and 476 translate a distance linearly proportional to the distance the spool 502 moved relative to the solenoid 520.

The present control mechanism relies on feedback from a sensor 532 disposed within the third piston 476. The microprocessor, responsive to the feedback, directs a solenoid to translate the second spool 504 with respect to ports 526, 528 and 530. As the second spool 504 moves away from these ports, error develops between the movement of second spool 504 and the second and third pistons 474 and 476; the second and third pistons 474 and 476 always lag behind the spool. This error may be minimized be increasing the area of the fifth piston 508 and decreasing the area of the second piston 474. Increasing the area of the fifth piston 508 allows high pressure fluid to act over a larger surface, thereby driving the third piston 476 with greater force against the carriage 446 during its transition toward the chamber barrel 410. Decreasing the area of the second piston 474 permits a greater load to be imposed on the third piston 476, causing it to drive the fourth piston 506 with greater force during its transition away from chamber barrel 410. Increasing the area of the fifth piston 508, however, would require a greater quantity of fluid to drive it for control purposes, thus decreasing overall system efficiency. Also, decreasing the area of the second piston 474 would increase the pressure in the hydraulic circuit and increase the likelihood of leakage.

Figure 57:
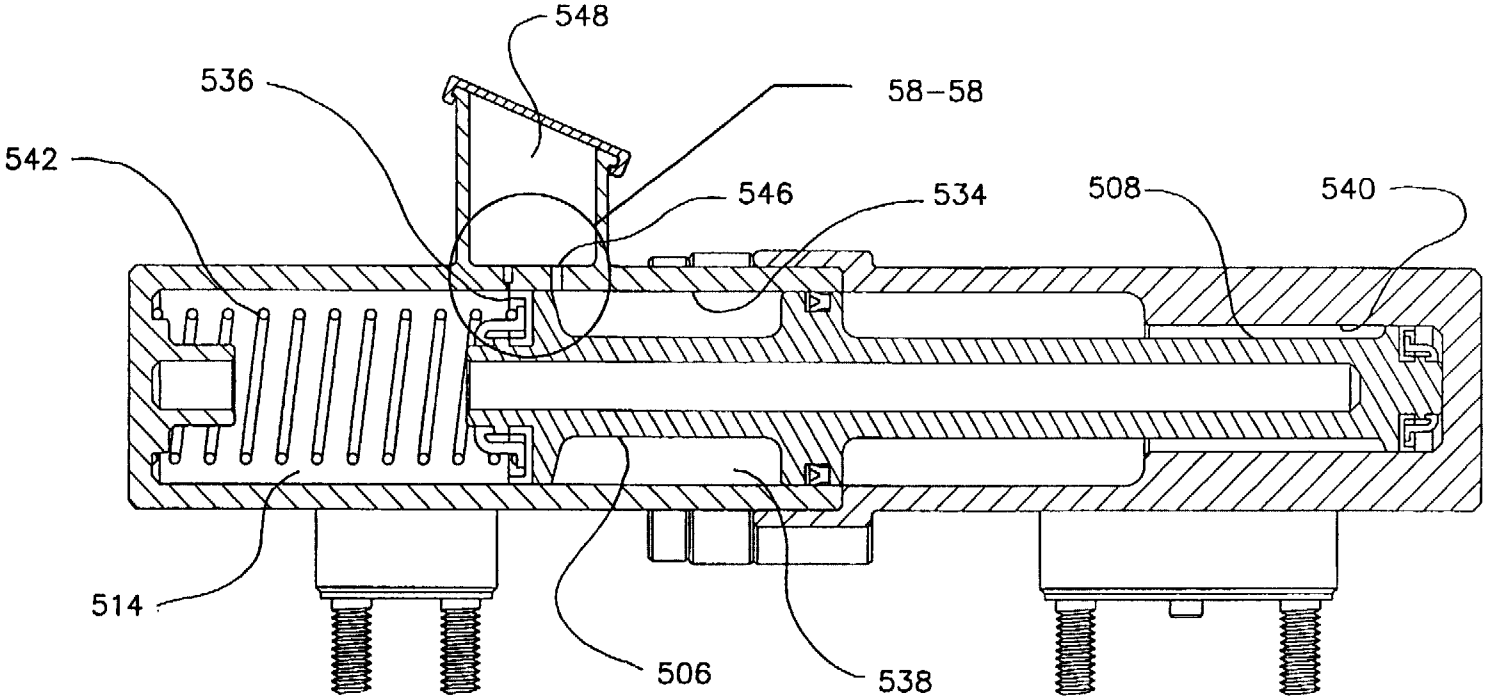
FIG. 57 is a cross-sectional detail view of the displacement mechanism taken along line 57—57 of FIG. 55.
Figure 58:
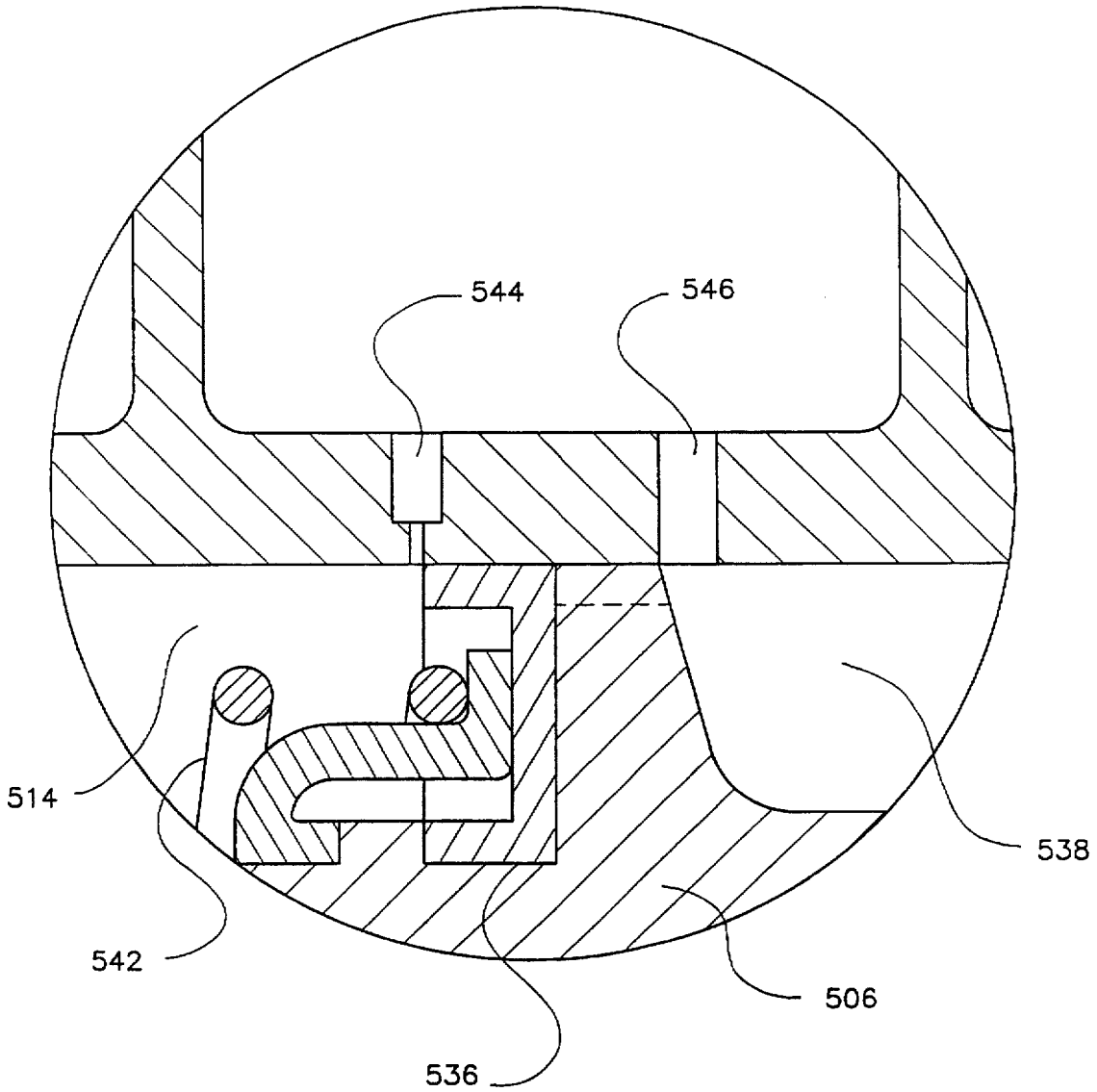
FIG. 58 is a cross-sectional detail view of the fluid replenishing mechanism taken along line 58—58 of FIG. 57 and drawn to an enlarged scale.

Referring to FIGS. 57 and 58, the cross-sectional detail view of the control mechanism shows means for reducing leakage potential in the hydraulic circuit. The fourth piston 506 slides in a cylinder 534. The fourth piston 506 includes a cup seal 536 with a posteriorly disposed secondary chamber 538 containing hydraulic fluid. The seal and reservoir arrangement deters air from entering the hydraulic circuit. If a leak develops in the hydraulic circuit, the position of the third piston 476 is no longer in calibration with the position of the fourth piston 506. Furthermore, in the transition to a maximum deflection 444, the third piston 476 will not fully advance the fifth piston 508 into its respective cylinder 540. In this case, a spring 542 urges the fifth piston 508 toward its stopping point, causing hydraulic fluid to bypass the cup seal 536 of the secondary chamber 538 and enter the fourth chamber 514, thereby filling the hydraulic circuit to its correct volume. As best shown in FIG. 58, ports 544 and 546 direct make-up fluid into the secondary chamber 538 and the fourth chamber 514 from an accumulator 548. The port 544 is configured to be blocked by the cup seal 536 after minute translation. This automatic calibration occurs every time the control pistons are fully recessed, i.e. when the pump is at maximum displacement. During periods of inactivity, the microprocessor may be programmed to position periodically the four-way valve 472 in position 3, and to retract the second and third pistons 474 and 476 in their respective cylinders, thus calibrating the circuit.

Figure 51:
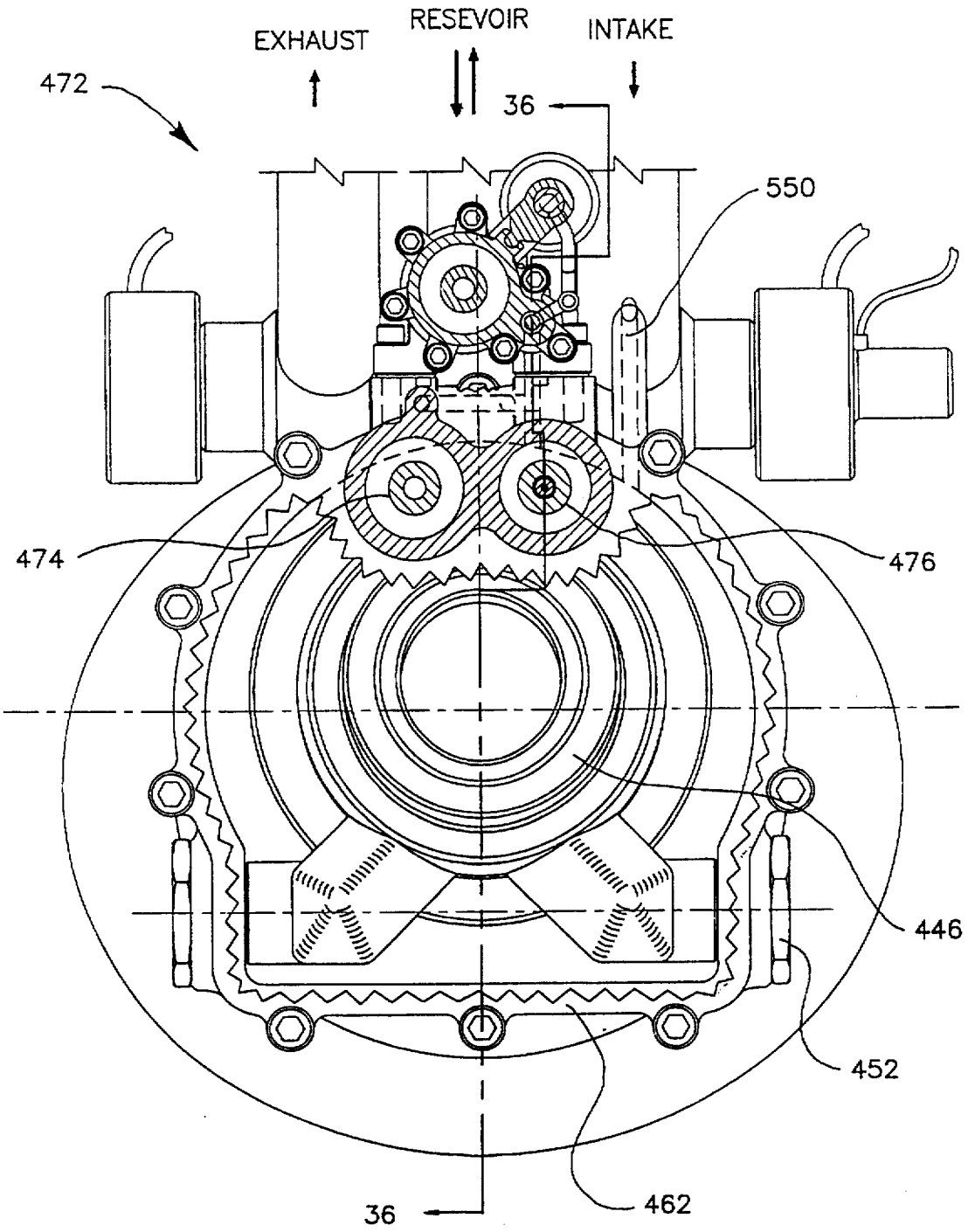
FIG. 51 is a cross-sectional detail view of the displacement control mechanism taken along line 51—51 of FIG. 36.
Figure 52:
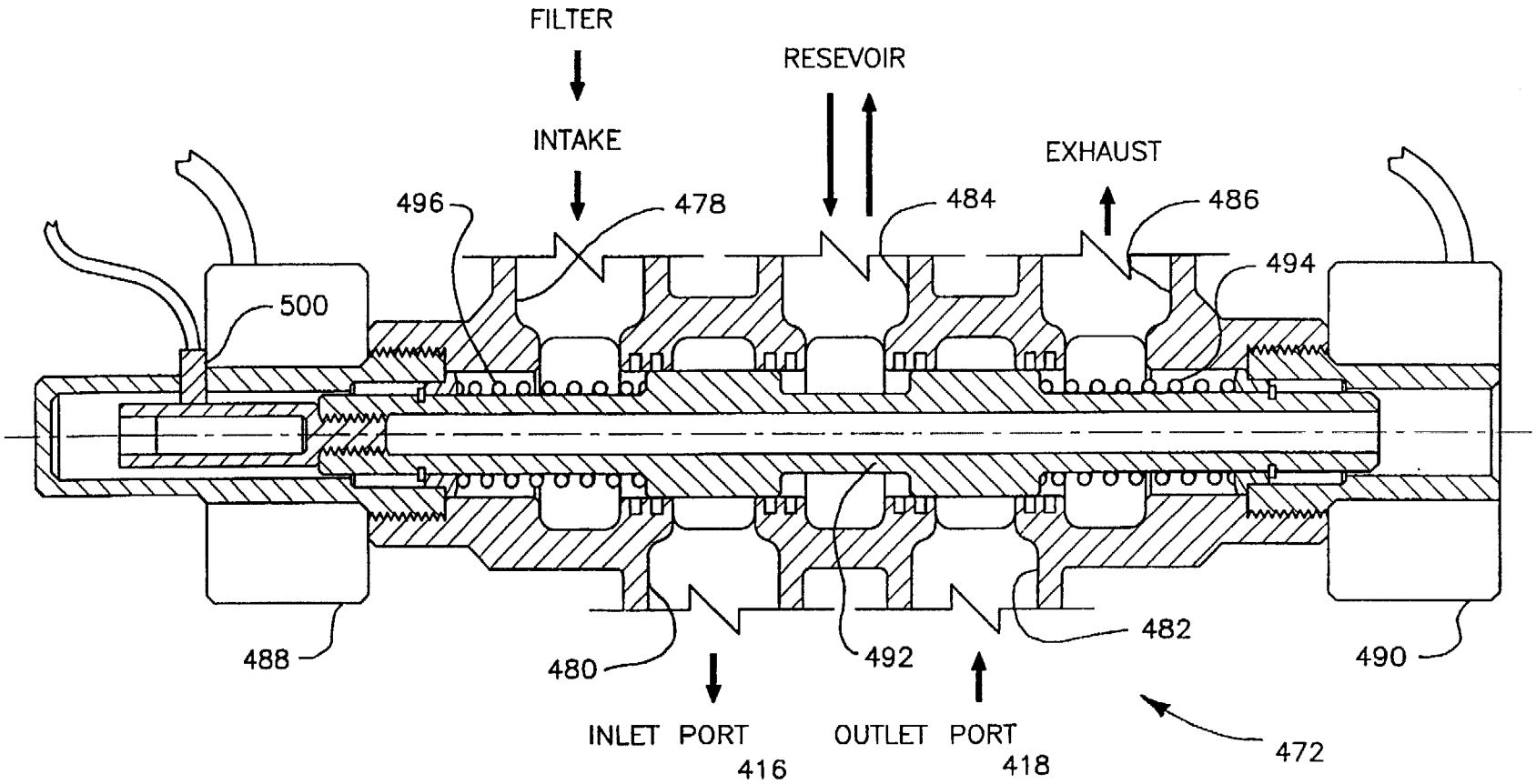
FIG. 52 is a cross-sectional detail view of the four-way valve taken along line 52—52 in FIG. 36.

Referring to FIGS. 36, 51 and 53, pressure acting against the first pistons 414 imparts a torque on the swash plate 434 about the pins 452. To balance this torque, the second and third pistons 474 and 476 act against the carriage 446 through linkages 531. The second chamber 510 receives high pressure air from the reservoir 122 which acts over the second piston 474. The second and third pistons 474 and 476 are not configured to overcome the forces imparted on the carriage 446 by the first pistons 414 individually. Rather, the second and third pistons 474 and 476 work in conjunction to balance the forces against the carriage 446. The force that the first pistons 414 and the second and third pistons 474 and 476 exert against each other are always in balance since the pressure acting over them is equal to the reservoir pressure. An alternative embodiment knot shown) would have the second piston 474 configured to overcome the force of the first pistons 414. The third piston 476 would act in conjunction with the first pistons 414 to overcome the force of the second piston 474. In this embodiment, the swash plate deflection 444 would seek its minimum value instead of the deflection 444 seeking a maximum value as described supra.

The sensor 532 located within the third piston 476 monitors its relative location. This value is evaluated by a microprocessor (not shown) with respect to predetermined data. The microprocessor processes the value and determines the pump displacement. The microprocessor calculates a displacement value which is employed as feedback for controlling the positioning of the second and third pistons 474 and 476 with respect to the displacement demands by the user.

Figure 59:
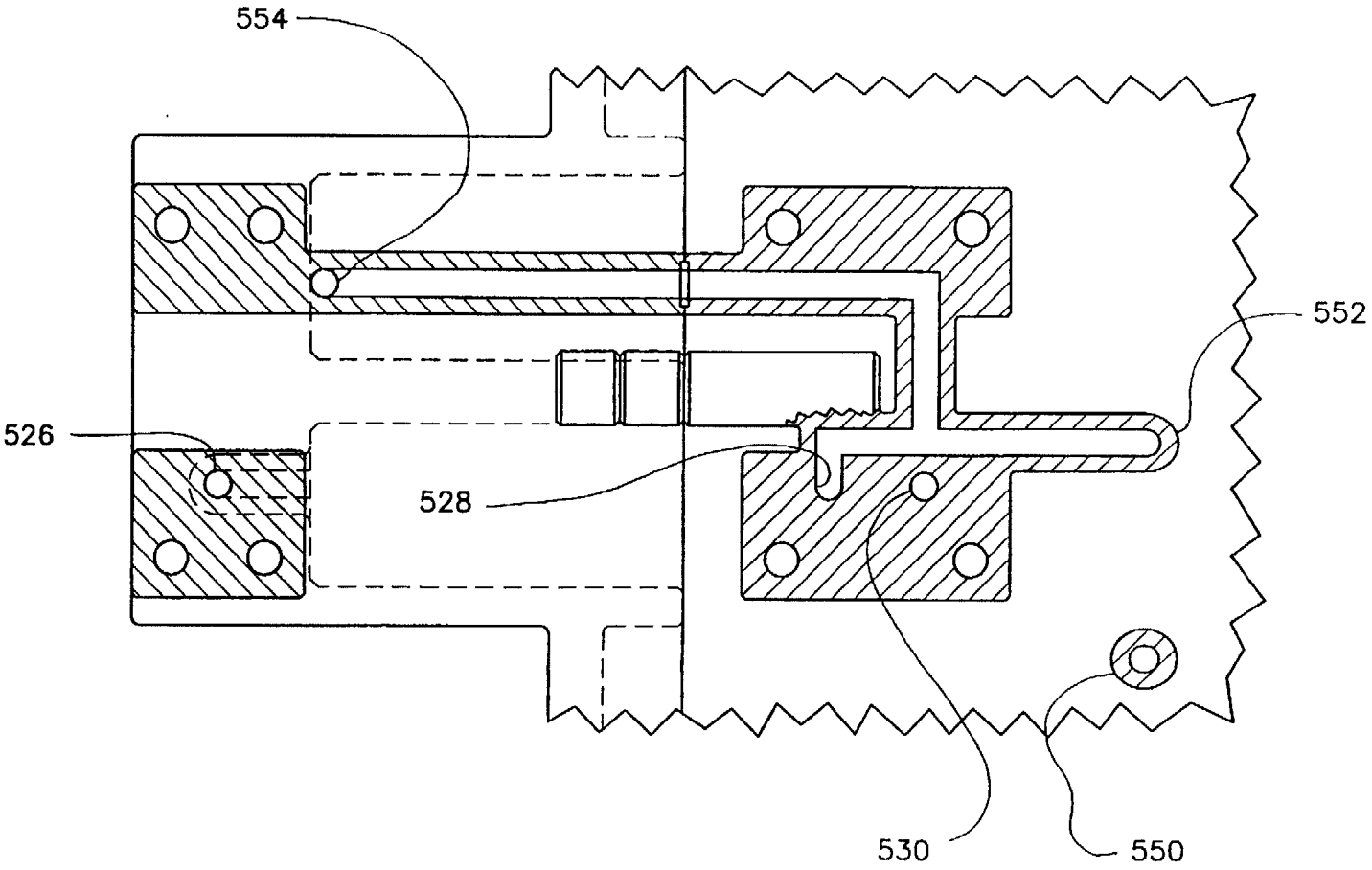
FIG. 59 is a cross-sectional detail view of the pressure vents drawn along line 59—59 of FIG. 36.

Referring to FIGS. 36, 51 and 59, a cross-sectional detail view of the porting scheme for the control unit is shown. A vent 550 permits fluid communication between the atmosphere and the pump housing 462. Air passing through port 530 is also vented via the vent 550. This minimizes any noise caused by high pressure air escaping through this port. High pressure air is drawn through a port 552 to feed both the second piston 474, via the port 554, and the port 528. Hydraulic fluid passes through port 526 into and out of the third piston 476.

E. Eccentric Ring-Type versus Axial Piston Pump Applications

An eccentric ring pump offers the advantages of being compact and relatively simple to manufacture compared to an axial piston pump. However, eccentric ring pumps have several shortcomings. First, under high pressure, oscillating forces imparted on the eccentric ring make positioning the ring difficult. Port damping may reduce the amplitude of these oscillating forces, however configuring ports to accommodate a variety shaft speeds and operating pressure differences is impractical. Furthermore, damped ports constrict the fluid flow through the pump and reduce overall efficiency. Second, at zero displacement, fluid leaks from the high pressure port to the low pressure port, since the pistons do not fully envelop the cylinders. Fluid from the high pressure port compresses residual air in the cylinders and vents that fluid to the low pressure port. Third, the force against the eccentric ring not only oscillates, it reverses direction as the shaft rotates. Fourth, the frequency of oscillations per revolution is relatively low. These disadvantages present the eccentric ring pump as an impractical braking device in high torque and high horsepower applications, such as automobiles and industrial machinery.

Although more costly and sophisticated, the axial pump disclosed is not limited by the shortcomings of the eccentric ring pump and is ideally suited for high torque and high horsepower applications.

The disclosed axial pump differs from the eccentric ring pump in several important ways. First, since the pin axis is configured such that it intersects the axis of the bottom most cylinder in the chamber barrel, when the pump is in the zero displacement position, the pistons fully envelop the cylinders, preventing leakage from the high pressure port to the Low pressure port. Second, the force of the pistons acting against the swash plate creates a net torque about the pin axis, consistently acting in one direction. Third, the great number of pistons each define a small working chamber with its respective cylinder, producing more, yet smaller oscillations. Higher oscillating frequencies produce less pronounced vibrations in the apparatus, provided the frequency does not approach the natural frequency of the apparatus.

F. Thermal Energy Storage and Reclamation

Referring again to FIG. 6, the present intention provides for storing heat generated during fluid compression in the reservoir. The reservoir 122 is surrounded by a chamber 600. The chamber 600 contains a thermally-excitable material, such as an aqueous salt solution. The solution receives from the reservoir 122 heat energy generated by increased fluid pressure within the reservoir 122 according to the ideal gas law. This material may be changed or supplemented via a filler aperture 602 in which a filler plug 604 is threadingly engaged. The filler plug 604 includes a diaphragm 606 for relieving excess pressure which may develop within chamber 600. Relieving the reservoir 122 of this heat energy promotes lower pressures within the reservoir 122, thus permitting incorporation of lighter weight and less costly equipment to carry out the invention. A relief valve 608 permits fluid communication between the reservoir 122 and the ambient atmosphere when interior fluid pressures levels test the limits of the reservoir 122. As pressure is relieved from the reservoir 122 and the reservoir 122 cools, the reservoir-surrounding material delivers stored heat energy back into the reservoir 122. As heat is added to the reservoir 122, fluid pressure increases therein. The thermal energy converted into fluid pressure is then fed into the hose 146. The present invention harnesses energy previously dissipated and permits the user to store and reclaim more kinetic energy associated with braking than with prior inventions.

The present invention. is not intended to be limited to the embodiments described above, but to encompass any and all embodiments within the scope of the following claims.

I claim:

1. A braking apparatus for a rotating element comprising:

a demand lever for selectively registering a demand for braking force and a demand for driving power;

an axial piston pump including:

a pump housing having an inlet port and an outlet port;

a chamber barrel, having a central axis, a first face, defining a first plane, a second face defined opposite said first face and a plurality of first chambers radially diverged about said central axis in said first plane, rotatably mounted on said pump housing, said chamber barrel including an output shaft drivingly connected to the rotating element;

a first piston received through said first face in each said first chamber;

a swash plate, having a third face, defining a third plane, a fourth face defined opposite said third face and a central axis, rotatably and pivotally mounted about a pivot axis on said housing;

a valve plate mounted on said housing, sealingly and slidingly contacting said second face of said chamber barrel, said valve plate including passages for conducting fluid between said inlet port and said first chambers being rotated away from said pivot axis, and between said outlet port and said first chambers being rotated toward said pivot axis;

said first plane and said third plane intersecting at said pivot axis and defining a displacement deflection between zero and a maximum, said displacement deflection being proportional to a displacement value of said pump;

mounting means for rotatably mounting each said first piston on said third face of said swash plate;

synchronizing means for urging said chamber barrel and said swash plate to rotate at substantially equal velocities;

said swash plate urging each said first piston to translate through its respective said first chamber as said swash plate is rotated, each said first piston being fully translated into its respective said first chamber when proximal to said pivot axis, each piston being fully withdrawn from its respective said first chamber when distal to said pivot axis;

a reservoir for receiving fluid;

conduit means for conveying fluid between said pump and said reservoir;

control means for adjusting the displacement of said pump in an amount corresponding to a selected one of said demand for braking force and said demand for driving power;

whereby, in response to said selected one of said demand for braking force and said demand for driving power, said control means establishes deflection between said swash plate and said chamber barrel, defining a displacement of said pump, said pump compressing fluid into said reservoir when configured to compress fluid and expanding fluid from said reservoir when configured to expand fluid responsive to said demand for braking force and said demand for driving power, respectively.

2. A braking apparatus for a rotating element as recited in claim 1, said reservoir including a jacket containing a thermally-excitable material which reacts endothermically to store thermal energy generated during compression of fluid within said reservoir and which exothermically releases energy stored during expansion to increase pressure within said reservoir as pressure is relieved therefrom.

3. A braking apparatus for a rotating element as recited in claim 2, wherein said thermally-excicable material is an aqueous salt solution.

4. A braking apparatus for a rotating element as recited in claim 1, said mounting means for rotatably mounting each said first piston on said third face of said swash plate including connecting rods interposed each said first piston and said swash plate, each said connecting rod having a first end terminating in a ball and a second end terminating in a ball, each said ball of each said first end being rotatably mounted on each said first piston, each said ball of each said second end being rotatably mounted on said swash plate.

5. A braking apparatus for a rotating element as recited in claim 1, wherein said valve plate has radial passages fostering efficient fluid communication between said first chambers and said inlet and outlet ports.

6. A braking apparatus for a rotating element as recited in claim 1, wherein said first chambers are concentrically diverged in at least two rings of said first chambers.

7. A braking apparatus for a rotating element as recited in claim 6, wherein said first chambers are annularly offset relative to one of said first chambers within at least one of said concentric rings.

8. A braking apparatus for a rotating element as recited in claim 1, including enabling means for operably connecting said braking apparatus with the rotating element, said braking apparatus thereby becoming responsive to said selected one of said demand for braking force and said demand for driving power.

9. A braking apparatus for a rotating element as recited in claim 8, said enabling means comprising:

an enabling lever for registering an enabling demand;

a first piston contacting said enabling lever, said first piston disposed within a first cylinder containing fluid;

a hydraulic clutch for connecting said pump to the rotating element including a second piston disposed in a second cylinder, said second cylinder being in fluid communication with said first cylinder;

a hydraulic reservoir closure for maintaining fluid communication between said reservoir and said pump responsive including a third piston disposed in a third cylinder, said third cylinder being in fluid communication with said first cylinder;

whereby actuation of said enabling lever translates said first piston through said first cylinder and urges fluid therefrom into said second cylinder and said third cylinder, urging translation of said second and said third pistons, respectively, thereby operably connecting said hydraulic clutch and opening said hydraulic reservoir closure.

10. A braking apparatus for a rotating element as recited in claim 8, said enabling means comprising:

a enabling lever for registering an enabling demand;

a first sensor, responsive to said enabling lever, generating an enabling demand;

an electronic clutch for connecting said pump to the rotating element including a first solenoid connected to said clutch for engagement thereof;

an electronic reservoir closure for providing fluid communication between said reservoir and said pump including a second solenoid connected to said reservoir closure for selectably opening it;

a microprocessor for receiving said enabling demand and directing energy to said first and said second solenoids;

whereby actuation of said enabling lever urges said first sensor to generate said enabling demand which is received by said microprocessor, said microprocessor directing energy to said first and said second solenoids, respectively, thereby operably connecting said hydraulic clutch and opening said hydraulic reservoir closure.

11. A braking apparatus for a rotating element as recited in claim 1, including configuring valve means for configuring said pump to compress or expand fluid comprising:

a valve housing;

a valve slidingly received by and translatable between a first, a second and a third position within said valve housing;

said valve, in said first position, promoting fluid communication between said inlet port of the said pump and the atmosphere, and between said outlet port of said pump and said reservoir, said pump thereby configured to compress fluid into said reservoir from the atmosphere;

said valve, in said second position, promoting fluid communication between the said inlet port of said pump and said reservoir, and between said outlet port of said pump and the atmosphere, said pump thereby configured to expand fluid from said reservoir into the atmosphere;

said valve, in said third position, discouraging fluid communication through said configuring valve means.

12. A braking apparatus for a rotating element as recited in claim 11, said control means for controlling pump displacement comprising:

a first transmission means for imparting fluid pressure from said reservoir against said fourth face of said swash plate, said fluid pressure opposing the force of said first pistons acting against said third face of said swash plate, said swash plate either being urged toward said chamber barrel or away from said chamber barrel depending on the configuration of said first transmission means;

a second transmission means for imparting fluid pressure from said reservoir against a predetermined one of said fourth face and said third face of said swash plate, depending on the configuration of said first transmission means defining a natural direction of rotation in which said swash plate moves, said second transmission means configured to oppose said direction said swash plate moves as determined by said first transmission means configuration;

said second transmission means including a regulating valve means for regulating fluid communication between the atmosphere and said second transmission means and between said reservoir and said second transmission means;

offset means responsive to an input signal defining said swash plate deflection and said pump displacement;

said offset means configured to offset said valve means in a first direction relative to said second transmission means, initiating fluid communication between the atmosphere and said second transmission means, in combination with said first transmission means, allowing said swash plate to pivot in said natural direction;

said regulating valve means being articulated as said swash plate is pivoted until said valve means interrupts fluid communication between the atmosphere and said second transmission means, said pump compressing or expanding at a new fixed displacement;

said offset means configured to offset said valve means in a second direction relative to said second transmission means, initiating fluid communication between said reservoir and said second transmission means, said second transmission means, in combination with said first transmission means, urging said swash plate to pivot against said natural direction;

said regulating valve means being articulated as said swash plate is pivoted until said valve means interrupts fluid communication between said reservoir and said second transmission means, said pump compressing or expanding at a new fixed displacement.

13. A braking apparatus for a rotating element as recited in claim 12, wherein:

said first transmission means for imparting said fluid pressure from said reservoir against said fourth face of said swash plate comprises:

a second piston pivotally mounted on said fourth face of said swash plate;

said pump housing including a second piston chamber receiving said second piston;

conduit means providing fluid communication between said reservoir and said second piston chamber, said fluid urging said second piston against said swash plate;

said second transmission means for imparting said fluid pressure from said reservoir against a predetermined one of said fourth face and said third face of said swash plate comprises:

a third piston pivotally mounted on said fourth face or said third face of said swash plate;

said pump housing including a third piston chamber receiving said third piston;

said pump housing including a fourth piston chamber and a fifth piston chamber;

a fourth piston disposed in said fourth piston chamber in hydraulic fluid communication with said third piston chamber;

a fifth piston disposed in said fifth piston chamber and connected to and movable synchronously with said fourth piston;

said offset means for offsetting said regulating valve means relative to said second transmission means includes a translation means, with a first spool translatable thereby, said translation means being mounted to said fourth piston; and said regulating valve means for regulating said fluid pressure against said fourth face of said swash plate includes a second spool mounted relative to said first spool, said second spool selectably fostering simultaneous fluid communication between the atmosphere and said fifth piston chamber, and between said third piston chamber and said fourth piston chamber, when said second spool is translated in a first direction, said second spool selectably fostering simultaneous fluid communication between said reservoir and said fifth piston chamber, and between said third piston chamber and said fourth piston chamber, when said second spool is translated in a second direction;

whereby actuation of said translation means, offsetting said second spool in a said first direction relative to said fourth piston and said fifth piston, provides fluid communication between the atmosphere and said fifth piston chamber, and between said third piston chamber and said fourth piston chamber, thereby permitting said swash plate, pivoting in its natural direction of rotation against said third piston, to urge fluid from said third chamber against said fourth piston, said fourth piston urging said fifth piston, said translation means, said first spool and said second spool to translate until said second spool interrupts fluid communication between the atmosphere and said fifth piston chamber, and between said third piston chamber and said fourth piston chamber;

said third and fourth pistons being hydraulically locked within said third and fourth piston chambers respectively, when fluid communication therebetween is interrupted by said second spool, said swash plate in turn being held in place by said third piston, whereby activation of said translation means, offsetting said second spool in said second direction relative to said fourth piston and said fifth piston, provides fluid communication between said reservoir and said fifth piston chamber, and between said third piston chamber and said fourth piston chamber, thereby permitting fluid from said reservoir to urge said fifth piston, said fourth piston, said translation means, said first spool and said second spool to translate until said second spool interrupts fluid communication between said reservoir and said fifth piston chamber, and between said third piston chamber and said fourth piston chamber, said fourth piston, during translation, urging fluid from said fourth piston chamber against said third piston, said third piston urging said swash plate against its said natural direction of rotation, said third and fourth pistons being hydraulically locked within said third and fourth piston chambers respectively, when fluid communication therebetween is interrupted by said second spool, said swash plate in turn being held in place by said third piston.

14. A braking apparatus for a rotating element as recited in claim 13, further including:

a hydraulic line providing hydraulic fluid communication between said fourth piston chamber and said third piston chamber, said hydraulic line having a constriction whereby any oscillations of said swash plate are damped as said swash plate is pivoted relative to said chamber barrel.

15. A breaking apparatus for a rotating element as recited in claim 13, further including:

a hydraulic line providing hydraulic fluid communication between said fourth piston chamber and said third piston chamber;

accumulator means for replenishing fluid lost from said hydraulic line between said third piston chamber and said fourth piston chamber.

16. A braking apparatus for a rotating element as recited in claim 15, said accumulator means comprising:

a first fluid receptacle in fluid communication with said fourth piston chamber;

said fourth piston interrupting fluid communication between said first fluid receptacle and said fourth piston chamber when said fourth piston is offset from a fully recessed position.

17. A braking apparatus for a rotating element as recited in claim 13, wherein said second spool is configured such that fluid communication between said reservoir and said fifth piston chamber occurs prior to fluid communication between said third piston chamber and said fourth piston chamber thereby forming in part a hysteresis means whereby said axial piston pump is saved from abrupt, hammering shifts that may degrade its structural integrity.

18. A braking apparatus for a rotating element as recited in claim 13, wherein said translation means is a solenoid.

19. A braking apparatus for a rotating element as recited in claim 18, including spring means for biasing said solenoid and said first spool relative to each other.

20. A braking apparatus for a rotating element as recited in claim 18, wherein said control means for adjusting pump displacement includes:

a pressure sensor disposed within said reservoir generating a pressure value;

said solenoid having an output shaft connected to said first spool of said pump for translation thereof;

a microprocessor, responsive to said pressure value and said selected one of said demand for braking force and said demand for driving power, provided with data for generating a braking capability value based on said pressure value, said microprocessor generating a pump displacement value based on said braking capability value and said microprocessor directing energy to said first solenoid corresponding to said displacement value when said demand lever registers said demand for braking force.

21. A braking apparatus for a rotating element as recited in claim 20, including an auxiliary braking means including:

a calliper brake mounted proximate to the rotating element and capable of causing an auxiliary braking force to be applied to said rotating element;

an auxiliary brake solenoid having an output shaft operably connected to said calliper brake for actuating it, said auxiliary brake solenoid being responsive to said microprocessor;

said microprocessor further being provided with data correlating an auxiliary braking value to the difference between said braking capability value and said demand for braking force, said microprocessor directing energy to said auxiliary brake solenoid corresponding to said auxiliary braking value.

22. A braking apparatus for a rotating element as recited in claim 20, including an auxiliary driving means including:

an auxiliary power plant capable of applying an auxiliary driving power to said rotating element, said auxiliary power plant providing said auxiliary driving power responsive to said microprocessor, said microprocessor further being provided with data correlating a driving capability value based on said pressure value, said microprocessor deriving an auxiliary driving value based on the difference between said driving capability value and said demand for driving power, and said microprocessor employing said auxiliary power plant in an amount corresponding to said auxiliary driving value when said demand lever registers said demand for driving power.

23. An axial piston pump comprising:

a pump housing having an inlet port and an outlet port;

a chamber barrel, having a central axis, a first face, defining a first plane, a second face defined opposite said first face and a plurality of first chambers radially diverged about said central axis in said first plane, rotatable mounted on said pump housing, said chamber barrel including an output shaft drivingly connected to the rotating element;

a first piston received through said first face in each said first chamber;

a swash plate, having a third face, defining a third plane, a fourth face defined opposite said third face and a central axis, rotatably and pivotally mounted about a pivot axis on said housing;

a valve plate mounted on said housing, sealingly and slidingly contacting said second face of said chamber barrel, said valve plate including passages for conducting fluid between said inlet port and said first chambers being rotated away from said pivot axis, and between said outlet port and said first chambers being rotated toward said pivot axis;

said first plane and said third plane intersecting at said pivot axis and defining a displacement deflection between zero and a maximum, said displacement deflection being proportional to a displacement value of said pump;

mounting means for rotatably mounting each said first piston on said third face of said swash plate;

synchronizing means for urging said chamber barrel and said swash plate to rotate at substantially equal velocities;

said swash plate urging each said first piston to translate through its respective said first chamber as said swash plate is rotated, each said first piston being fully translated into its respective said first chamber when proximal to said pivot axis, each piston being fully withdrawn from its respective said first chamber when distal to said pivot axis.

24. The axial piston pump according to claim 23, said mounting means for rotatably mounting each said first piston on said third face of said swash plate including connecting rods interposed each said first piston and said swash plate, each said connecting rod having a first end terminating in a ball and a second end terminating in a ball, each said ball of each said first end being rotatably mounted on each said first piston, each said ball of each said second end being rotatably mounted on said swash plate.

25. The axial piston pump according to claim 23, wherein said valve plate has radial passages fostering efficient fluid communication between said first chambers and said inlet and outlet ports.

26. The axial piston pump according to claim 23, wherein said first chambers are concentrically diverged in at least two rings of said first chambers.

27. The axial piston pump according to claim 26, wherein said first chambers are annularly offset relative to one of said first chambers within at least one of said concentric rings.

28. The axial piston pump according to claim 23, including configuring valve means for configuring said axial piston pump to compress or expand fluid comprising:

a valve housing;

a valve slidingly received by and translatable between a first, a second and a third position within said valve housing;

said valve, in said first position, promoting fluid communication between said inlet port of the said pump and a low pressure source, said pump thereby configured to compress fluid into a high pressure source from said low pressure source;

said valve, in said second position, promoting fluid communication between said inlet port of said pump and said high pressure source, said pump thereby configured to expand fluid from said high pressure source into said low pressure source;

said valve, in said third position, discouraging fluid communication through said configuring valve means.

29. The axial piston pump according to claim 23, including control means for adjusting the displacement of said pump in an amount corresponding to an input signal;

whereby, in response to said input signal, said control means establishes deflect-on between said swash plate and said chamber barrel, defining a displacement of said pump.

30. The axial piston pump as recited in claim 29, said control means for controlling pump displacement comprising:

a first transmission means for imparting fluid pressure from said high pressure source against said fourth face of said swash plate, said fluid pressure opposing the force of said first pistons acting against said third face of said swash plate, said swash plate either being urged toward said chamber barrel or away from said chamber barrel depending on the configuration of said first transmission means;

a second transmission means for imparting fluid pressure from said high pressure source against a predetermined one of said fourth face and said third face of said swash plate, depending on the configuration of said first transmission means defining a natural direction of rotation in which said swash plate moves, said second transmission means configured to oppose said direction said swash plate moves as determined by said first transmission means configuration;

said second transmission means including a regulating valve means for regulating fluid communication between the atmosphere and said second transmission means and between said high pressure source and said second transmission means;

offset means responsive to said input signal defining said swash plate deflection and said pump displacement;

said offset means configured to offset said valve means in a first direction relative to said second transmission means, initiating fluid communication between the atmosphere and said second transmission means, in combination with said first transmission means, allowing said swash plate to pivot in said natural direction;

said regulating valve means being articulated as said swash plate is pivoted until said valve means interrupts fluid communication between the atmosphere and said second transmission means, said pump compressing or expanding at a new fixed displacement;

said offset means configured to offset said valve means in a second direction relative to said second transmission means, initiating fluid communication between said high pressure source and said second transmission means, said second transmission means, in combination with said first transmission means, urging said swash plate to pivot against said natural direction;

said regulating valve means being articulated as said swash plate is pivoted until said valve means interrupts fluid communication between said high pressure source and said second transmission means, said pump compressing or expanding at a new fixed displacement.

31. The axial piston pump as recited in claim 30, wherein:

said first transmission means for imparting said fluid pressure from said high pressure source against said fourth face of said swash plate comprises:

a second piston pivotally mounted on said fourth face of said swash plate;

said pump housing including a second piston chamber receiving said second piston;

conduit means providing fluid communication between said high pressure source and said second piston chamber, said fluid urging said second piston against said swash plate;

said second transmission means for imparting said fluid pressure from said reservoir against a predetermined one of said fourth face and said third face of said swash plate comprises:

a third piston pivotally mounted on said fourth face or said third face of said swash plate;

said pump housing including a third piston chamber receiving said third piston;

said pump housing including a fourth piston chamber and a fifth piston chamber;

a fourth piston disposed in said fourth piston chamber in hydraulic fluid communication with said third piston chamber;

a fifth piston disposed in said fifth piston chamber and connected to and movable synchronously with said fourth piston;

said offset means for offsetting said regulating valve means relative to said second transmission means includes a translation means, with a first spool translatable thereby, said translation means being mounted to said fourth piston; and said regulating valve means for regulating said fluid pressure against said fourth face of said swash plate includes a second spool mounted relative to said first spool, said second spool selectably fostering simultaneous fluid communication between the atmosphere and said fifth piston chamber, and between said third piston chamber and said fourth piston chamber, when said second spool is translated in a first direction, said second spool selectably fostering simultaneous fluid communication between said high pressure source and said fifth piston chamber, and between said third piston chamber and said fourth piston chamber, when said second spool is translated in a second direction;

whereby actuation of said translation means, offsetting said second spool in a said first direction relative to said fourth piston and said fifth piston, provides fluid communication between the atmosphere and said fifth piston chamber, and between said third piston chamber and said fourth piston chamber, thereby permitting said swash plate, pivoting in its natural direction of rotation against said third piston, to urge fluid from said third chamber against said fourth piston, said fourth piston urging said fifth piston, said translation means, said first spool and said second spool to translate until said second spool interrupts fluid communication between the atmosphere and said fifth piston chamber, and between said third piston chamber and said fourth piston chamber;

said third and fourth pistons being hydraulically locked within said third and fourth piston chambers respectively, when fluid communication therebetween is interrupted by said second spool, said swash plate in turn being held in place by said third piston, whereby activation of said translation means, offsetting said second spool in said second direction relative to said fourth piston and said fifth piston, provides fluid communication between said high pressure source and said fifth piston chamber, and between said third pIston chamber and said fourth piston chamber, thereby permitting fluid from said high pressure source to urge said fifth piston, said fourth piston, said translation means, said first spool and said second spool to translate until said second spool interrupts fluid communication between said high pressure source and said fifth piston chamber, and between said third piston chamber and said fourth piston chamber, said fourth piston, during translation, urging fluid from said fourth piston chamber against said third piston, said third piston urging said swash plate against its said natural direction of rotation, said third and fourth pistons being hydraulically locked within said third and fourth piston chambers respectively, when fluid communication therebetween is interrupted by said second spool, said swash plate in turn being held in place by said third piston.

32. The axial piston pump according to claim 31, further including:

a hydraulic line providing hydraulic fluid communication between said fourth piston chamber and said third piston chamber, said hydraulic line having a constriction whereby any oscillations of said swash plate are damped as said swash plate is pivoted relative to said chamber barrel.

33. The axial piston pump according to claim 31, further including:

a hydraulic line providing hydraulic fluid communication between said fourth piston chamber and said third piston chamber;

accumulator means for replenishing fluid lost from said hydraulic line between said third piston chamber and said fourth piston chamber.

34. The axial piston pump according to claim 33, said accumulator means comprising:

a first fluid receptacle in fluid communication with said fourth piston chamber;

said fourth piston interrupting fluid communication between said first fluid receptacle and said fourth piston chamber when said fourth piston is offset from a fully recessed position.

35. The axial piston pump according to claim 31, wherein said second spool is configured such that fluid communication between said high pressure source and said fifth piston chamber occurs prior to fluid communication between said third piston chamber and said fourth piston chamber thereby forming in part a hysteresis means whereby said axial piston pump is saved from abrupt, hammering shifts that may degrade its structural integrity.

36. The axial piston pump according to claim 31, wherein said translation means is a solenoid.

37. The axial piston pump according to claim 36, including spring means for biasing said solenoid and said first spool relative to each other.

* * * * *